US005359357A

United States Patent [19]

Takagi et al.

[11] Patent Number: 5,359,357

[45] Date of Patent: Oct. 25, 1994

[54] INK-JET RECORDING APPARATUS

[75] Inventors: Jun Takagi; Tatsuhiro Ishize; Hisayuki Kinoshita, all of Kanagawa, Japan

[73] Assignee: Fuji Xerox Co., Ltd., Tokyo, Japan

[21] Appl. No.: 33,801

[22] Filed: Mar. 18, 1993

[30] Foreign Application Priority Data

| | | | |
|---|---|---|---|
| Mar. 19, 1992 | [JP] | Japan | 4-064262 |
| Jul. 2, 1992 | [JP] | Japan | 4-175536 |
| Jul. 2, 1992 | [JP] | Japan | 4-175537 |
| Jul. 14, 1992 | [JP] | Japan | 4-186752 |
| Jul. 14, 1992 | [JP] | Japan | 4-187162 |
| Jul. 14, 1992 | [JP] | Japan | 4-187163 |

[51] Int. Cl.[5] ..... B41J 2/175; B41J 2/19

[52] U.S. Cl. ..... 347/49; 347/68; 347/92

[58] Field of Search ..... 346/140

[56] References Cited

U.S. PATENT DOCUMENTS

| | | | |
|---|---|---|---|
| 4,712,119 | 12/1987 | Kiyohara | 346/140 X |
| 4,771,295 | 9/1988 | Baker et al. . | |
| 5,148,194 | 9/1992 | Asai et al. | 346/140 |
| 5,155,502 | 10/1992 | Kimura et al. | 346/140 |

FOREIGN PATENT DOCUMENTS

| | | | |
|---|---|---|---|
| 0313205 | 4/1989 | European Pat. Off. | B41J 25/30 |
| 0378240 | 7/1990 | European Pat. Off. | B41J 2/17 |
| 0435696 | 7/1991 | European Pat. Off. | B41J 25/34 |
| 60-157865 | 8/1985 | Japan | B41J 3/04 |
| 61-41553 | 2/1986 | Japan | B41J 3/04 |
| 61-121940 | 6/1986 | Japan | B41J 3/00 |
| 61-121947 | 6/1986 | Japan | B41J 3/04 |
| 1-125238 | 5/1989 | Japan | B41J 3/04 |
| 2-78588 | 3/1990 | Japan | B41J 29/00 |
| 2-187364 | 7/1990 | Japan | B41J 2/175 |
| 2-198862 | 8/1990 | Japan | B41J 2/175 |
| 3-87266 | 4/1991 | Japan | B41J 2/175 |
| 3-203652 | 9/1991 | Japan | B41J 2/01 |

*Primary Examiner*—Joseph W. Hartary

*Attorney, Agent, or Firm*—Finnegan, Henderson, Farabow, Garrett & Dunner

[57] ABSTRACT

In an ink-jet recording apparatus, a replacement of a head carriage can be readily performed within a short time, and when the head cartridge is mounted on the head carriage, the mounting position is fixed. A head cartridge K arranged by a head supporting member F and an ink-jet recording head H includes an unloosen preventing member 55c. The head carriage C has a depression means 37 for depressing along a predetermined direction the head cartridge K under such a condition that the head cartridge is mounted on a head supporting member mounting portion 32, and also a loosen preventing member 35 engaged with the unloosen preventing member 55c when being depressed.

43 Claims, 30 Drawing Sheets

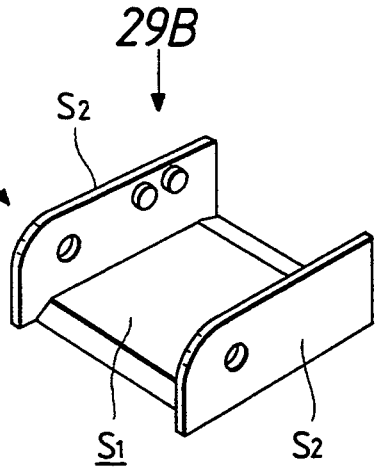
FIG. 29A
FIG. 29B
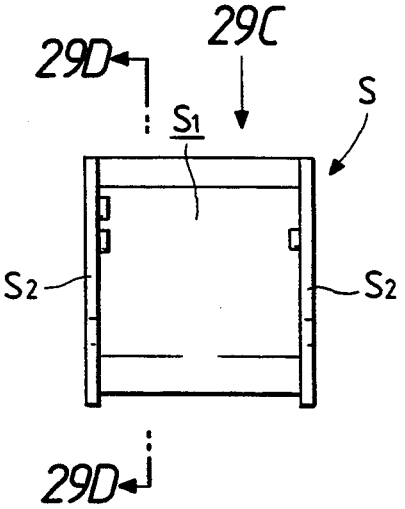
FIG. 29D
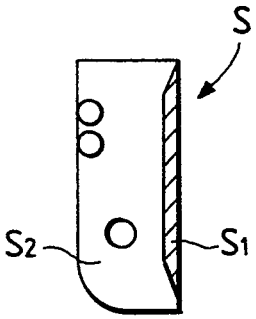
FIG. 29C
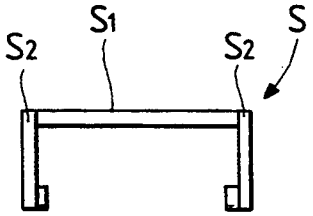

INK-JET RECORDING APPARATUS

BACKGROUND OF THE INVENTION

1. Field of the Invention

The present invention generally relates to an ink-jet recording apparatus for performing a recording operation by jetting ink stored in an ink tank as a recording fluid, from an ink exhausting outlet of an ink-jet recording head as droplets of the ink and then by attaching the ink droplets onto a medium to be recorded. More specifically, the present invention is directed to an ink-jet recording apparatus equipped with a head cartridge having a head supporting member on which an ink joint connectable to the ink tank is mounted, and an ink-jet recording head supported by this head supporting member, and also a head carriage on which this head cartridge is detachably mounted and which is reciprocated along a main scanning direction.

2. Description of Prior Art

An ink-jet recording apparatus owns specific features such as a high-speed printing operation and a low noise operation, and therefore have been widely utilized in the recent recording apparatus of the information processing apparatus.

In such an ink-jet recording apparatus, the ink-jet recording head must be replaced by a new ink-jet recording head due to malfunction or a lifetime of this ink-jet recording head, and also ink is refilled with the ink-jet recording head because of ink depletion. Conventionally, for the sake of easy replacement of the ink-jet recording head, the replacing head cartridge has been utilized which is arranged by the ink-jet recording head and the head supporting member for supporting this head.

To replace the above-described head cartridge, a correct positioning operation is required for the replaced new ink-jet recording head. Also, it is desired to refill ink into the ink tank without causing dirt of a finger of an operator when the depletion of ink is solved.

There are two solutions as the method for refilling ink into the ink tank in order that a finger of an operation is not darted by ink:

a). A method capable of detachably mounting a cartridge type ink tank on a head cartridge.

b). A method wherein an ink tank arranged at a proper position of an ink-jet recording apparatus is connected with a carriage-side ink connection member mounted on the carriage by an ink flow path, and when the head cartridge is mounted on the head carriage, the head cartridge-side ink connection portion is automatically connected to the carriage-side ink connection portion.

When these methods (a) and (b) are employed, it is preferable to easily replace the head cartridge within a short time. When the method (a) is employed, it is preferable to easily replace the ink tank within a short time.

The above-described conventional method capable of replacing the ink-jet recording head is described in, for instance, Unexamined Japanese Patent Publication (Kokai) Sho-60-157865/(1975). However, since the ink-jet recording head of this prior art is fixed by employing the rubber member, there is a problem in positioning precision of the ink-jet recording head.

Further, in Unexamined Japanese Patent Publication (Kokai) Hei-2-198862/(1990), such a conventional technique has been opened that with respect to the head carriage reciprocated along the main scanning direction (main-scanning carrier), the ink-jet recording head and the ink tank are assembled in an integral form, which is then fixed by the fixing lever. In accordance with this second prior art, even when only the ink tank must be replaced, the integrated body of the ink-jet recording head and the ink tank must be removed, or separated from the head carriage. As a result, when only the ink tank is replaced, such a waste workload is required that the ink-jet recording head is removed from the head carriage and again mounted thereon.

It should be noted in this Unexamined Japanese Patent Publication Hei-2-198862 that the following descriptions are made, that is, "since no ink is leaked from any one of the recording head portion 2 and the ink tank 3 during the replacement, the ink tank can be replaced on the carriage", and "it is of course possible to replace the ink tank on the carriage in accordance with any preferred embodiments". However, there is no such a description about the method for fixing the recording head portion 2 with respect to the head carriage. Accordingly, there is no description that only ink tank can be readily replaced within a short time, while the recording head portion 2 remains fixed on the head cartridge.

If the above-described method (b) is employed, then there are the following problems:

That is, to prevent ink caked in the ink exhausting outlets of the ink-jet recording head in the ink-jet recording apparatus, the capping unit for sealing the ink exhausting outlets is employed. When the head carriage is stopped at the home position, this capping unit depresses the sealing cap against the peripheral portion of the ink exhausting outlets, namely the tip portion of the head cartridge. In this case, if the position of the head cartridge is not firmly fixed on the head cartridge, the head cartridge is moved on the head cartridge. Such a cartridge movement may cause that the head cartridge-side ink connection portion is mutually moved with respect to the carriage-side ink connection portion. Such a mutual movement between the head cartridge-side ink connection portion and the carriage-side ink connection portion may cause ink leakage at these ink connection portions.

If the head carriage is vibrated, there is a risk that a relative small movement happens to occur between the head cartridge-side ink connection portion and the carriage-side ink connection portion. As a consequence, the ink connection portions must be constructed in order not to cause such an ink leakage even when the above-described relative small movement happens to occur.

SUMMARY OF THE INVENTION

The present invention has been made in an attempt to solve the above-described various problems, and therefore has a major object to achieve the following item (A) in such an ink-jet recording apparatus for performing a printing operation with employment of a head cartridge (namely, head cartridge having an ink-jet recording head) detachably provided on a head carriage reciprocated along a main scanning direction. Also, the present invention has other objects Go achieve the below-mentioned items (B) to (X).

(A). Replacement of a head cartridge can be easily performed within a short time period, and a fixing position when the head cartridge is mounted to a head carriage is not moved.

(B). In case that an ink tank is detachably connected to the head cartridge, either a head cartridge having an ink-jet recording head, or an ink tank can be readily replaced within a short time. Also, replacement of only an ink tank can be done without removing the head cartridge from the head carriage.

(C). An ink-jet recording apparatus capable of solving the above items (A) and (B) can be realized with employment of a simple structure.

(D). In case that the ink tank is detachably arranged with the head cartridge, the ink tank can be replaced without any ink leakage.

(E). When the ink tank is replaced, a new ink tank can be easily and correctly mounted at a predetermined mounting position.

(F). The above item (E) is realized with employment of a simple construction.

(G). In case that the ink tank is detachably arranged with the head cartridge, a sealing characteristic established between the ink tank and the ink connection portion (joint) at the head cartridge side to which this ink tank is connected, is improved to prevent ink leakage from this ink connection portion.

(H). When the ink tank is replaced, no air is entered inside the ink connection portion (namely, ink joint inside communicated with the ink exhausting outlets of the ink-jet recording head) at the head cartridge side to which the ink tank is connected.

(I). It is prevented that contamination is entered into ink supplied to the ink exhausting outlets of the ink-jet recording head.

(J). A moving characteristic of ink toward a down stream side of the ink joint connected to the ink tank is improved.

(K). Connections/disconnections between the ink tank and the ink-jet recording head, and between the ink-jet recording read and the head carriage can be easily performed.

(L). In the ink-jet recording apparatus having a plurality of ink tanks and a plurality of ink tanks and a plurality of ink-jet recording heads so as to carry out a color recording with employment of different color ink, the ink tanks and the ink-jet recording heads corresponding to the different color ink can be separately and readily replaced.

(M). When the ink-jet recording head is firmly fixed to a predetermined position of the head carriage, and only the ink tank is removed while mounting the ink-jet recording head on the head carriage, even if a force for removing the ink tank is given to the ink-jet recording head, the ink-jet recording head is firmly fixed on the head carriage.

(N). The above item (M) is realized with a simple structure.

(O). In case that the head cartridge has such a tank holder for holding the ink tank, the structures of the tank holder and the head carriage for supporting this tank holder can be made simple, and also can be easily manufactured. When such an ink-jet recording apparatus is manufactured which includes a plurality of ink tanks and a plurality of ink-jet recording heads to perform a color recording with employment of different color ink, the plural ink tanks and the plural ink-jet recording heads corresponding to these different color ink can be arranged at an effective space efficiency.

(P). Even when the tank holder coupled to the ink-jet recording head in an integral form, arranged on the head carriage, is moved along the depression direction of the depression member, and also moved along a direction perpendicular to the depression direction, the tank holder can be held at predetermined positions along said depression direction and said vertical direction. Also, when a plurality of tank holders carriage in an array form, these tank holders can be moved along the array direction, so that the respective ink tanks can be maintained at predetermined positions along the array direction.

(Q). When the ink-jet recording head is replaced, a connection terminal portion of a circuit portion of a new ink-jet recording head is automatically connected with the connection terminal portion of the carriage side.

(R). A simple assembling work of the circuit portions mounted on the head carriage is realized.

(S). A protection can be made between an external circuit connection terminal portion and the circuit portion mounted on the ink-jet recording head.

(T). In case that a shutter is provided to cover the connection terminal portion of the flexible cable of the ink-jet recording head, when the ink-jet recording head is mounted on the head carriage, the shutter is automatically opened/released, so that the ink-jet recording head can be replaced without paying any attention to the opening/closing conditions of the shutter.

(U). When the ink tank and the ink-jet recording head are replaced, these replacement works can be simply performed over the head carriage.

(V). In case that the joint connection member connected via the flexible ink supply tube to the ink tank fixed at a proper position, when the head cartridge is mounted on the head carriage, the ink joint of the head cartridge can be easily connected with the joint connection portion without any ink leakage.

(W). The above item (V) can be achieved, and the ink joint and the joint connection portion can be easily manufactured.

(X). Even when the ink joint is positionally shifted with regard to the joint connection portion, a proper connection condition can be achieved. Also, even if a relative movement happens to occur between them due to vibrations thereof, a watertight connection condition can be maintained without any damage.

It should be noted that various structures of this ink-jet recording apparatuses according to the present invention will now be described so as to achieve the above-explained various items, and for the sake of easy understandings of relationships between reference numerals and constructive elements employed in the below-mentioned preferred embodiments, the reference numerals will be employed as those for denoting the relevant constructive elements. However, these reference numerals are not employed to limit the technical spirit and scope of the present invention.

To achieve the above-described items, in accordance with an ink-jet recording apparatus (U) of a first aspect of the invention, comprising:

a head cartridge (K, K1, K2) including a head supporting member (F, 161,181) in which an ink tank and an ink joint (65) communicatable with said ink tank are provided, a head chip (74, 174) mounted on a tip portion of a heat sink (70, 171) fixed to said head supporting member (F, 161, 181), and having a plurality of ink exhausting outlets;

and ink-jet recording head (H) arranged by an ink supply path for communicating said plurality of ink exhausting outlets with an inside of said ink joint; (65, 164, 184); and a head carriage (C) reciprocated along a main scanning direction and to which said head cartridge (K, K1, K2) is detachably mounted;

the first ink-jet recording apparatus is characterized in that;

said head supporting member (F, 161, 181) has an unloosen preventing member (55*c*, 162*b*, 162*e*, 182*b*, 182*e*);

said head carriage (C) includes;

a head supporting member mounting portion (32, 122*b*, 122*c*, 123*b*, 123*c*) on which said head supporting member (F, 161, 181) can be slidably mounted;

an insertion guide wall (27, 28, 29, 122*a*, 123*a*) for guiding said head supporting member (F, 161, 181) to be inserted into said head supporting member mounting portion (32, 122*b*, 122*c*, 123*b*, 123*c*);

a head passing through hole (33, 122, 123) through which said tip portion of said ink-jet recording head (H) under such a condition that said head supporting member (F, 161, 181) is mounted on said head supporting member mounting portion (32, 122*b*, 122*c*, 123*b*, 123*c*);

a depression member (37:151) for depressing said head supporting member (F, 161, 181) along a direction intersecting with said insertion direction to be moved on said head supporting member mounting portion (32, 122*b*, 122*c*, 123*b*, 123*c*) under such a condition that said head supporting member (F, 161, 181) is mounted on said head supporting member mounting portion;

a loosen preventing member (35, 122*c*, 122*d*, 123*c*, 123*d*) engaged with said unloosen preventing member (55*c*, 162*c*, 162*e*, 182*b*, 182*e*) of said head supporting member (F, 161, 181) depressed by said depression member (37, 151) in order to block a movement of said head supporting member (F, 161, 18) along a direction opposite to said insertion direction; and a mounting state holding means (154) for holding a position of said depression member (37, 151) under such a cartridge mounting condition that said unloosen preventing member (55*c*, 162*b*, 162*e*, 182*b*, 182*e*) is engaged with said loosen preventing member.

An ink-jet recording apparatus (U) according to a second aspect of the invention is characterized in that;

said depression member (37, 151) is arranged by a pivot lever (37*a*, 152) pivotably journaled to the head carriage, and a cam member (37*b*, 152*b*) pivoted with said pivot level (37*a*, 152) in an integral form, and having a depression cam plane abutting to a front surface of said head supporting member (F, 161, 181).

An ink-jet recording apparatus (U) according to a third aspect of the invention is characterized in that:

said mounting condition holding means has a mounting condition holding surface which is formed locally lower than the abutting plane of said pression cam plane abutting on the outer side view of said head supporting member (F) when said abutting portion of said depression cam plane abutting at said outer side plane of said head supporting member (F) is abutted to said abutting portion of the depression cam plane and said pivot lever (37*a*) of said depression member (37) is rotated from the cartridge mounting state to the depressed side.

An ink-jet recording apparatus (U) according to a fourth invention is characterized in that:

said mounting condition holding means is provided between said pivot lever (152) and a member (106) for pivotably supporting said pivot lever (152), and has a tension spring (1549 for pivoting said pivot lever (152) along the depression direction when said pivot lever (152) is pivoted from a predetermined pivot position to a depression side.

Also, to achieve the above-described items, an ink-jet recording apparatus (U) according to a fifth aspect of the invention is characterized in that:

said head supporting member (F) is constructed of a holder bottom wall (F1) on which an ink joint (65) is provided, a holder said wall (54:62) for guiding an ink tank (T) inserted toward said holder bottom wall (F1) to said bottom wall (F1), and an unloosen preventing member detachably engaged with a loosen preventing member (55*c*) arranged on at a least one of outer side surfaces of said holder bottom wall (F1) and said holder side wall (54, 62); and said ink tank (T) owns an ink storage space therein, and a joint connection member (81*b*) formed on a bottom plane thereof, said joint connection member (81*b*) being connected with the ink joint (65) when being depressed against the ink joint (65) formed on said holder bottom wall, whereby an inside of the ink tank is communicated with an inside of the ink joint, and separated from the ink joint (65) when a tension force along a separation direction from the ink joint is exerted.

An ink-jet recording apparatus (U) according to a sixth aspect of the invention is characterized in that:

an atmospheric communication hole (82*b*) for communicating an ink storage space with the external atmosphere is provided within said ink tank (T), and a porous ink holding body (83) is stored into the ink storage space inside the ink tank (T).

An ink-jet recording apparatus (U) according to a seventh aspect of the invention is characterized in that:

a stopped member (81*a*) for positioning purpose is provided on said side surface of the tank, said stopped member (81*a*) is stopped at the holder side wall (54:62) of the tank holder (F) to position said ink tank (T), which is performed by a stopping member (54*d*, 62*b*).

An ink-jet recording apparatus (U) according to an eighth aspect of the invention is characterized in that:

said stopped member (81*d*) is a semi-spherical projection, said stopping member (54*d*, 62*b*) is a stopping hole (54*d*, 62*b*) formed on said holder side wall (54, 62), and said holder side wall portion (54, 62) on which said stopping hole is made, has an elastic characteristic capable of deforming toward an outside.

An ink-jet recording apparatus (U) according to a ninth aspect of the invention is characterized in that, two parallel slits (54*c*, 62*a*) re formed from the side planes of said holder side wall (54, 62) and said stopping hole (54*d*, 62*b*) is arranged between said two parallel slits.

An ink-jet recording apparatus (U) according to a tenth aspect of the invention is characterized in that:

said joint connecting member (81*b*) of the ink tank (T) is arranged by a circular through hole (81*b*) formed on a tank bottom surface, said ink joint (65) has a cylindrical portion passing through said through hole, and a seal ring (66) is mounted on an outer peripheral portion of said cylinder portion, which abuts on the outer side surface of the ink tank (T) around said through hole (81*b*).

An ink-jet recording apparatus (U) according to 11th aspect of the invention is characterized in that:

a closing member is provided in said ink tank (T), which closes said through hole until it is destroyed, and which is easily destroyed when it is depressed against the ink joint (65).

An ink-jet recording apparatus (U) according to 12th aspect of the invention is characterized in that;

a porous body (68) is stored inside said cylinder portion of the ink joint (65).

An ink-jet recording apparatus (U) according to 13th aspect of the invention is characterized in that;

said porous body (68) stored into an inside of said cylindrical portion of said ink joint (65) has a density lower than that of the inner holding body (839 stored inside said ink tank (T).

An ink-jet recording apparatus (U) according to 14th aspect of the invention is characterized in that;

in the ink joint (65), a filter (67) is provided at a boundary portion between a cylindrical inside of the ink joint and the ink storage space of the ink tank (T).

An ink-jet recording apparatus (U) according to 15th aspect of the invention is characterized in that:

a plurality of head supporting member mounting portions (32), head through holes (33), insertion guide walls (27, 28, 29), depression members (37) and loosen preventing members (34) are provided within said head carriage (C).

An ink-jet recording apparatus (U) according to 16th aspect of the invention is characterized in that;

said unloosen preventing member (55*c*) is arranged by one pair of "L" shaped pawl (55*a*) having a projection portion projecting from said holder bottom wall (F1) outer side surface outwardly, and a loosen preventing portion formed at a tip portion of said projection portion and extends in parallel with said holder bottom wall F outer side surface; and said unloosen preventing member (35) is constructed of a held portion held by the holder bottom wall (F) and said "L"-shaped pawl loosen preventing portion when said head supporting member is depressed by said depressing member (37) under such a condition that said holder bottom wall of the head supporting member is supported to said head supporting member mounting portion (32).

An ink-jet recording apparatus according to 17th aspect of the invention, is characterized in that:

said depression member (37) includes an eccentric cam (37*b*) having a depression cam plane abutting at one side wall of said tank holder (F).

An ink-jet recording apparatus (U ) according to 18th aspect of the invention, is characterized in that:

said holder side surface of the head supporting member is formed by 4 side surfaces (54, 56, 52, 62) which constitute a pyramid having a rectangular shape as viewed in a sectional direction, and one side surface among them is fabricated as a depressed surface (56) depressed by said depression member (37).

An ink-jet recording apparatus (U) according to 19th aspect of the invention is characterized in that:

four holder side surfaces of said head supporting member is a pyramid having a trapezoid, said depressed surface (50) is formed by a side surface for constituting one oblique edge of said trapezoid.

An ink-jet recording apparatus according to a 20th aspect of the invention is characterized in that:

a guided projection (56*a*) is formed on said depressed plane (56), and a cam groove (37*c*) for guiding said guided projection (56*a*) is formed on a cam plane of said eccentric cam (37*b*).

An ink-jet recording apparatus (U) according to a 21st aspect of the invention is characterized in that:

a connection terminal portion (72*a*) of a flexible cable (72) connected to a circuit portion of said ink-jet recording head (U) is held at a side (56) opposite to the depressed surface (57) of said tank holder (F); and a carriage side connection terminal portion (41) is formed in said head carriage (C) at a position connectable with said connection terminal portion when said head supporting member is depressed by said depression member (37) along a direction intersecting with said insertion direction under such a condition that said holder bottom wall (F1) is supported by the head supporting member mounting portion (32).

An ink-jet recording apparatus according to a 22nd aspect of the invention is characterized in that:

a board insertion groove (31) is formed on said head carriage (C), and said carriage side connection terminal portion (41) is a formed on a connection board (B) detachably mounted on said board insertion groove (31).

An ink-jet recording apparatus according to a 23rd aspect of the invention is characterized in that:

a shutter guide (62*d*) is formed on a side surface of said tank holder (F), and a shutter (S) is mounted on said shutter guide, which is movable between a terminal covering position for covering said connection terminal portion (72*a*) of said flexible cable (72) and a terminal releasing position for releasing the connection terminal portion along said shutter guide (62*a*).

An ink-jet recording apparatus (U) according to a 24th aspect of the invention is characterized in that:

both of said head sink (70) and said shutter (S) of said ink-jet recording head (H) are constructed by a conductive material, and said heat sink (70) is connected to said shutter by a conductive ground line (Sa).

An ink-jet recording apparatus (U) according to a 25th aspect of the invention is characterized in that:

a shutter engaging portion for sliding said shutter (S) to a release position with being engaged with said shutter (S) is provided on said head carriage (C), when the tank holder (F) at said terminal covering position is inserted toward the head supporting member mounting portion (32) along said side wall (27, 28, 29) of the head carriage (C).

An ink-jet recording apparatus (U) according to a 26th aspect of the invention is characterized in that:

said shutter engaging portion is formed by the end surface of the side wall (27, 28, 29) of said head carriage (C).

An ink-jet recording apparatus (U) according to a 27th aspect of the invention is characterized in that:

both of said insertion direction of the head supporting member mounting portion (32) to said head carriage (C), and said insertion direction of said tank into the holder wall (F1) of the tank holder are set to a bottom direction.

An ink-jet recording apparatus (U) according to a 28th aspect of the invention is characterized in that:

said joint connecting member (141) is provided in the head carriage (C) at a position opposite to the ink joint (164, 184) of said head cartridge (C) mounted on said cartridge mounting portion (122*b*, 122*c*, 123*b*, 123*c*), and at a position connected to the ink joint (164, 184) of the cartridge held (K1, K2) under said cartridge mounting state, and said joint connecting member (141) is connected via a flexible ink supplying tube (142) to the ink tank fixed to a proper position, and also at least one joint portion (141*c*) of said ink joint and said joint connection portion is displaceably arranged.

An ink-jet recording apparatus according to a 29th aspect of the invention is characterized in that:

at least one of junction portions (141*c*) of said ink joint (164, 184) and said joint connecting member (141) is displaceable; and a junction portion between a deformable elastic characteristic applying portion (142*a*) with a thin thickness and a tip portion thereof is integrally formed.

An ink-jet recording apparatus according to a 30th aspect of the invention is characterized in that:

one junction portion (141*c*) of said ink joint (164, 184) and said joint connecting member (141) has a narrow taper-shaped outer side surface, and the other junction portion (164, 184) has a taper-shaped inner hole capable of being fitted with said taper-shaped outer side surface, and expanding toward a tip portion thereof.

In accordance with the ink-jet recording apparatus (U) of the first aspect of the invention, when the head cartridge (K, K1, K2) having the head supporting member (F, 161, 181) and the ink-jet recording head (H) is inserted into the head supporting member mounting portion (32, 122*b*, 122*c*, 123*b*, 123*c*) of the cartridge (C), the head cartridge (K, K1, K2) are guided along the insertion guide wall (27, 28, 29, 122*a*, 123*a*). Then, the head supporting member (F, 161, 181) of the head cartridge (K, K1, K2) reaches the head supporting member mounting portion (32, 122*b*, 122*c*, 123*b*, 123*c*) and is mounted thereon.

Under such a condition that this head supporting member (F, 161, 181) is supported to the head supporting member mounting portion (32, 122*b*, 122*c*, 123*b*, 123*c*), when the head cartridge (K, K1, K2) is depressed by the depression member (37, 151) along the direction intersecting this insertion direction, the unloosen preventing member (55*c*, 162*b*, 162*e*, 182*b*, 182*e*) of the head cartridge (K, K1, K2) is engaged with the loosen preventing member (35, 122*c*, 122*d*, 123*c*, 123*d*) of the head carriage (C). Under such a condition that the unloosen preventing member (55*c*, 162*b*, 162*e*, 182*b*, 182*e*) of this head supporting member (F, 161, 181) is engaged with the loosen preventing member (35, 122*c*, 122*d*, 123*c*, 123*d*) of the head carriage (C), namely under such a cartridge mounting condition, the movement of the head cartridge (K, K1, K2) along the direction opposite to the insertion direction is blocked.

Then, since this cartridge mounting condition is maintained by the mounting condition holding means (154) for holding the position of the depression member (37, 151), the head cartridge (K, K1, K2) is stacked to the head cartridge (C).

The ink-jet recording head (H) includes the head chip (74, 174) mounted on the tip portion of the heat sink (70, 171) fixed to the head supporting member (F, 161, 181). Under the cartridge mounting condition, the tip portion of the ink-jet recording head (H) of the head cartridge (K, K1, K2) passes through the head through hole (33, 122, 123) of the head carriage (C).

Under this cartridge mounting condition, the capping apparatus capable of preventing the ink caked in the plural ink exhausting outlets of the head chip (74, 174) provided at the tip portion of the heat sink (70, 171), depresses the tip portions of the ink-jet recording head around the head chip. In this case, the head cartridge (K, K1, K2) receives the force exerted along the direction opposite to the insertion direction of the head carriage (C).

However, under the above-described cartridge mounting condition, since the head cartridge (K, K1, K2) is stacked to the head carriage (C), it is not moved over the head carriage (C).

When the ink-jet recording head (H) is replaced, namely the head cartridge (K, K1, K2) is replaced, the depression force of the depression member (37, 151) is released, so that the head cartridge (K, K1, K2) is moved along the direction opposite to the direction depressed by the above depression force. Thus, the engagement between the unloosen preventing member (55*c*, 162*b*, 162*e*, 182*b*, 182*e*) of the head cartridge (K, K1, K2) and the loosen preventing member (35, 122*c*, 122*d*, 123*c*, 123*d*) of the head carriage (C) is released. Therefore, the head cartridge (K, K1, K2) can be freely moved along the direction opposite to the insertion direction to the head carriage (C).

As a consequence, if the head carriage (K, K1, K2) is drawn along the direction opposite to the insertion direction to the head carriage (C), the head cartridge (K, K1, K2) having the ink- jet recording head (H) is separated from the carriage (C).

In the ink-jet recording apparatus of the second invention, since said depression member (37, 151) is arranged by a pivot lever (37*a*, 152) pivotably journaled to the head carriage (C), and a cam member (37*b*, 152*b*) pivoted with said pivot lever (37*a*, 152) in an integral form, and having a depression cam plane abutting to a front surface of said head cartridge, the structure thereof can be made simple and hard. As the depression member (37, 151) is so constructed, the firm depression force can be obtained over a long time under a stable condition. Furthermore, the productibility of the ink-jet recording apparatus can be improved, and it is possible to avoid an increase of the production cost.

The ink-jet recording apparatus (U) of the third aspect of the invention is characterized in that:

said mounting condition holding means has a mounting condition holding surface which is formed locally lower than the abutting plane of said depression cam plane abutting on the outer side view of said head supporting member (F) when said abutting portion of said depression cam plane abutting at said outer side plane of said head supporting member (F) is abutted to said abutting portion of the depression cam plane and said pivot lever (37*a*) of said depression member is rotated from the cartridge mounting state to the depressed side.

In this case, under the above-described cartridge mounting condition that the head cartridge (K) is depressed by the depression member to a predetermined position, when such a force for moving the head cartridge (K, K1, K2) to the anti-depression side is exerted on the head cartridge (K, K1, K2), another force for pivoting the depression member 37 to the anti-depression side is given to the depression member 37. However, since the adjoining depression cam surface is made higher than the abutting portion of the depression cam plane with the head cartridge (K) under the cartridge mounting condition (namely, such a condition that the depression member depresses the head cartridge (K) to a predetermined position), the depression member (37) is not rotated to the anti-depression direction.

If the depression cam plane is constructed in the above manner, then the head cartridge (K) is stably held at the above- described predetermined mounting position under such a condition that this head cartridge (K)

is depressed by the depression member (37) to a preselected mounting position of the head cartridge (C).

In other words, the portion of the depression cam plane of the depression member (37) which is locally made low, produces an effect to maintain the mounting state of the head cartridge (K) to the head carriage (C).

An ink-jet recording apparatus (U) according to a fourth aspect of the invention is characterized in that:

the mounting condition holding means is equipped with the tension spring (154).

The mounting condition holding means is provided between said pivot lever (152) and a member (106) for pivotably supporting said pivot lever (152), and has the tension spring (154) for pivoting said pivot lever (152) along the depression direction when said pivot lever (152) is pivoted from a predetermined pivot position to a depression side.

As a consequence, the cam member (152*b*) pivotable with this pivot lever (152) in an integral manner, and having the depression cam plane abutting to the outer side surface of the head supporting member (161, 181) during the pivot operation, may cause the head cartridge (K1, K2) to be maintained at such a position where the mounting condition is kept by the tension spring (154).

In the ink-jet recording apparatus according to the fifth aspect to the invention, when the ink tank (T) with the internal ink storage space into which ink is refilled, is inserted toward the holder bottom plane of the tank holder (F), the ink tank (T) is guided along the holder side wall (54, 62). Then, the joint connection member (81*b*) of the tank bottom plane of the ink tank (T) is depressed against the ink joint (65) of the holder bottom plane. At this time, the joint connection member (18*b*) of the tank bottom plane is connected to the ink joint (65), so that the inside of this tank is communicated with the inside of the ink joint (65).

In the tank holder into which this ink tank (T) has been inserted, namely in the head supporting member (F), the ink-jet recording head (H) is coupled in an integral form. Then, the ink exhausting outlets of the ink-jet recording head (H) is communicated with the inside of the tank via the inside of the ink joint 65. Under this communication condition, since the ink stored in the ink tank (T) is supplied to the ink exhausting outlets of the ink-jet recording head (H), a printing operation can be done by the ink jetted from the ink exhausting outlets.

When the tank holder, namely the head supporting member (F) is inserted toward the head supporting member mounting portion (32) of the head carriage (C), the tank holder (F) is guided along the insertion guide wall (27, 18, 29). Then, the tank holder (F) has reached the head supporting member mounting portion (32) at the holder bottom wall (F1) thereof. At this time, the ink-jet recording head (H) integrally coupled with the outside bottom wall of the tank holder (F) becomes such a condition that this head passes through the head through hole (33) of the head carriage (C). Under such a condition, when the tank holder is depressed by the depression member (37) along the direction intersecting this insertion direction, the unloosen preventing member (55*c*) of the tank holder (F) is engaged with the loosen preventing member (35) of the head carriage (C). Under such a condition that this unloosen preventing member (55*c*) is engaged with the loosen preventing member (35), namely the holder mounting state, the movement of the tank holder (F) along the direction opposites to the insertion direction is blocked.

When only the ink tank (T) is replaced, under the holder mounting condition, if the empty ink tank (T) is pulled along the direction opposite to the insertion direction toward the tank holder (F), the joint connection portion (81*b*) of the ink tank (T) is separated from the ink joint (65). When the ink tank (T) is pulled out, a tension force along the direction opposite to the insertion direction toward the head carriage (C) is effected also to the tank holder (F), namely the force for separating the tank holder (F) from the head carriage (C). However, the unloosen preventing member (55*c*) of the tank holder (F) is not separated by the loosen preventing member (35) of the head carriage (C).

After the empty ink tank (T) has been removed, if a new ink tank (T) is inserted toward the holder bottom wall (FI) of the tank holder (F), the joint connection member (81*b*) of this new ink tank (T) is connected to the ink joint (65).

When the ink-jet recording head (H) is replaced, the depression force of the depression member (37) is released to move the tank holder (F) along the depression direction caused by the depression force. Thus, the engagement between the unloosen preventing member (55*c*) of the holder bottom outside wall of the tank holder (F) and the loosen preventing member (35) is released. Accordingly, the tank holder (F) can be freely moved along the direction opposite to the insertion direction toward the head carriage (C). As a consequence, if the tank holder (F) is pulled along the direction opposite to the insertion direction of the head carriage (C), then both of the tank holder (F) and the ink-jet recording head (11) coupled to this tank holder (F) in an integral manner are separated from the carriage. IN this case, the ink tank (T) is also inserted into the tank holder (F).

Then, when the ink still remains in this ink tank (T), the ink tank (T) in which the ink is still left may be inserted into the new tank holder (F) which is coupled to the new ink-jet recording head (H). Then, if the tank holder (F) into which the ink tank (T) has been inserted, is inserted toward the head supporting member mounting portion (32) of the head carriage (C), the new ink-jet recording head (H) integrally coupled to the tank holder (F) can be mounted to the head carriage (C).

As previously explained, according to the fifth invention, the replacement of the ink tank (T), or the ink-jet recording head (H) can be achieved by a simple operation. Then, the replacement of only the ink tank (T) may be performed without separating the ink-jet recording head (H) from the head carriage (C).

Also, under such a mounting condition that the head cartridge (K) is mounted at a predetermined position of the head carriage (C), when there is provided the capping unit for preventing the ink caked in the plural ink exhausting outlets of the head chip (74) formed at the tip portion of the heat sink (70), the capping unit depresses the tips of the ink-jet recording head around the head chip. In this case, the head cartridge (K) receives the force exerted along the direction opposite to the insertion direction toward the head carriage (C) .

However, as described above, under such a cartridge mounting condition, since the head cartridge (C), this head cartridge (K) is not moved over the head carriage (C).

In the ink-jet recording apparatus (U) according to the sixth aspect of the invention, since the atmospheric communication hole (82*b*) for communicating the inside of the tank with atmospheric air is formed on the ink tank (T), the ink stored in the ink tank can be supplied to the ink exhausting outlets of the ink-jet recording head (H) without employing an extra pressure applying unit in the ink tank (T). Also, since the porous ink holding member (83) into which the ink is dipped is stored into the ink storage space of the ink tank (T), when the ink tank (T) is replaced, it is possible to prevent ink leakage from the joint connection member (81*b*) of the tank bottom plane of the ink tank (T).

In the ink-jet recording apparatus (U) according to a seventh aspect of the invention, since the stopped member (81*a*) for positioning purpose is provided on said side surface of the tank, said stopped member (81*a*) is stopped at the holder side wall (54:62) of the tank holder (F) to position said ink tank (T), which is performed by a stopping member (54*d*, 62*b*), when the ink tank (T) is replaced, the new ink tank can be correctly mounted on a predetermined mounting position.

In the ink-jet recording apparatus (U) according to an eighth aspect of the invention, since the stopped member (81*d*) is semi- spherical projection, said stopping member (54*d*, 62*b*) is a stopping hole (54*d*, 62*b*) formed on said holder side wall (54, 62) and said holder side wall portion (54, 62) on which said stopping hole is made, has an elastic characteristic capable of deforming toward an outside, when the ink tank (T) is replaced, a new ink tank can be correctly mounted to a predetermined mounting position.

In the ink-jet recording apparatus (U) according to a ninth aspect of the invention, two parallel slits (54*c*, 62*a*) are formed from the side planes of said holder side wall (54, 62) and said stopping hole (54*d*, 62*b*) is arranged between said two parallel silts. This stopping hole is defined in the eighth aspect of the invention. The holder side wall (54, 62) portion having the elastic characteristic capable of deforming outwardly can be realized with a simple structure.

The ink-jet recording apparatus (U) according to a tenth aspect of the invention is characterized in that:

said joint connecting member (81*b*) of the ink tank (T) is arranged by a circular through hole (81*b*) formed on a tank bottom surface, said ink joint (65) formed on the tank holder bottom wall (F1) has a cylindrical portion passing through said through hole, and a seal ring (66) is mounted on an outer peripheral portion of said cylinder portion, which abuts on the outer side surface of the ink tank (T) around said through hole (81*b*). As a result, the sealing characteristic between the ink tank (T) and the ink joint (65) connected to this ink tank (T) can be improved. The ink leakage from this connection portion can be prevented. Moreover, this apparatus has a simple structure.

The ink-jet recording apparatus (U) according to 11th invention is characterized in that:

a closing member is provided in said ink tank (T), which closes said through hole until it is destroyed, and which is easily destroyed when it is depressed against the ink joint (65).

This ink tank (T) corresponds to the above-described ink tank (T) according to the 10th aspect of the invention, into which the through hole has been formed as the joint connection member (81*b*). Accordingly, no ink leakage happens to occur during ink transportation or ink preservation.

The ink-jet recording apparatus (U) according to 12th aspect of the invention is characterized in that:

a porous body (68) is stored inside said cylinder portion of the ink joint (65). Therefore, when the ink tank (T) is replaced, air can be hardly entered into the inside of the ink joint (65) to be connected to the ink tank (T) (namely, inside of the ink joint communicated with the ink exhausting outlets of the ink-jet recording head (H). Also, since contamination flow can be blocked by the porous body (68), it can be prevented that contamination is entered into the ink supplied to the ink exhausting outlets of the ink-jet recording head positioned at the down stream side.

The ink-jet recording apparatus (U) according to 13th aspect of the invention is characterized in that;

said porous body (68) stored into an inside of said cylindrical portion of said ink joint (659 has a density lower than that of the inner holding body (83) stored inside said ink tank (T). As a consequence, when the porous ink holding body (83) stored in the ink storage space of the ink tank (T) is positioned in contact with the porous body (68) within the ink joint (65), the ink is absorbed from the ink tank (T) to the porous body (68) within the ink joint (65) whose density is smaller than that of the ink tank (T) due to the capillary phenomenon. As a result, the transportation characteristic of the ink from the ink tank (T) to the ink joint (65) at the down stream side can be improved, and the utilization efficiency of the ink can be increased.

The ink-jet recording apparatus (U) according to 14th invention is characterized in that:

In the ink joint (65), a filter (67) is provided at a boundary portion between a cylindrical inside of the ink joint and the ink storage space of the ink tank (T). Accordingly, it is possible to prevent that contamination is entered into the ink supplied to the ink exhausting outlets of the ink-jet recording head (H).

The ink-jet recording apparatus (U) according to 15th aspect of the invention is characterized in that:

a plurality of head supporting member mounting portions (32), head through holes (33), insertion guide walls (27, 28, 29), depression members (37) and loosen preventing members (34) are provided within said head carriage (C). Thus, in such an ink-jet recording apparatus that there are provided a plurality of ink tanks (T) and a plurality of ink-jet recording heads (H) so as to perform the color recording operation with employment of the different color ink, the ink tanks (T) and the ink-jet recording heads (H), corresponding to the respective colors can be independently replaced.

In accordance with the ink-jet recording apparatus of the 16th aspect of the invention when the tank holder (F) is inserted toward the head supporting member mounting portion (32) of the head carriage (C), this holder bottom wall (F1) is supported by the head supporting member mounting portion (32). Under this condition, the unloosen preventing member (55*c*) arranged by the "L"-shaped pawl (55*a*) formed on the outer side surface of the holder bottom wall of the tank holder (F), is stored into the "L"-shaped pawl storing portion provided on the head supporting member mounting portion (32). Under this condition, when the tank holder (F) is depressed by the depression means (37), the loosen preventing member (35) (namely, held portion) formed on the head supporting member mounting portion (32) is held by the holder bottom wall (F1) and the loosen preventing portion of the "L"-shaped pawl (55*a*).

Under such a condition, the ink-jet recording head (H) is firmly fixed to a predetermined position of the head carriage (C). When only the ink tank (T) is pulled out to be released, while mounting the ink-jet recording head (H) on the head carriage (C), although the force to pull the ink tank (T) to be removed is exerted to the ink-jet recording head (H), the ink-jet recording head (H) is not removed from the head carriage (C) due to the unloosen preventing member (55c) and the loosen preventing member (35).

The ink-jet recording apparatus according to 17th aspect of the invention, is characterized in that:

said depression member (37) includes an eccentric cam (**37*b*) having a depression cam plane abutting at one side wall of said tank holder (F). Accordingly, the depression member (37**) for depressing the tank holder (F) along the direction intersecting with the insertion direction can be realized with a simple structure.

The ink-jet recording apparatus (U) according to 18th aspect of the invention, is characterized in that:

said holder side surface of the head supporting member is formed by 4 side surfaces (54, 56, 52, 62) which constitute a pyramid having a rectangular shape as viewed in a sectional direction. As a consequence, the shape of the ink tank (T) to be inserted into this tank holder (F) can be made substantially rectangular. Also, the shape of the holder bottom wall supporting plane (32) of the head carriage (C) to be inserted into the tank holder (F) is made rectangular. Therefore, the structures of the tank holder (F) for holding the ink tank (T) and the head carriage (C) for supporting the tank holder (F) can be made simple, which can be easily constructed.

In case that the ink-jet recording apparatus having a plurality of ink tanks (T) and a plurality of ink-jet recording heads (H) is manufactured to perform the color recording operation with employment of the different color ink, the plural ink tanks (T) and the plural ink-jet recording heads (H) provided for the respective colors can be arranged at the proper arranging positions in view of space saving. When the depressed surface depressed by the depression member (37) is formed on the tank holder (F), one side surface of the above-described tank holder (F) having a rectangular shape among the four side surfaces thereof can be employed.

The ink-jet recording apparatus (U) according to 19th aspect of the invention is characterized in that:

four holder side surfaces of said head supporting member is a pyramid having a trapezoid, said depressed surface (50) is formed by a side surface for constituting one oblique edge of said trapezoid. Thus, when the side surface (depressed surface) for constituting one oblique edge of the tank holder (F) is depressed by the depression member (37), a component force for depressing the side surface along the direction perpendicular to the depression direction of the depression member (37) is given to the tank holder (F).

As a result, since the tank holder (F) connected to the ink- jet recording head (H) arranged on the head carriage (C) is moved along the depression direction by the depression member (37), and also moved along the component force direction perpendicular to the depression direction, the tank holder (F) can be moved to the preselected positions along the depression direction and the component force direction perpendicular to this depression direction to be held therein.

When a plurality of tank holders (F) are arranged on the head carriage (C), since the tank holder (F) can be moved along the arranging direction (namely, effective direction of the component force) and the direction normal to this arranging direction, the respective tank holders (F) can be held at the predetermined positions along the arranging direction of the tank holders (F). That is, when the tank holder (F) is inserted along the guide wall (27, 28, 29) of the head cartridge (C), even if there is a space between the tank holder's outer side surface and the guide wall (27, 28, 29), the tank holders (F) can be held at the predetermined positions by the depression member (37).

An ink-jet recording apparatus according to a 20th aspect of the invention is characterized in that:

the guided projection (**56*a*) of the tank holder (F) is formed on said depressed plane (56), and a cam groove (37*c*) for guiding said guided projection (56*a*) is formed on a cam plane of said eccentric cam (37*b*). In this case, the tank holder (F) can be easily moved along the depression direction of the depression member and the direction normal to this direction by changing the extending direction of the cam groove (37*c***).

The ink-jet recording apparatus (U) according to a 21st aspect of the invention is characterized in that:

the connection terminal portion (**72*a*) of the flexible cable (72) connected to a circuit portion of said ink-jet recording head (U) is held at a side (56) opposite to the depressed surface (57) of said tank holder (F). Accordingly, the connection terminal portion (72*a*) is automatically depressed against a carriage side connection terminal portion (41) is when said head supporting member is depressed by said depression member (37) along a direction intersecting with said insertion direction under such a condition that said holder bottom wall (F1) is supported by the head supporting member mounting portion (32**).

As a consequence, when the ink-jet recording head (H) is replaced, the connection work between the connection terminal portion (**72*a*) of the circuit portion of the new ink-jet recording head (H) and the carriage side connection terminal (41**) can be automatically performed.

The ink-jet recording apparatus according to a 22nd aspect of the invention is characterized in that:

the board insertion groove (31) is formed on said head carriage (C), and said carriage side connection terminal portion (41) is formed on the connection board (B) detachably mounted on said board insertion groove (31). Therefore, the assembly work of the circuit portion to b mounted on the head carriage (C) can be made simple.

The ink-jet recording apparatus according to a 23rd aspect of the invention is characterized in that:

the shutter guide (**62*d*) is formed on a side surface of side tank holder (F), and a shutter (S) is mounted on said shutter guide, which is movable between portion (72*a*) of said flexible cable (72) and a terminal releasing position for releasing the connection terminal portion along said shutter guide (62*a*). Thus, when the ink-jet recording head (H) integrally coupled with the tank holder (F) is preserved, or transported, the shutter (S) is moved to the terminal covering position, so that the connection terminal portion (72*a***) of the circuit portion mounted on the ink-jet recording head (H) can be protected.

The ink-jet recording apparatus (U) according to a 24th aspect of the invention is characterized in that:

both of said head sink (70) and said shutter (S) of said ink-jet recording head (H) are constructed by a conductive material, and said heat sink (70) is connected to said shutter by a conductive ground line (Sa). As a consequence, the circuit portion mounted on the ink-jet recording head (H) can be protected from electrostatic damages.

The ink-jet recording apparatus (U) according to a 25th aspect of the invention is characterized in that:

the shutter engaging portion for sliding said shutter (S) to a release position with being engaged with said shutter (S) is provided on said head carriage (C), when the tank holder (F) at said terminal covering position is inserted toward the head supporting member mounting portion (32) along said side wall (27;28;29) of the head carriage (C). Accordingly, when the ink- jet recording head (H) is mounted on the head carriage (C), since the shutter (S) for covering the connection terminal portion (72*a*) of the flexible cable (72) of the ink-jet recording head (H) can be automatically released, or opened, the ink-jet recording head (H) can be replaced without paying any attention to the opening/closing operations of the shutter (S).

The ink-jet recording apparatus (U) according to a 26th aspect of the invention is characterized in that:

said shutter engaging portion is formed by the end surface of the side wall (27, 28, 29) of said head carriage (C). Thus, when the ink-jet recording head (H) is mounted on the head carriage (C), the function for automatically opening the shutter (S) which cover the connection terminal portion (72*a*) of the flexible cable (72) for the ink-jet recording head (H) can be realized with a simple construction.

The ink-jet recording apparatus (U) according to a 27th aspect of the invention is characterized in that:

both of said insertion direction of the head supporting member mounting portion (32) to said head carriage (C), and said insertion direction of said tank into the holder wall (F1) of the tank holder are set to a bottom direction. Thus, when the ink tank (T) is replaced and the head cartridge (K) having the ink-jet recording head (H) is replaced, both of a new tank (T) and a new head cartridge (K) may be just mounted on the tank holder bottom wall (F1) and the head supporting member mounting portion (32). In other words, the above-described replacement work can be easily carried out while being put over the head carriage (C).

The ink-jet recording apparatus (U) according to a 28th aspect of the invention is characterized in that the joint connection member (141) is provided on the head carriage (C). The joint connecting member (141) is provided in the head carriage (C) at a position opposite to the ink joint (164, 184) of said head cartridge (C) mounted on said cartridge mounting portion (122*b*, 122*c*, 123*b*, 123*c*), and at a position connected to the ink joint (164, 184) of the cartridge held (K1, K2) under said cartridge mounting state.

Under such a condition, when the head cartridge (K1, K2) is depressed by the depression member (151), the head cartridge (K1, K2) is moved on the head supporting member mounting portion (122*b*, 122*c*, 123*b*, 123*c*), so that it becomes the cartridge mounting state.

At this time, the ink joint (164, 184) of the head cartridge (K1, K2) is depressed against the joint connection member (141) of the head carriage (C).

Since at least one joint portion (141*c*) of said ink joint and said joint connection portion is displacebly arranged, even if the position of the ink joint (164, 184) is positionally displaced with respect to the position of the joint connection member (141), these members are connected to each other under proper state. Since the joint connecting member (141) is connected via a flexible ink supplying tube (142) to the ink tank fixed to a proper position, the ink can be supplied to the ink joint (164, 184) connected to the joint connection member (141).

The ink-jet recording apparatus according to a 29th aspect of the invention is characterized in that:

at least one of junction portions (141*c*) of said ink joint (164, 184) and said joint connecting member (141) is displaceable; and a junction portion between a deformable elastic characteristic applying portion (142*a*) with a thin thickness and a tip portion thereof is integrally formed. Both of the ink joint (164, 184) having such an elastic characteristic applying portion (142*a*) and the junction portion (141*c*) integrally formed at the tip side thereof, and also the joint connection member (141) can be mass-produced by forming them in an integral form.

The ink-jet recording apparatus according to a 30th aspect of the invention is characterized in that:

one junction portion (141*c*) of said ink joint (164, 184) and said joint connecting member (141) has a narrow tape-shaped outer side surface, and the other junction portion (164, 184) has a taper-shaped inner hole capable of being fitted with said taper- shaped outer side surface, and expanding toward a tip portion thereof.

As a consequence, while the ink joint (164, 184) and the joint connection member (141) are mutually depressed by the depression member (1519, the taper-shaped inner hole extending toward the tip portion of one member (164, 184) and the taper-shaped narrow outer-side surface of the other member (141) are mutually depressed.

When the taper-shaped inner hole extending toward the tip portion and the taper-shaped narrow outer-side surface are mutually depressed, such a force for making the center lines of the junction portions coincident is produced, depending upon the shapes of the junction portions. Accordingly, even if there is a positional shift in these junction portions, since at least one junction portion (141*c*) is constructed to be displaceable, the center lines of both the junction portions can be automatically coincident with each other.

As a result, both of the joint connection member (141) and the ink joint (164, 184) are coupled under watertight condition.

Also, even if a vibration happens to occur in either the above-described head carriage (C), or the head cartridge (K1, K2) and thus a relative positional-shift would be produced between them, such a positional shift could be absorbed by way of a displacement in at least one joint portion (141*c*). As a consequence, even when the above-explained relative positional-shift would be produced, both of the joint connection member (141) supported to the head carriage (C) and the ink joint (164, 84) supported to the head cartridge (K1, K2) would not be damaged and therefore could be maintained under watertight connection condition.

BRIEF DESCRIPTION OF THE DRAWINGS

For a better understanding of the present invention, reference is made of the detailed description in conjunction with the accompanying drawings in which:

FIG. 10A is a sectional FIG. 10 is a detailed explanatory diagram of a cross-sectional views of the head carriage C, FIG. 10A is a sectional view of the head carriage C, taken along a line 10A—10A of FIG. 9, and FIG. 10B is a sectional view of the head carriage C, taken along a line 10B—10B of FIG. 9;

FIG. 13B is a sectional view of FIG. 13A, taken along an arrow 13B—13B;

FIG. 16A is a front view of the connection board B (namely, a view for showing a plane of an arrow side X1), and FIG. 16B is a rear view of the connection board B;

FIG. 19A is a view for representing such a condition that a flexible cable 72 is mounted, and FIG. 19B is a view in which a connection terminal portion 17 of the flexible cable is omitted.

FIGS. 29A to 29D are explanatory diagrams of a shutter S of the ink- jet recording apparatus U according to a preferred embodiment 3 of the present invention; FIG. 29A is a perspective view thereof;

FIG. 29B is a bottom view thereof; FIG. 29C is a view as view from an arrow 29C of FIG. 29B; FIG. 29D is a sectional view, taken along a line 29D—29D of FIG. 29B;

FIG. 30A.

FIG. 3 is a sectional view of the head carriage C, taken along an arrow 35—35 of FIG. 33;

FIG. 47A is an exploded perspective view of the main body "H" of the above-described ink-jet recording head, FIG. 47B is a detailed explanatory diagram of a major portion of the main body "H" of the ink-jet recording head, and FIGS. 47C and 47D are detailed explanatory diagram of a check valve 179 used in the main body "H" of the ink-jet recording head;

FIG. 56A is an explanatory diagram of a joint connection member 141, FIG. 56B is an explanatory diagram of an ink joint 164 (184), and FIG. 56C is a view of the ink joint as viewed from an arrow 56C of FIG. 56B.

DETAILED DESCRIPTION OF THE PREFERRED EMBODIMENTS

Referring now to drawings, various preferred embodiments of the present invention will be described. It should be noted that the present invention is not limited to the below-mentioned preferred embodiments.

STRUCTURE OF FIRST INK-JET RECORDING APPARATUS

Figure 1:
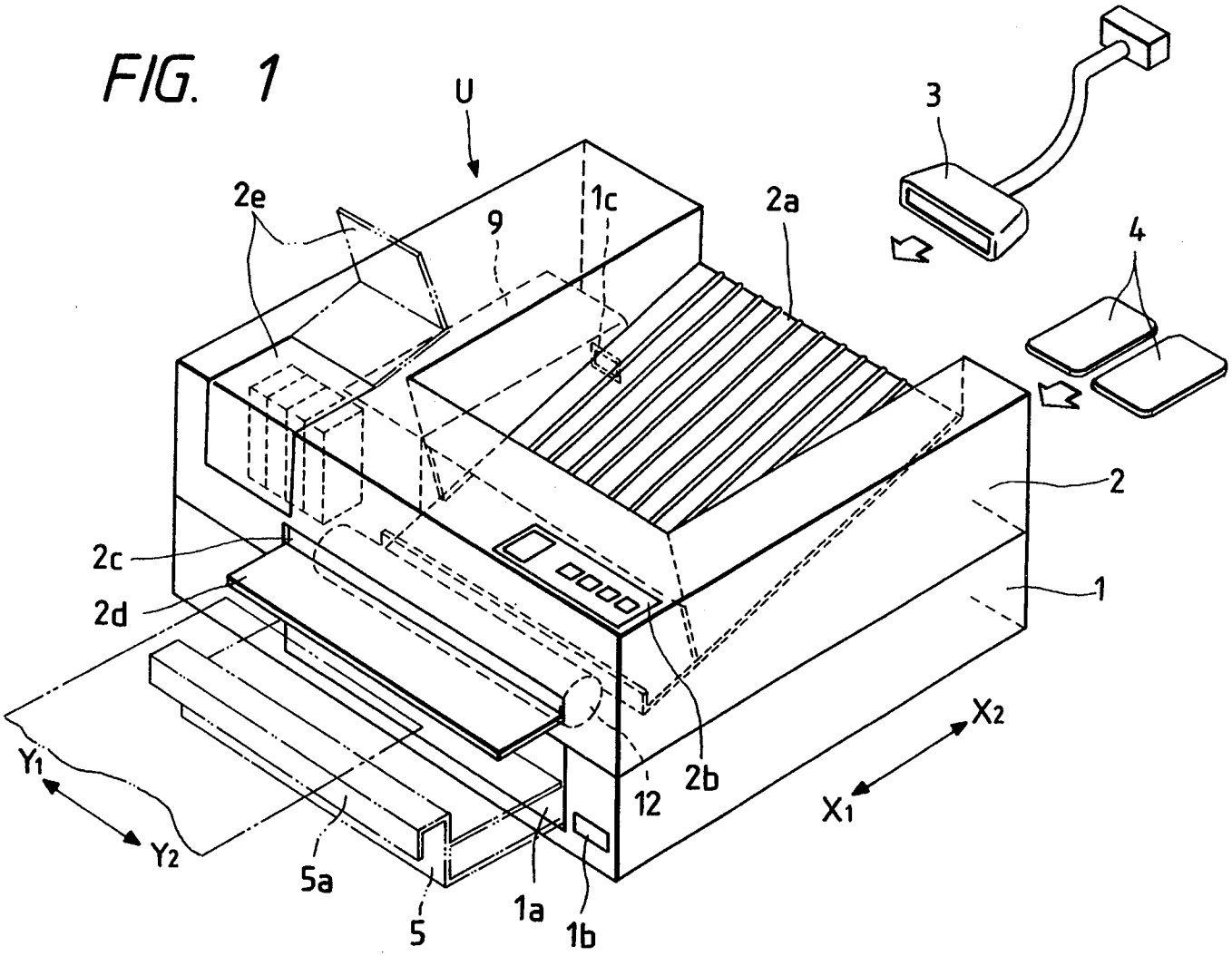
FIG. 1 is a perspective view of an overall ink-jet recording apparatus according to a preferred embodiment of the present invention.
Figure 2:
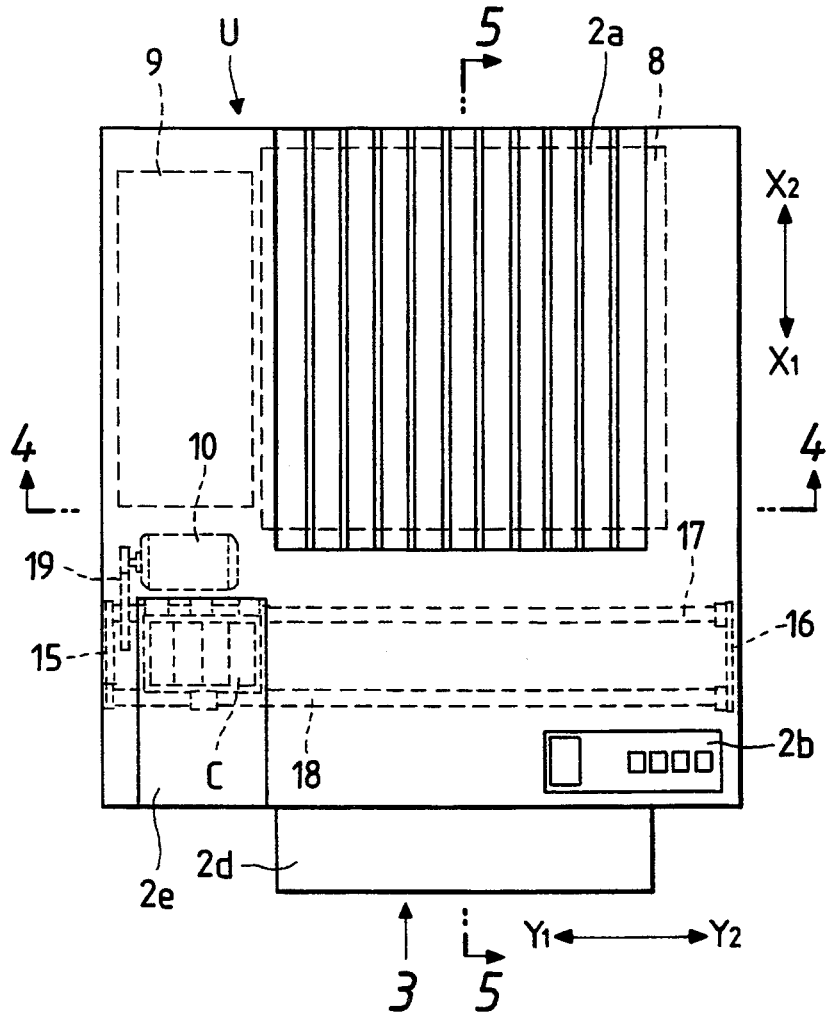
FIG. 2 schematically shows a top view of the ink-jet recording apparatus of the preferred embodiment 1.
Figure 3:
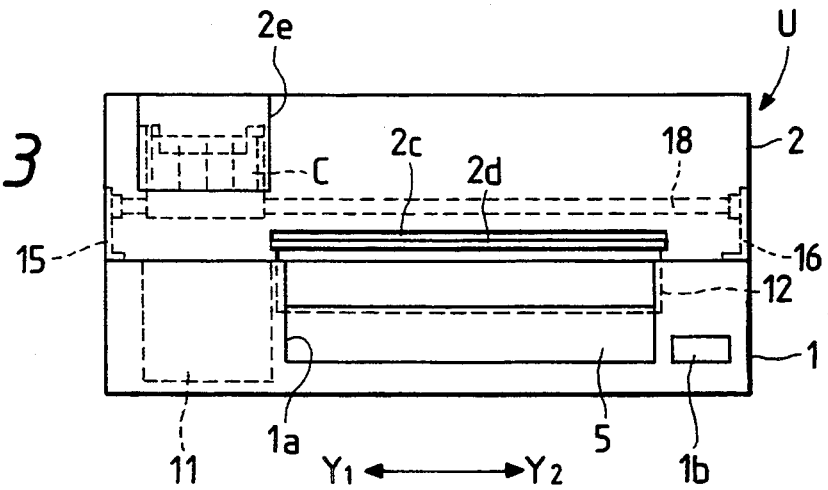
FIG. 3 schematically shows a front view of the ink-jet recording apparatus of the preferred embodiment 1.
Figure 4:
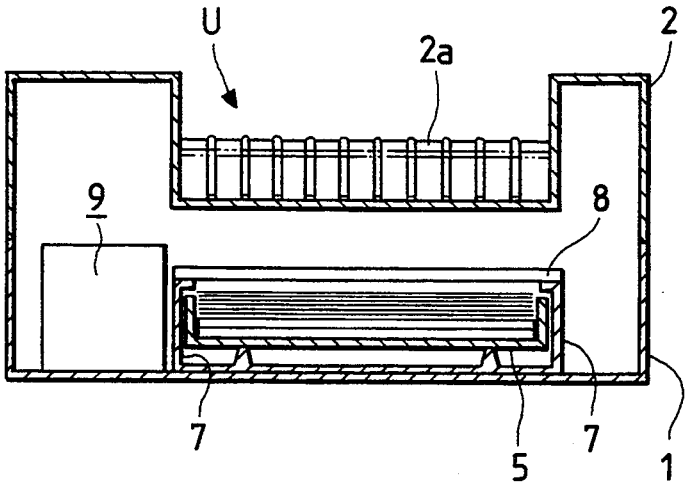
FIG. 4 schematically represents a sectional view of the ink- jet recording apparatus, taken along a line IV—IV of FIG. 2.
Figure 5:
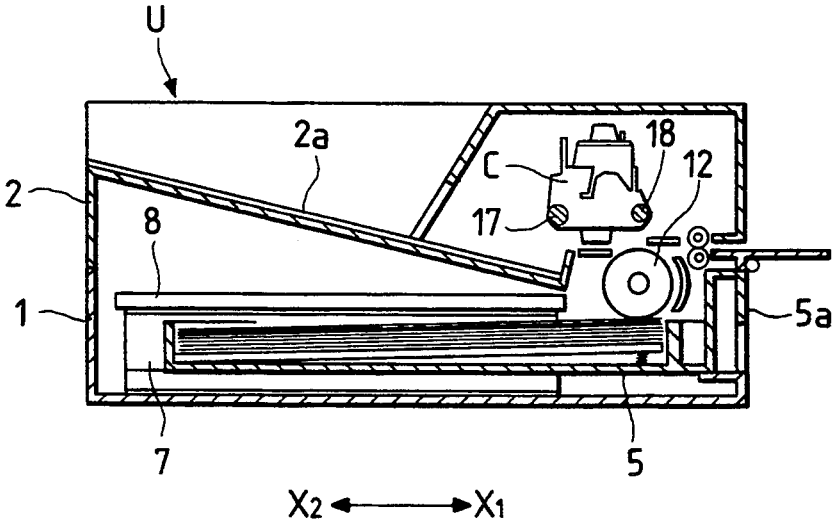
FIG. 5 schematically shows a sectional view of the ink-jet recording apparatus taken along a line V—V of FIG. 2.

FIG. 1 schematically shows a perspective view of an overall ink-jet recording "U" apparatus according to a preferred embodiment 1 of the present invention. FIG. 2 schematically represents a top view of the ink-jet recording apparatus according to the preferred embodiment 1. FIG. 3 schematically indicates a front view of the ink-jet recording apparatus according to the preferred embodiment 1. FIG. 4 schematically indicates a sectional view of the ink-jet recording apparatus, taken along a line IV—IV of FIG. 2. FIG. 5 schematically shows a sectional view of the ink-jet recording apparatus, taken along a line V—V of FIG. 2.

It should be understood that in the following descriptions of the ink-jet recording apparatus according to the preferred embodiment 1 of the present invention, an expression "forward" or "front side" implies a direction X1 (see FIG. 1) of a front side of the ink-jet recording apparatus U. Similarly, an expression "backward" or "back side" implies a direction X2 (see FIG. 1) of a rear side of the ink-jet recording apparatus U. Furthermore, an expression "leftward" or "left side" implies a direction Y1 (see FIG. 1) of a left-side of the ink-jet recording apparatus U, as viewed from the front side thereof. Furthermore, an expression "rightward" or "right side" implies a direction Y2 (see FIG. 1) of a right side of the ink-jet recording apparatus U, as viewed from the front side.

In FIG. 1, the ink-jet recording apparatus U includes a lower case 1 and an upper case 2. In a front center part of this lower case 1, a tray insertion port 1*a* is formed. Similarly, a dip switch lb is formed on the front right side of this lower case 1, and a main switch 1*c* is provided on the rear left side of this lower case 1. On the upper case 2, a paper receiver 2*a* is formed and also a panel console 2*b* (see FIGS. 1 and 2). Further, a manual paper insertion port 2C for inserting paper by a manual operation, and a manual paper insertion tray 2*d* are formed on the upper case 2, and also a small lid 2*e* which is freely opened and closed.

Also, connectors (not shown) for electrically connecting an interface cable 3 and memory cards 4 with the main body of the ink-jet recording apparatus are provided on the rear side surface of the lower case 1. A paper tray 5 of A4 paper size is inserted from the tray insertion port 1*a*. A folded portion 5*a* (see FIGS. 1 and 5) is provided on the front surface of the paper tray 5, which is hooked by fingers of an operator when the paper tray 5 is drawn.

As shown in FIG. 4, guide walls 7 and 7 are formed on both right and left sides of the paper tray 5, and a main board 8 on which an electronic circuit is mounted, is fixed on the upper ends of these guide walls 7 and 7. On the lower case 1, a power source 9, a motor 10 (refer to FIG. 2), a caping unit 11 (refer to FIG. 3), and a paper feed roller 12 (see FIGS. 1, 3, 5) and the like are mounted.

As represented in FIGS. 2 and 3, brackets 15 and 16 are fixed on both right and left sides of the lower case 1. A screw shaft 17 and a guide shaft (refer to FIGS. 2, 3 and 5), which are arranged in parallel with each other are supported by these brackets 15 and 16. The screw shaft 17 is supported via a bearing in such a manner that this screw shaft 17 is rotatable, and the guide shaft 18 is fixedly supported by the brackets 15 and 16.

The screw shaft 17 is rotatably driven by the motor 10 via a proper transmission mechanism 19 (see FIG. 2).

A head carriage "C" (refer to FIGS. 2, 3 and 5) is mounted on the screw shaft 17 and the guide shaft 18. The head carriage C is shown more in detail in FIGS. 6 through 15.

Figure 6:
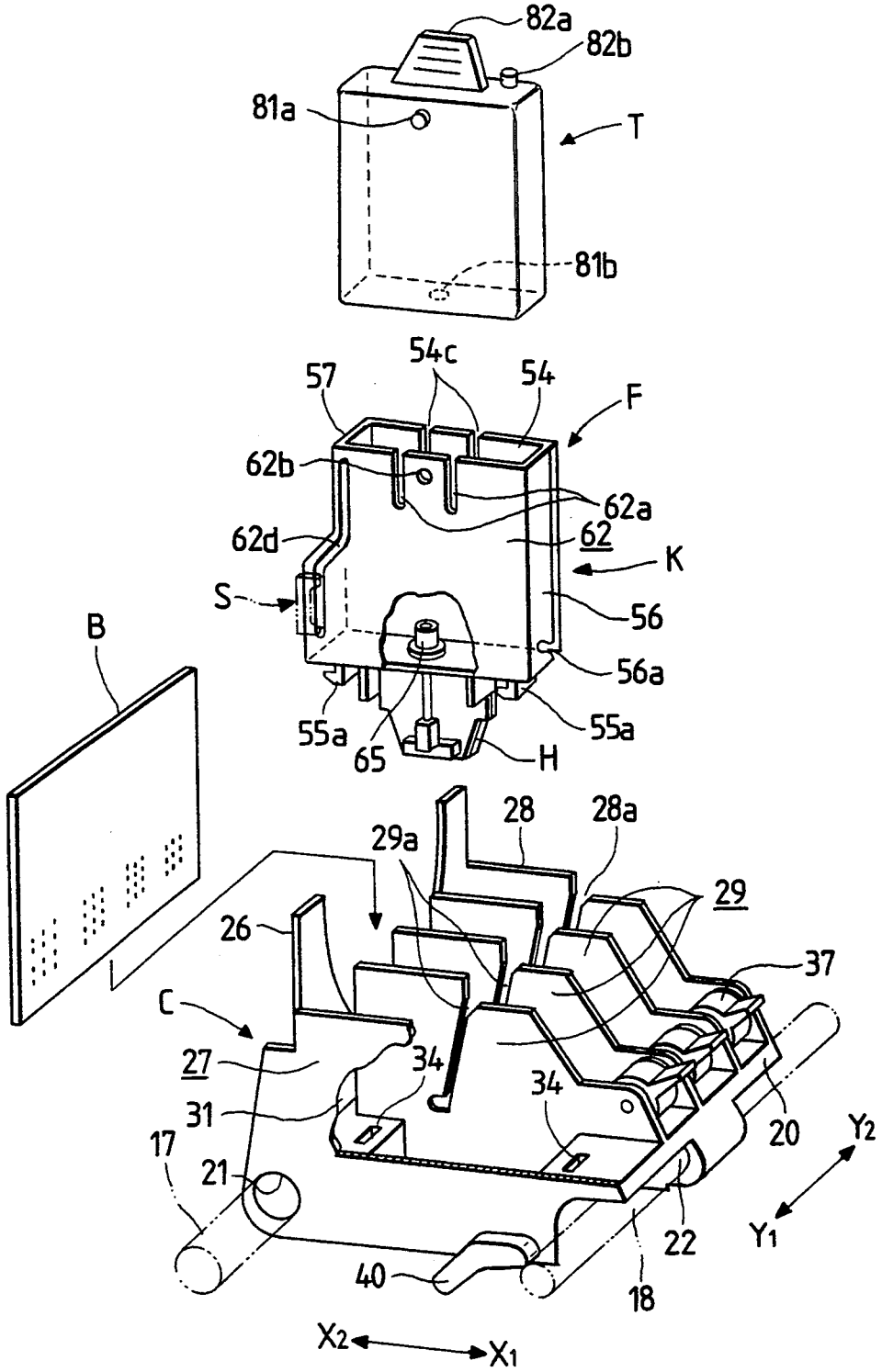
FIG. 6 is an exploded perspective view of a head carriage C, a head cartridge K mounted on this head carriage C, and an ink tank T mounted on this head carriage K.
Figure 7A:
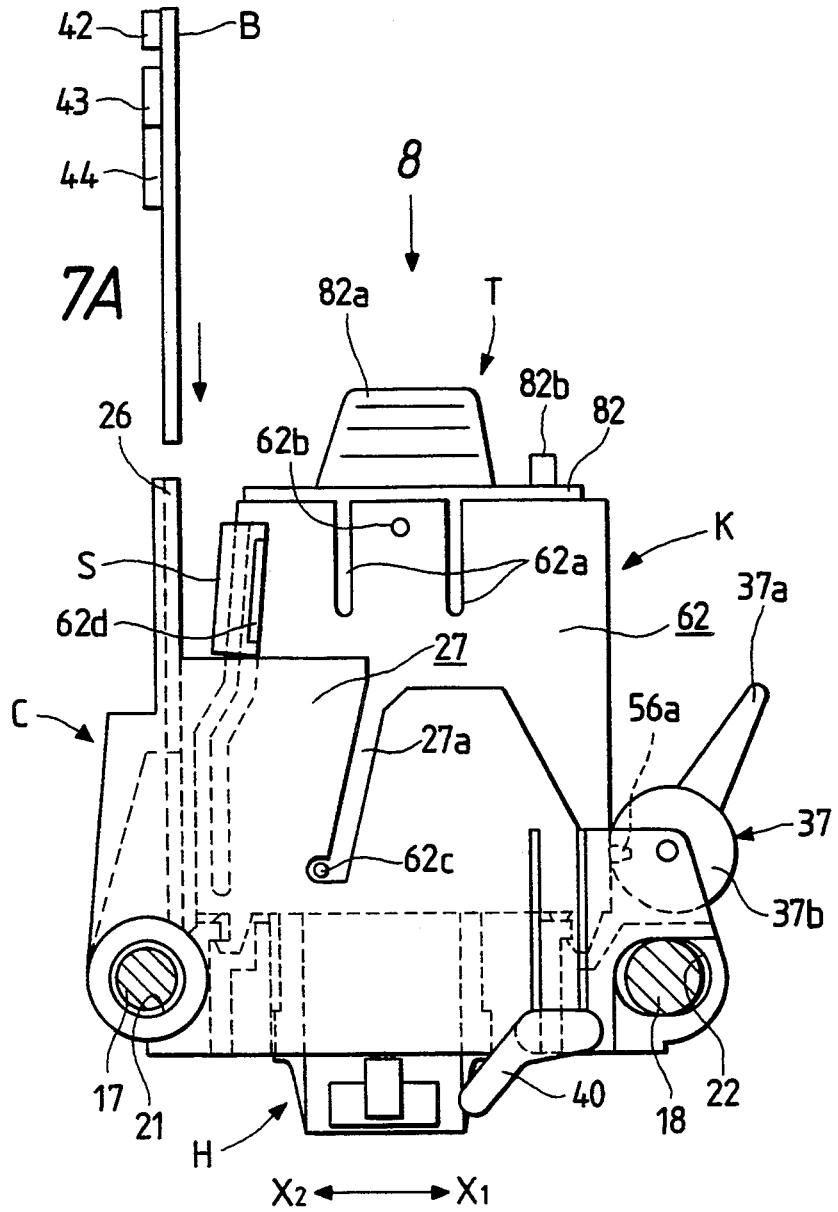
FIG. 7A is an explanatory diagram of a mounting condition between the head carriage C and the head cartridge K, it is a side view for showing a condition under which the above-described head carriage C, head carriage K and ink tank T are mutually coupled to each other.
Figure 7B:
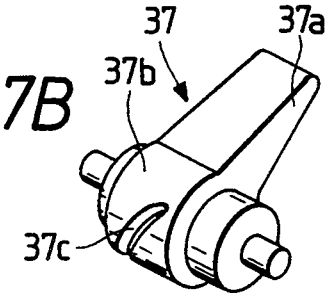
FIG. 7B is a perspective view of a depression member forming a part of the apparatus illustrated in FIG. 7A.
Figure 8:
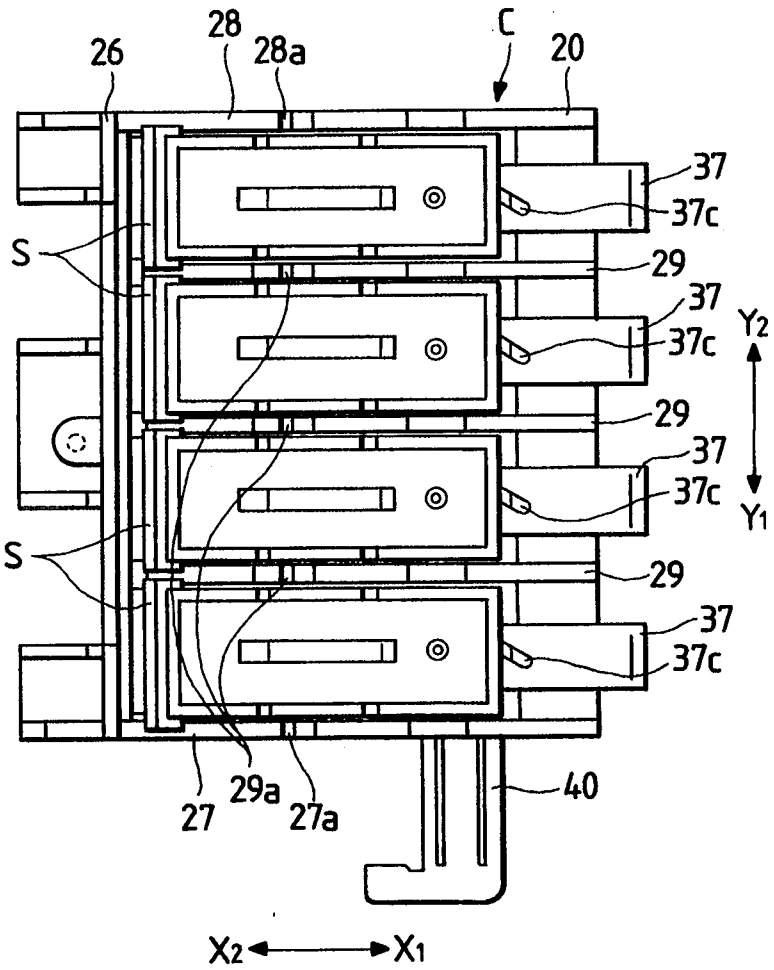
FIG. 8 is a plan view as viewed from an upper direction in FIG. 7.

FIG. 6 is an exploded perspective view of the head carriage C, a connection board B and a head cartridge K, which are mounted to this head carriage C, and an ink tank "T" mounted on this head cartridge K. The head cartridge "K" is constructed of a tank holder "F" and an ink-jet recording head "H" which is integrally connected to the tank holder F. FIG. 7 is an explanatory diagram for showing such a mounting condition between the head carriage C and the head cartridge K. FIG. 7A is a side view for showing a mutual connection condition among the head carriage C, the head cartridge K, and the ink tank T. FIG. 7B is a perspective view of an eccentric cam shown in FIG. 7A. FIG. 8 is a view of the above-described connecting condition as viewed from an arrow 8 of FIG. 7A.

Figure 9:
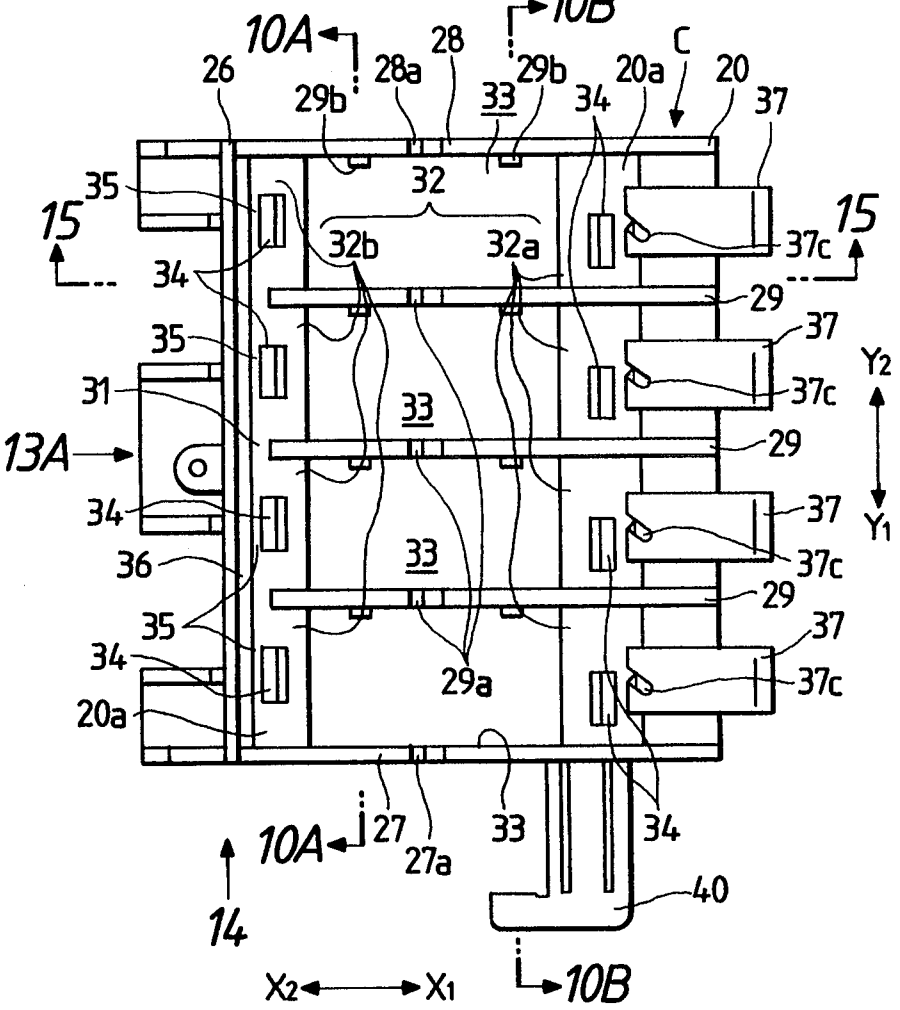
FIG. 9 is a plan view of a single body of the head carriage C.
Figure 10A:
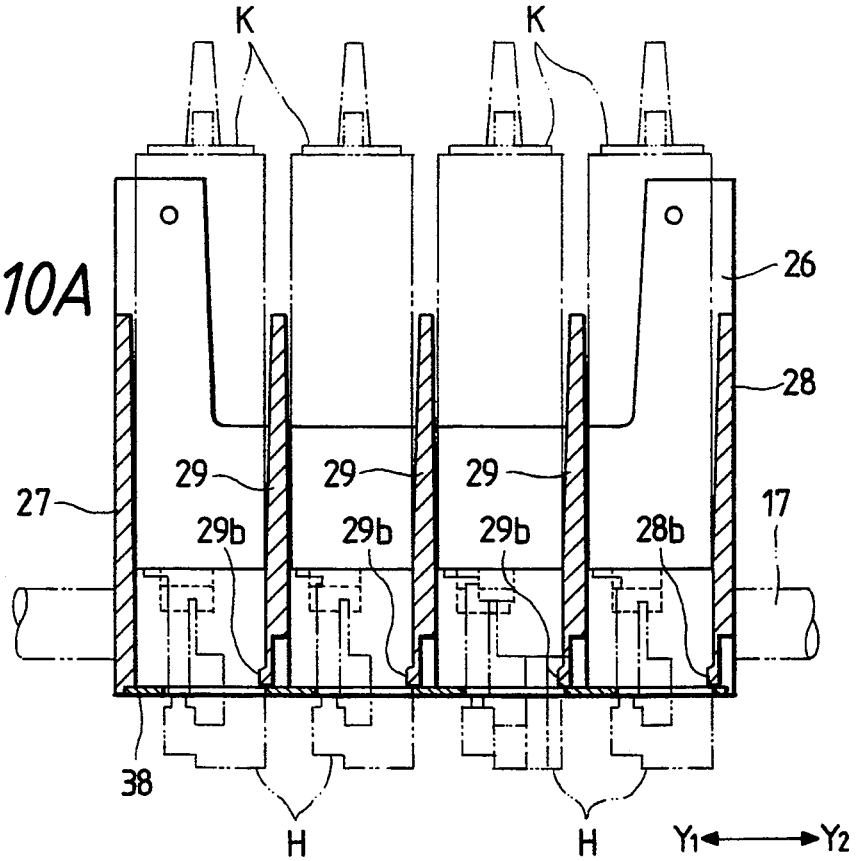
FIGS. 10A and 10B are detailed explanatory diagrams of cross-sectional views of the head carriagae C.
Figure 10B:
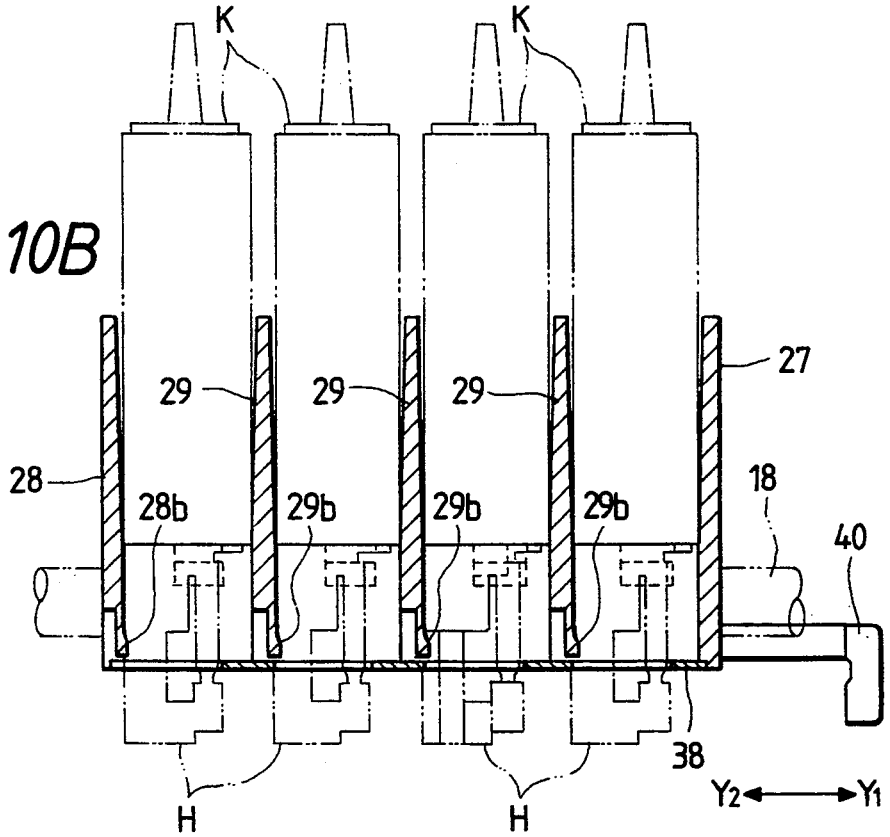
Figure 11:
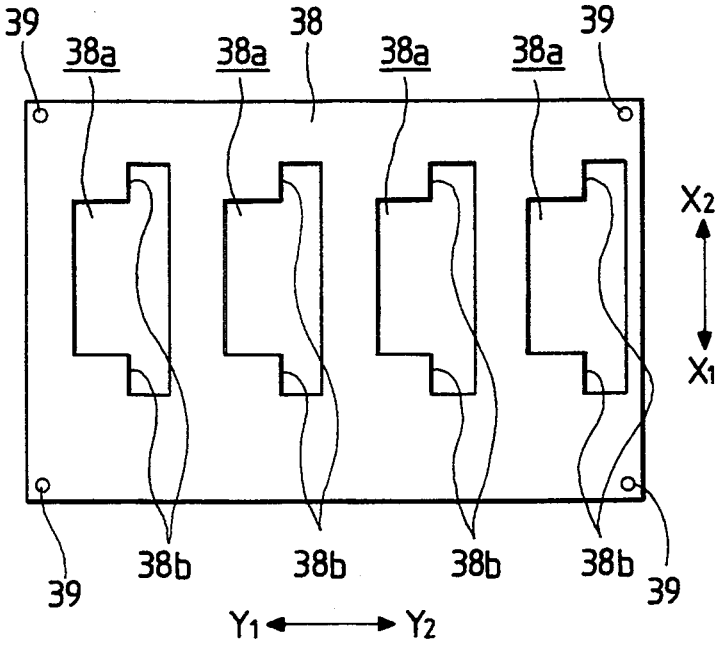
FIG. 11 is an explanatory diagram of a head positioning plate 38 shown in FIG. 10.
Figure 12:
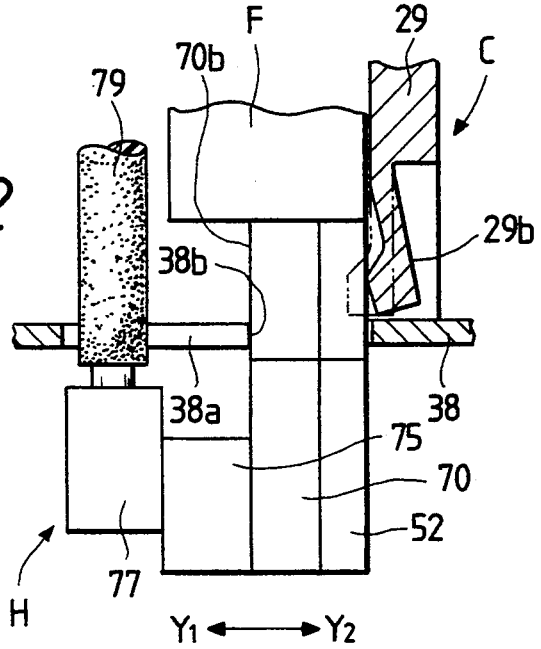
FIG. 12 is an explanatory diagram of a positioning structure for an ink-jet recording head "H" along a horizontal direction when the head cartridge K is inserted into the head carriage C.
Figure 13A:
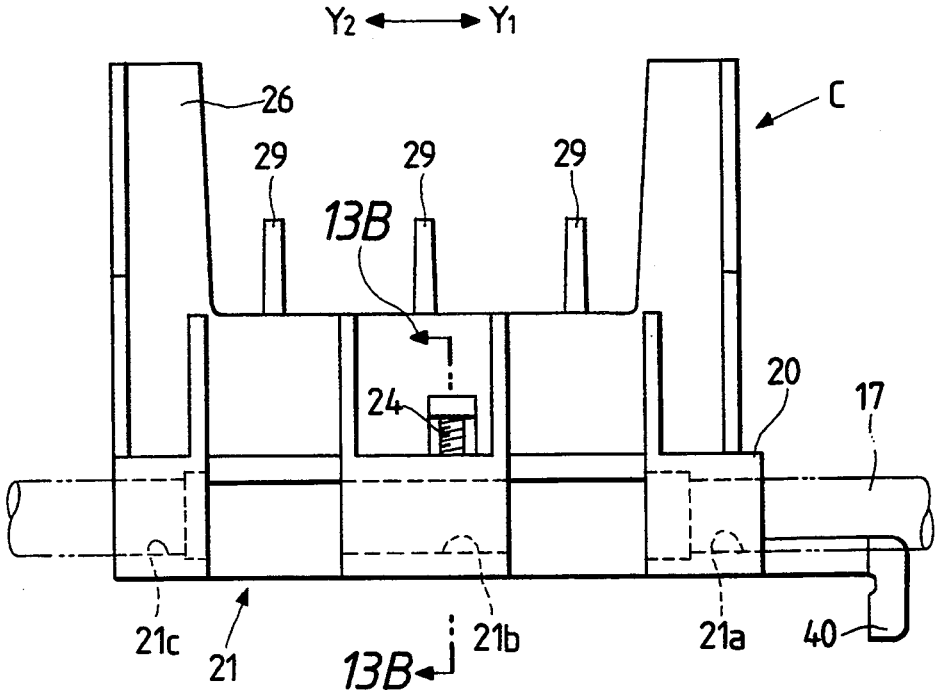
FIGS. 13A and 13B are explanatory diagrams of a drive structure for the head carriage C, FIG. 13A as a side view of the head carriage C as viewed along an arrow 13A of FIG. 6.
Figure 13B:
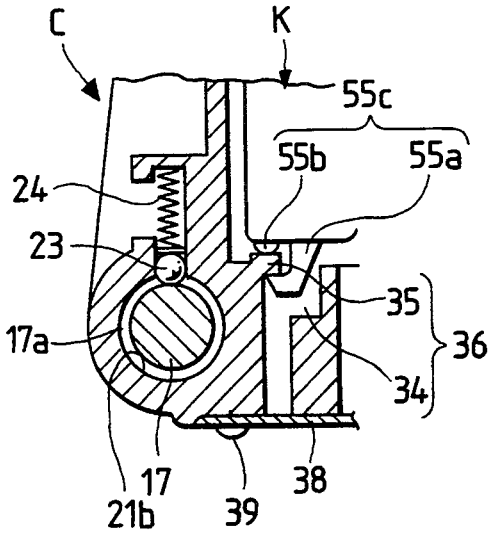
Figure 14:
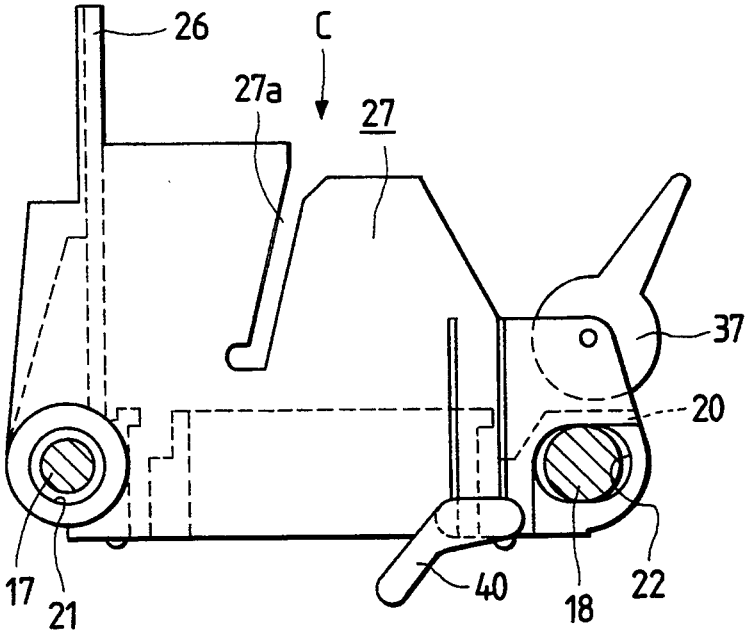
FIG. 14 is a view as viewed along an arrow 14 of FIG. 9.
Figure 15:
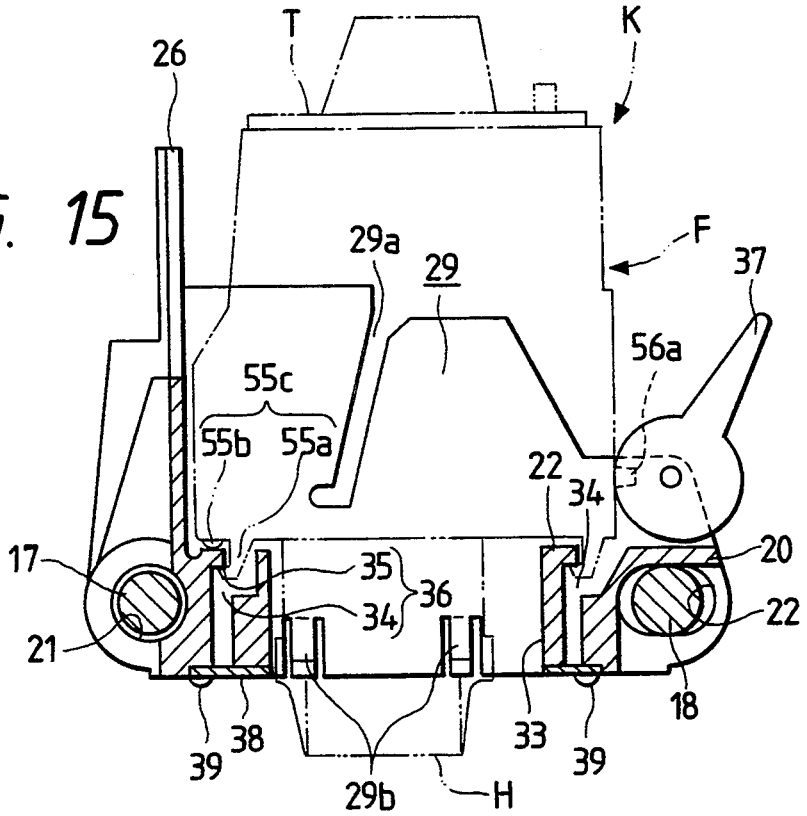
FIG. 15 is a sectional view of the head carriage C, taken along a line 15—15 of FIG. 9.

FIGS. 9 to 15 are explanatory diagrams of a single body of the head carriage C. FIG. 9 is a plan view of this head carriage C. FIG. 10 is a detailed explanatory diagram of a side sectional view of the head carriage C. FIG. 10A is a sectional view of the head carriage C, taken along a line 10A to 10A of FIG. 9. FIG. 10B is a sectional view of the head carriage C of FIG. 9. FIG. 11 is an explanatory diagram of a head positioning plate 38 of a bottom surface of the head carriage C. FIG. 12 is an explanatory diagram of a positioning structure for the ink-jet recording head "H" in the horizontal direction when the head cartridge K is inserted into the head cartridge C. FIG. 13 is an explanatory diagram of a drive structure for the head carriage C. FIG. 13A is a view of the drive structure as viewed from an arrow 13A of FIG. 9. FIG. 13B is a sectional view of the drive structure, taken along a line 13B—13B of FIG. 13A. FIG. 14 is a view of the head carriage as viewed from an arrow 14 of FIG. 9. FIG. 15 is a sectional view of the head carriage of FIG. 9.

As represented in FIGS. 6 to 15, as viewed in the plan views (see FIGS. 8 and 9), the head carriage C owns a substantially rectangular shaped carriage main body 20. A screw shaft through hole 21 is formed in the rear lower portion (lower portion at a side of an arrow X1 shown in FIG. 7A) of this carriage main body 20. Another guide shaft through hole 22 is formed in the front lower portion of this carriage main body 20 (see lower portion at a side of an arrow X1 shown in FIG. 7A). The screw shaft through hole 21 is constructed of three through holes 21*a*, 21*b* and 21*c* (refer to FIG. 13A), which are separated along the horizontal direction (i.e., a direction of Y1 to Y2). As apparent from FIG. 7A, the screw shaft 17 and the guide shaft 18 pass through the screw shaft through hole 21 and the guide shaft through hole 22, respectively.

As shown in FIGS. 13A and 13B, a ball 23 engaged with a screw groove 17*e* of the screw shaft 17 is disposed in the through hole 21*b*. This ball 23 is continuously depressed by a spring 24 inwardly to the through hole 21.

As a result, when the screw shaft 17 is rotated by a proper transmission mechanism (see FIG. 2) 19 by the motor (see FIG. 2), the head carriage C is transported along the horizontal direction (namely, direction of Y1 to Y2, see FIGS. 2 and 6).

A carriage rear wall 26 is formed on the rear upper surface of the above-explained carriage main body 20 in such a manner that this rear wall is extended. A carriage left-side wall 27 and a carriage right-side wall 28 as an insertion guide wall for guiding the head cartridge "K" are formed on both upper surfaces of the right and left edges of the carriage main body 20 in such a manner that these right-side wall 28 and left-side wall 27 are extended. The left-side wall 27 and the right-side wall 28 and also the carriage rear wall 26 are arranged in a "U"-shaped form, as a viewed in a plan view (refer to FIGS. 8 and 9). The left- side wall 27 is positioned in parallel with the right-side wall 28.

As indicated in FIGS. 6, 8 and 9, three intermediate walls (newly, insertion guide wall) 29 are provided among the left-side wall 27 and the right-side wall 28 in such a way that the intermediate walls are positioned in parallel with these side walls 27 and 28 under the same interval. Holder guide grooves 27*a*, 28*b*, 29*a* are formed on the respective side walls 27, 28 and 29 in such a manner that the holder guide grooves are extended from the upper end central portion toward a lower portion. The functions of these holder guide grooves 27*a*, 28*a*, 29*a* are such grooves to guide the above-described tank holder F (will be described later).

Further, as shown in FIGS. 10A, 10B, 12 and 15, depression elastic portions 28*b* and 28*b* are formed in the lower end portions of the side walls 28 and 29. These depression elastic portions 28*b* and 29*b* have a function to depress the head cartridge K along a left direction (namely, the Y1 direction, see FIGS. 10A, 10B and 12) when the head cartridge K is inserted into the head carriage C (will be discussed later more in detail).

As represented in FIGS. 6, 9 and 14, the rear ends of the carriage left-side wall 27 and the carriage right-side wall 28 are connected to the carriage rear wall 26, whereas an interval is defined between the rear end of the intermediate side wall 29 and the carriage rear wall 26. Then, a board insertion groove 31 (see FIGS. 6 and 9) is formed by way of the above-described intervals which are formed among three intermediate side walls 29 and the carriage rear wall 26. A detailed description will be made of a connection board "B" (see FIGS. 6, 7 and 16) to be inserted into this board insertion groove 31.

In FIG. 9, within the respective side walls 27, 29, 29, 28, the upper surface of the carriage main body 20 sandwiched by a pair of side walls constitutes a single holder bottom wall supporting plane (namely, head supporting member mounting portion) 32. This single holder bottom wall supporting plane 32 is constructed of a front side portion 32*a* and a rear side portion 32*b*, and a head through hole 32 is formed in these intermediate portion.

In other words, four holder bottom wall supporting planes (namely, head supporting member mounting portions) 32 in total are formed in the upper surface of the carriage main body 20, and head through holes 33 are fabricated in the respective central portions of these holder bottom wall supporting planes 32. Carriages bottom planes 20*a* are formed from 4 holder bottom wall supporting surfaces 32 of the upper plane of the carriage main body 20.

Both of an L-type pawl storage unit 34 and a sandwiched portion 35 as a loose preventing member as shown in FIGS. 9 and 13B are formed on the front and rear end portions of the respective holder bottom wall supporting plane 32.

In connection with the above-described four holder bottom wall supporting planes 32, depression members (see FIGS. 6 to 9) are formed on the upper surface of the carriage main body 20 in such a manner that these depression member 37 are freely rotatable. As represented in FIG. 7B, the depression member 37 has a pivot lever 37*a* and an eccentric cam 37*b* integrally made of this pivot lever 37*a*. The depression member 37 are freely pivotable around a shaft positioned in parallel to the screw shaft 17 and the guide shaft 18.

A cam plane (depression cam plane) of the eccentric cam 37*b* is to depress a depressed plane (will be discussed later) of the tank holder F when the tank holder F is depressed.

A cam groove 37*c* is formed in the cam plane (depression cam plane) of the eccentric cam 37*b*. This cam groove 37*c* corresponds to a groove which is engaged with a projection (will be discussed later) formed in a depressed plane (will be described later) of the tank holder F when the tank holder F is depressed.

The depression member 37 must be maintained under such a stable condition that the depression member 37 is pivoted to the depression side, thereby depressing the tank holder F (in other words, the head cartridge K is mounted on the head carriage C). As a consequence, the depression cam plane of the depression member 37 is so formed that the attaching portion thereof to tank holder F under the above-described depression condition (namely, mounting state) is positioned slightly lower than the adjoining portion. As described above, when the attaching portion of the depression cam plane to the tank holder F under the mounting condition is formed slightly lower than the depression cam plane adjacent to this attaching portion, the depression member 37 becomes stable at this position. In other words, the depression cam plane having such a shape may function as a mounting condition maintaining condition capable of keeping the mounting condition under stable condition.

In this case, under such a depression condition, when a force to move the tank holder F against a depressed side is exerted to the tank holder F (namely, head cartridge K), a force to pivot the depression member 37 to the depressed side is exerted to the depression member 37. However, since the adjoining depression cam plane is formed higher than the attaching portion of the depression cam plane with the tank holder F under the depression condition, the depression member 37 is not rotated to the anti-depression direction.

Since the depression cam plane is formed in such a condition, the tank holder "F" is held at a predetermined mounting position under a stable condition with maintaining such a state that this tank holder "F" is depressed to a predetermined mounting position of the head carriage C.

That is, in accordance with this preferred embodiment 1, the mounting condition holding means for holding the mounting state of the head cartridge K to the head cartridge C is constituted by the local portion (i.e., mounting condition holding plane) formed at the depression cam plane of the depression member 37 at such a lower position.

As indicated in FIGS. 7B, 8 and 9, the above-described cam groove 37*c* is inclined with respect to the rotation shaft of the depression member 37, and has such a function that when the depression member 37 is rotated, a projection (will be discussed later) of the depressed plane of the tank holder F engaged with this cam groove 37*c* is depressed against the rotation shaft along the vertical direction, and also is depressed against the rotation shaft along a direction parallel to the rotation shaft (Y1 direction). A detailed explanation thereof will be made later.

Also, as shown in FIGS. 10A, 10B, 11, 13B and 15, a head positioning plane 38 is fixed by a screw (refer to FIGS. 13 and 15) to a lower end of the carriage main body 20. As shown in FIG. 11, four head positioning holes 38*a* are formed through which a tip portion of the ink jet recording head "H" of the head cartridge K. An interval of the front and rear end portions (end portions along X1-X2 direction) of the head positioning holes 38*a* is made narrow along the horizontal direction (i.e., Y1-Y2 direction). A left edge 38*b* of this narrow interval is used as a positioning edge 38*b* of the head cartridge K (see FIG. 12), which will be discussed later.

As represented in FIGS. 6, 7A, 8 and 9, a projection 40 is provided at the left side portion (side portion of the arrow Y2) of the carriage main body 20. When the head carriage C is moved along the horizontal direction (Y1-Y2 direction) along the screw shaft 17 and the guide shaft 18, and then has reached its home position (left end portion of FIG. 2), the projection 40 has a function to trigger a limit switch (not shown). Then, when this limit switch is triggered, the capping unit 11 (see FIG. 3) is actuated to cap a cap (not shown) on an ink outlet port of the ink jet recording head H. As this capping unit 11, the known capping unit may by utilized.

Next, a description will now be made of a connection board B (refer to FIGS. 6, 7A and 16) to be inserted into the above-described board insertion groove 31 (see FIGS. 6 and 9).

Figure 16A:
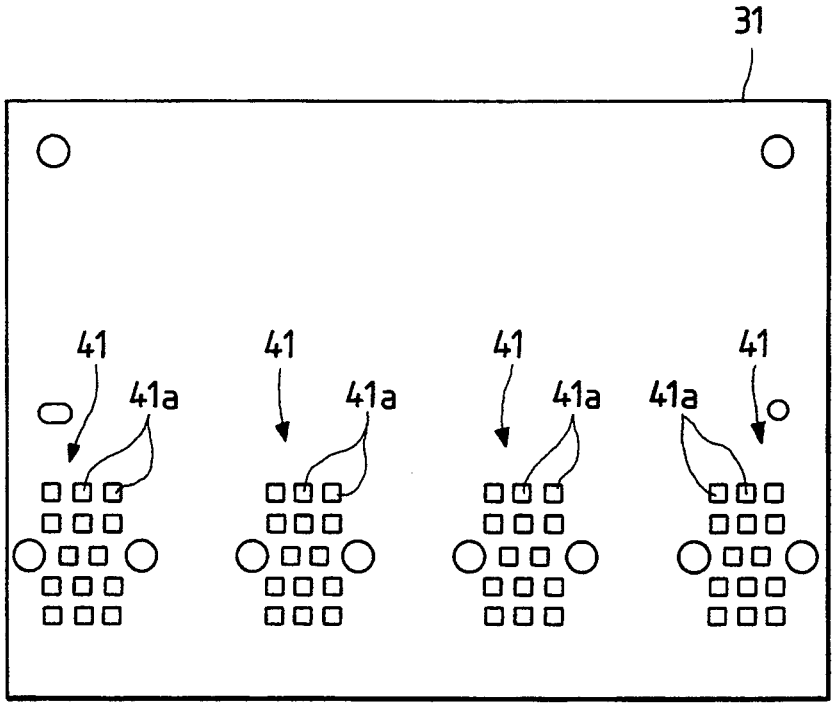
FIGS. 16A and 16B are explanatory diagrams of a connection board B.
Figure 16B:
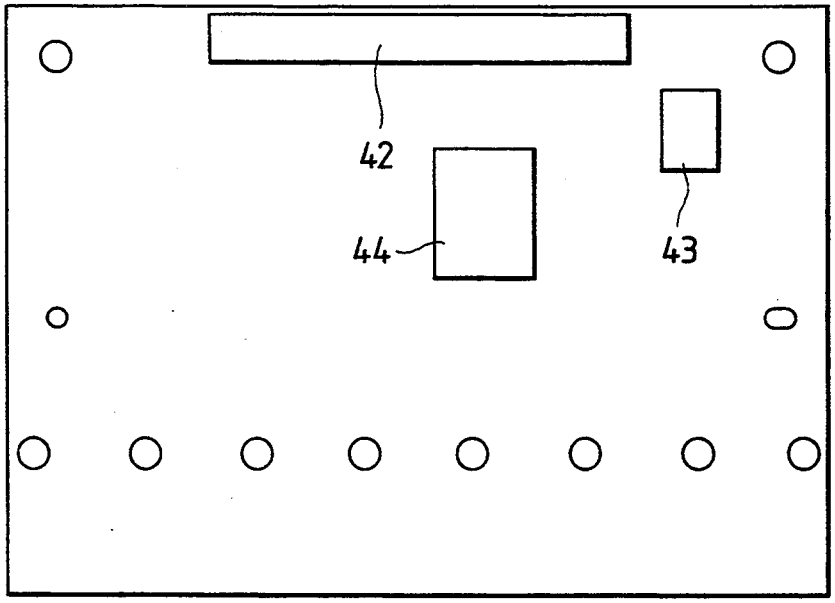

FIG. 16 is an explanatory diagram of the connection board B, FIG. 16A is a front view of the connection board B (namely, a view for showing a plane of this board at a side of an arrow X1), and FIG. 16B is a rear view thereof.

In FIG. 16A, there are provided connection terminal portions 41 for the carriage side at the positions corresponding to the four holder bottom wall supporting planes 32 (see FIG. 9) at the front plane of the connection board B. The respective carriage- side connection terminal portions 41 have a plurality of connection terminals 41*a*.

In FIG. 16B and FIG. 7A, a pin connector 42, and electronic parts 43, 44 such as an IC are mounted on the rear surface of the connection board B. The pin connector 42 corresponds to a connector for connecting the main board 8 (see FIGS. 2, 4 and 5) with a connection cable (not shown).

Referring now to FIGS. 17 to 25, a description will be made of the head cartridge K which is constructed of the tank holder F and the ink jet recording head H connected to this tank holder F in an integral form.

Figure 17:
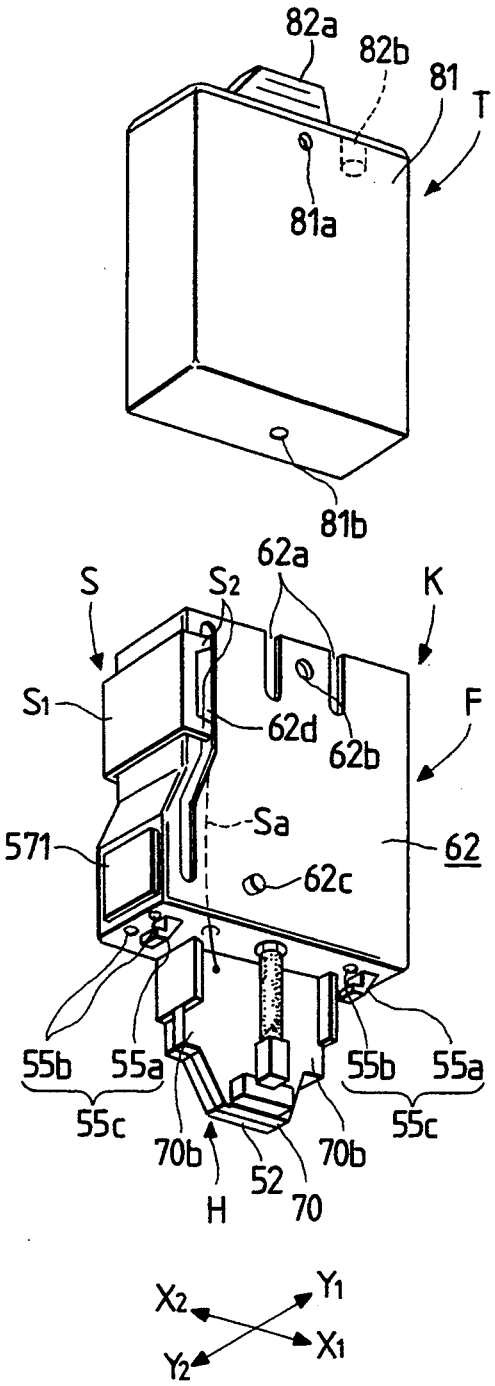
FIG. 17 is a perspective view for showing a condition under which the head cartridge K and the ink tank T mounted on this head cartridge K are released.

FIG. 17 is a perspective view for indicating such a condition that the head cartridge K is released from the ink tank T to be mounted to this head cartridge K.

Figure 18:
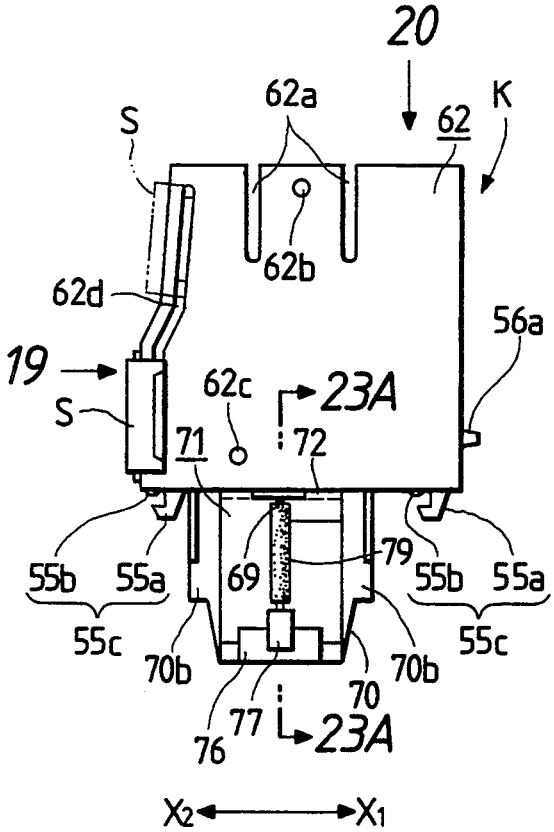
FIG. 18 is a left side view (i.e., a side view as view at a side 1 of the arrow Y1) of the head cartridge K.

FIG. 18 is a left side view of the head cartridge K (side view at the side of the arrow Y1 in FIG. 17).

FIG. 19 is a view of the head cartridge K shown in FIG. 18, as viewed from an arrow 19, from which a shutter S has been omitted.

Figure 19A:
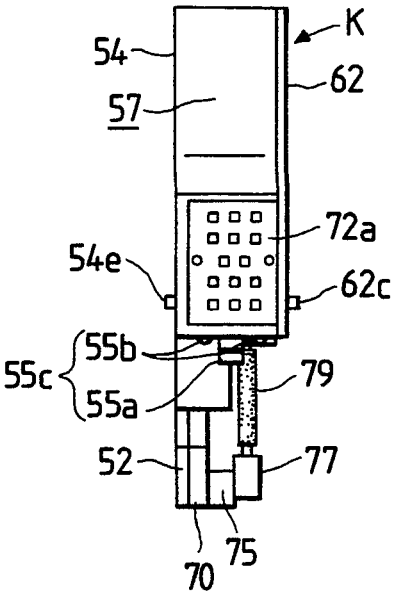
FIGS. 19A and 19B are rear side views of the head cartridge "K" namely, side views as viewed at a side of an arrow X2 shown therein (a view as viewed from the arrow 19, while omitting a shutter S of the head cartridge K of FIG. 18)
Figure 19B:
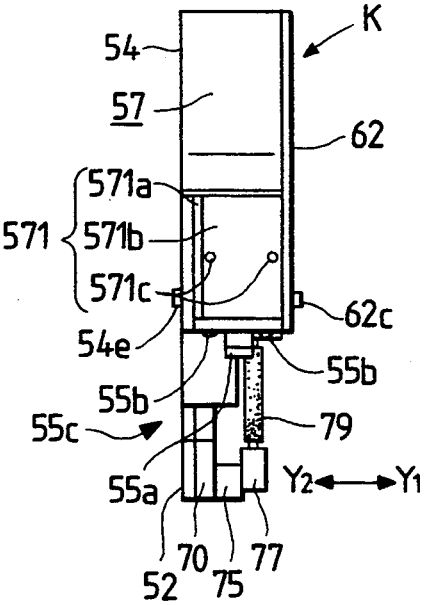

FIG. 19A is a view for representing such a condition that a flexible cable 72 is mounted, and FIG. 19B is a view in which a connection terminal portion 17 of the flexible cable is omitted.

Figure 20:
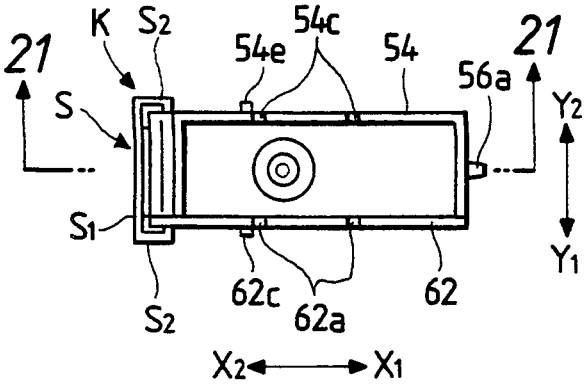
FIG. 20 is an upper view of the head cartridge K (i.e., a view shown from an arrow 20 of FIG. 18)
Figure 21:
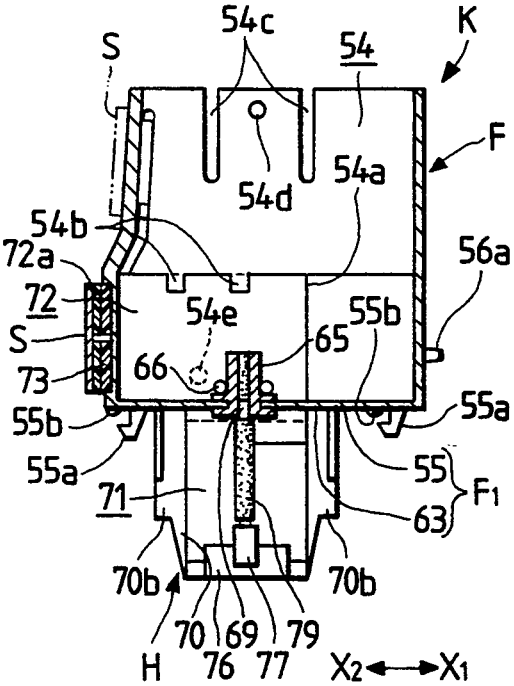
FIG. 21 is a sectional view of the head carriage, taken along an arrow 21—21 of FIG. 20.
Figure 22A:
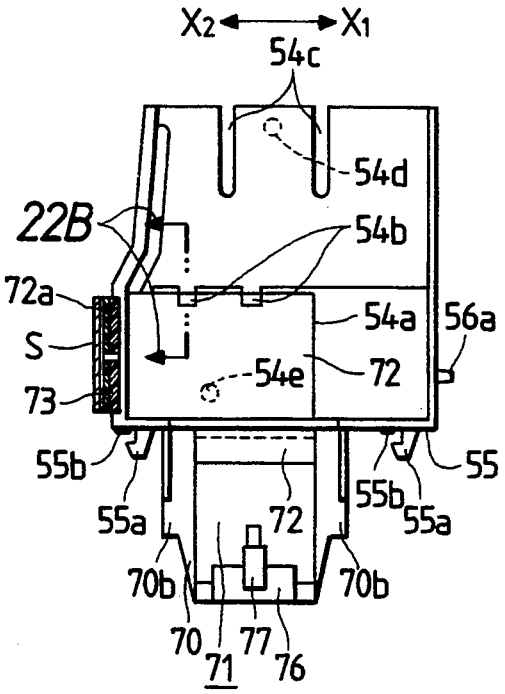
FIGS. 22A and 22B are explanatory diagrams from which a cover member 61 of a tank holder F of the head cartridge K is omitted, FIG. 22A being an overall view, and FIG. 22B being a sectional view, taken along a line 22B—22B of FIG. 22A.
Figure 23A:
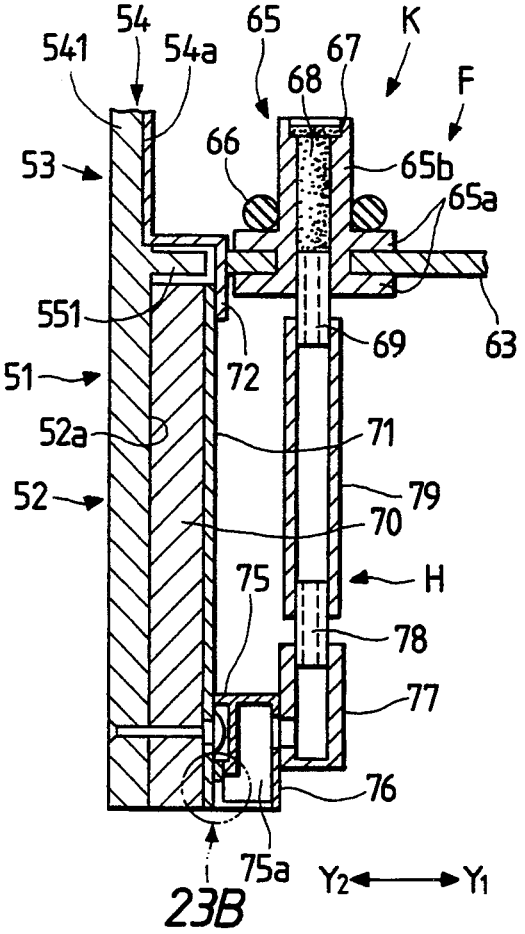
FIG. 23A is a detailed explanatory diagram of an ink-jet recording head "H" portion in the head cartridge K, the figure being a sectional view of the head cartridge K, taken along the line 23A—23A.
Figure 22B:
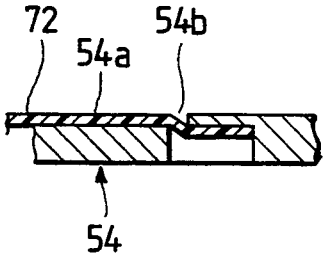
Figure 23B:
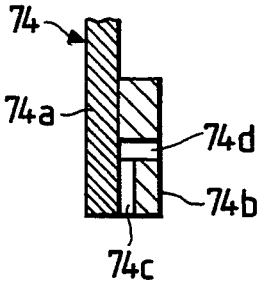
FIG. 23B is an enlarged diagram of the portion indicated by an arrow 23B of FIG. 23A.
Figure 24:
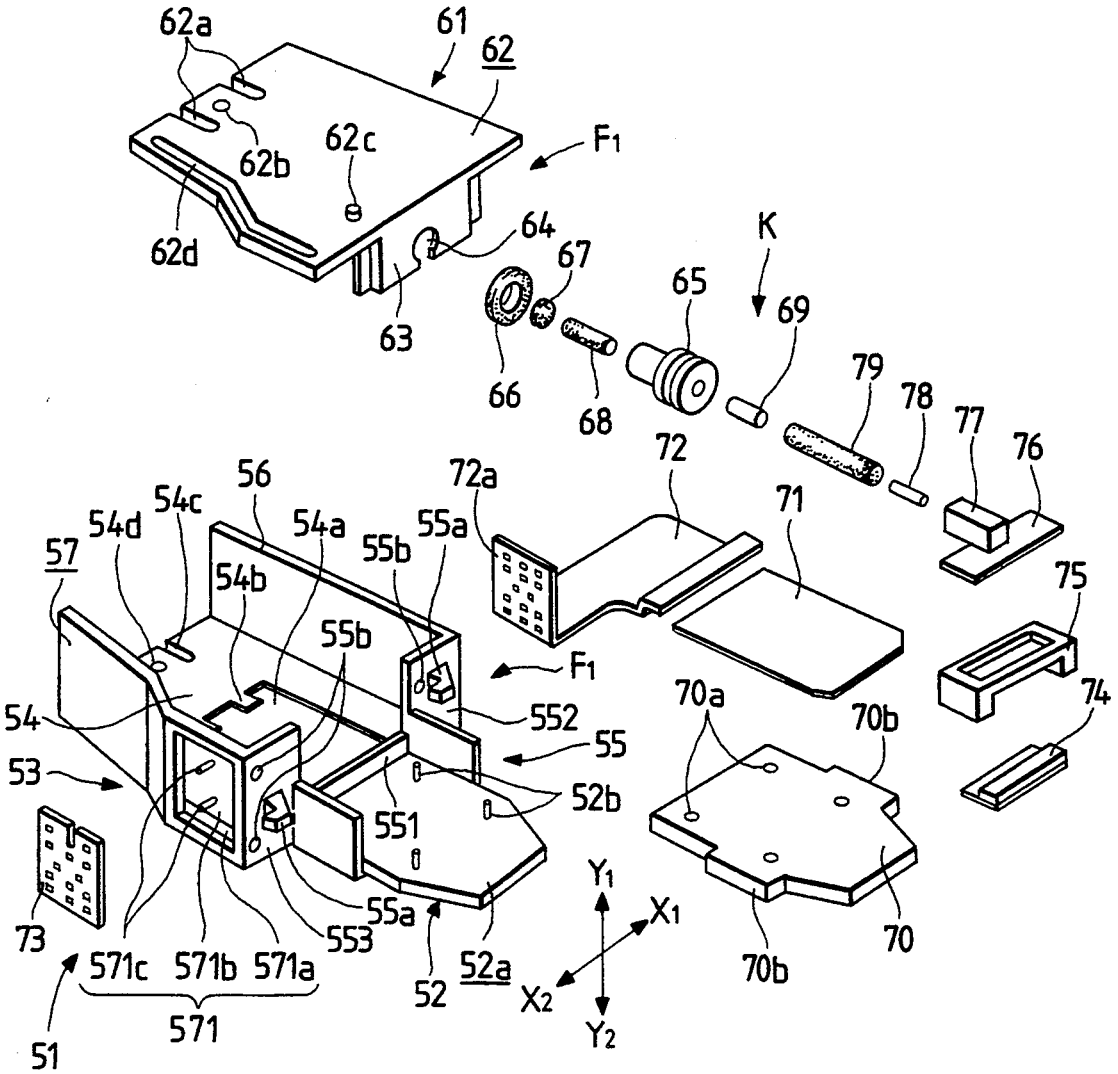
FIG. 24 is an exploded perspective view of the head cartridge K.
Figure 25:
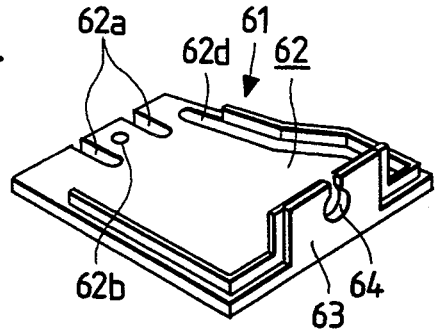
FIG. 25 is a perspective view of a cover member of a tank holder F of the head cartridge K.

FIG. 20 is an upper view of the head cartridge K (i.e., a view shown from an arrow 20 of FIG. 18);

FIG. 21 is a sectional view of the head carriage, taken along an arrow 21—21 of FIG. 20;

FIG. 22 is an explanatory diagram from which a cover member 61 of a tank holder F of the head cartridge K is omitted, FIG. 22A is an overall view, and FIG. 22B is a sectional view, taken along a line 22B—22B of FIG. 22A;

FIG. 23 is a detailed explanatory diagram of an ink-jet recording head "H" portion in the head cartridge K, FIG. 23A is sectional view of the head cartridge K, taken along the line 23A—23A, and FIG. 23B is an enlarged diagram of the portion indicated by an arrow 23B of FIG. 23A;

FIG. 24 is an exploded perspective view of the head cartridge K;

FIG. 25 is a perspective view of a cover member of a tank holder F of the head cartridge K.

In FIG. 24, the head cartridge K has a base plate member 51. This base plate member 51 owns a head supporting portion 52 and a tank holder forming portion 53. The tank holder forming portion 42 includes a holder right-side wall 54 formed at the substantially same plane with the head supporting portion 52, and a holder bottom wall portion 55 which rises at a substantially right angle along a boundary line between this holder right-side wall 54 and the head supporting portion 52. This holder bottom wall portion 55 is arranged by a lower partition wall portion 551 at a center portion thereof, a holder bottom wall front side portion 552, and a holder bottom wall rear side portion 553, which are positioned with sandwiching the central partition wall portion 551.

The tank holder forming portion 53 has a pair of holder front wall 56 and holder rear wall 57, which rise from the front and rear end portions of the holder right-side wall 54.

A flexible cable storing portion **54*a* is fabricated at an inner surface of the holder right-side wall 54. This flexible cable storing portion 54*a* is formed in such a manner that this storing portion 54*a* is made concave more than other portions of the inner surface of the holder right-side wall 54. Then, a flexible cable may be stored into this flexible cable storing portion 54*a*. That is to say, as apparent from FIGS. 23A and 24, the inner surface of this flexible cable storing portion 54*a* is made concave by approximately 1 mm from the head supporting plane (i.e., right-side plane of FIG. 23A) of the head supporting unit 52. Then, in this preferred embodiment 1, both of the portion (see FIG. 21 and 24) of the inner surface (rightside surface of FIG. 23A) of the holder right-side wall 54 except for the flexible cable storing portion 54*a*, and the head supporting plane 52*a* of the head supporting portion 52** are formed on the same plane.

Then, as indicated by FIGS. 21 and 22A, in the inner plane of the above-described holder right-side wall 54, two cable stopping portions **54*b* are formed at the edge portion of the flexible cable storing portion 54*a*. As seen from FIG. 2B, the cable stopping portion 54*b* is constructed of a concave formed by an outer surface side (lower side of FIG. 22B) of the holder right-side wall 54, and a "U"-shaped slit (see FIGS. 21 and 22A) passing through the flexible cable storage portion 54*a***.

Two parallel slits **54*c*, 54*c* are formed in the upper end portion (upper end portion in FIGS. 21, 22A, or upper left-side portion in FIG. 24) of the holder right-side wall 54. Then, a circular stopping hole 54*d* as the stopping member is fabricated at an intermediate portion of the above-explained two slits 54*c*, 54*c* of the holder right-side wall 54. The circular stopping hole 54*d* owns a function to position the tank T and to maintain this tank T (will be discussed later). Then, these two slits 54C, 54C own a function to cause a portion of the holder right-side wall 54** positioned therebetween to have elastic characteristics.

Also, a guided projection **54*e* (refer to FIGS. 19 and 201 is formed on the outer surface of the holder right-side wall 54. This guided projection 54*e* is guided in engagement with the holder guide groove 28*a*, or 29*a* of the head carriage C (see FIGS. 6, 8, 9, 15**).

In FIG. 24, "L"-shaped pawls **55*a*, 55*a* are provided on the outer surfaces of the holder bottom wall front side portion 552 and the holder bottom wall rear side portion 553, which constitute the above-described holder bottom wall portion 55. As apparent from FIGS. 13, 21, 22A, 24 and so on, the L-shaped pawl 55*a* has a projection portion projected outwardly from the outer plane of the holder bottom wall 55 (refer to FIG. 24), and a loosen stopper portion which is provided at a tip portion of this projection portion and is extended in parallel to the holder bottom wall outer surface. Then, a semi-spherical holding projection 55*b* is formed at the outer surfaces of the holder bottom wall front side portion 552 and the holder bottom rear side portion 553 at a position corresponding to the loose stopper portion which is extended in parallel to the holder bottom wall outer surface of the "L"-shape pawl 55*a***.

It should be noted that a concrete arrangement of the above- described "L"-shape pawl **55*a* and holding projection 55*b* is clearly displayed in FIG. 24, which are provided at the outer surfaces of the holder bottom wall front side portion 552 and the holder bottom wall rear side portion 553. In FIG. 24, one holding projection 55*b* is formed on the outer surface of the holder bottom wall front side portion 552. This holding projection 55*b* is arranged at a position opposite to the loose stopping portion extending parallel with the holder bottom wall outer surface of the "L"-shaped pawl 55*a*. Two holding projections 55*b* are formed on the outer surface of the holder bottom wall rear side portion 555. These holding projections 55*b* and 55*b* are separately positioned from each other with respect to a position opposite to the loose stopping portion extending parallel to the holder bottom wall outer surface of the "L"-shaped pawl 55*a***.

An unloosed stopping member **55*c* (see FIG. 18) is constructed of the above-described "L"-shaped pawl 55*a* and semi-spherical holding projection 55*b*. This unloosed stopping member 55*c* is so arranged as to hold the held portion 55** of the head carriage C, as shown in FIG. 13B, when the head cartridge K is mounted to the head carriage C.

A guided projection 56*a* (see FIGS. 18, 20, 21, and 22A) is formed in the outer surface of the holder front wall 56. This guided projection 56*a* corresponds to a projection which is engaged with the cam groove 37*c* (see FIGS. 7B, 8, 9) of the depression member 37 provided at the head carriage C. This projection 56*a* is arranged at a position corresponding to the guided projection 54*e* (refer to FIGS. 19 and 20) of the outer surface of the holder right-side wall 54.

In FIGS. 24 and 19B, a terminal holding portion 571 is provided at the outer surface of the holder rear wall 57, which holds a connection terminal portion of a flexible cable (will be described later) for the ink-jet recording head "H" of the head cartridge "K". This terminal holding portion 571 is arranged by a cable insertion hole 571*a* through which the flexible cable (will be discussed later) is drawn from the inside of the holder rear wall 57 to the outside thereof, an concave 571*b* for storing an elastic member (will be described later) positioned at a lower side of the flexible cable drawn out from this cable insertion hole 571*a*, and two positioning pins 571*c*. This terminal holding portion 571 will be explained later.

In FIG. 24, the head cartridge K has a core member 61 which is coupled to the tank holder forming portion 53 of the circuit board member 51 to constitute the tank holder F. The cover member 61 owns a holder left-side wall 62 and a holder bottom-wall center portion 63. The holder left-side wall 62 is coupled with left ends of the holder bottom-wall portion 55, the holder front wall 56, and the holder rear wall 57 of the tank holder forming portion 53 (namely, indicated by Y1 of FIGS. 19A and 19B, lower end of FIG. 20, and upper end of FIG. 24) by means of an adhesive agent, or a thermal melting method. Then, the holder bottom wall F1 (see FIGS. 21 and 22) is constructed of the holder bottom wall portion 55 and the holder bottom-wall center portion 63.

Two parallel slits 62*a* are formed on the upper end portion of the holder left-side wall 62 for the cover member (i.e., upper end portion in FIG. 18, otherwise upper left-side portion in FIG. 24). Then, a circular stopping hole 62*b* functioning as the stopping member is formed at intermediate portions of the above-explained two slits 62*a* of the holder left-side wall 62. This circular stopping hole 62*b* owns such a function to position an ink tank "T" (will be explained later) and to hold this ink tank at a positioning place. Also, these two slits 62*a* have such a function to cause a portion of the holder leftside wall 62 provided therebetween to have an elastic characteristic.

Guided projections 62*c* (see FIGS. 18, 20 and 24) are provided on the outer surface of the holder left-side wall 62. These guided projections 62*c* are guided with being engaged to either the holder guide groove 27*a*, or the holder guide groove 29*a* (see FIGS. 6, 7A and 8) of the head carriage. The guided projections 62*c* are arranged at positions corresponding to the guided projection 54*e* (FIGS. 19 and 20) formed on the outer surface of the holder right-side wall 54.

At the outer surface of the holder left-side wall 62, a slit-shaped guide group as a shutter guide, namely a shutter guide group 62*d* (see FIGS. 17, 18 and 24) is formed. This shutter guide groove 62*d* is such a groove to guide the shutter S (see FIGS. 17, 18 and 20).

FIG. 17, the shutter S has a conductive covering plate S1 and one pair of leg portions S2 which are provided on both sides of this covering plate S1, and hold the outer surfaces of the left and right side walls 62 and 54 (see FIGS. 19A, 19B, 20) of the tank holder F. Projections (not shown in detail) for holding the holder side walls 62 and 54 are provided at the inside planes of the leg portions S2. Then, the projections formed on the leg portions S2 for holding the holder left side wall 62, is fitted with the shutter guide groove 62*d* so as to be guided. As a consequence, the shutter S can be moved along the shutter guide groove 62*d* between a terminal covering position (refer to a solid-line position of FIGS. 18 and 21) for covering a connection terminal portion of a flexible cable (will be discussed later) held by the terminal holding portion 571 (see FIGS. 19B, 24) of the outer face of the holder rear wall 57, and a terminal opening position (refer to a solid-line position of FIG. 17, and a dot/dash line position of FIG. 18 and FIG. 21) for opening the connection terminal portion.

Also, as shown in FIG. 17, the shutter S is grounded to an aluminum base member (will be explained later) of the ink-jet recording head "H" by way of a conductive ground line Sa.

In FIG. 24, the holder bottom wall central portion 63 of the cover member 61 has a joint supporting hole 64. An ink joint 65 (see FIGS. 23A and 24) is mounted on this joint supporting hole 64 and is fixed therein by an adhesive agent. In FIGS. 23A and 24, the ink joint 65 has a pair of flanges 65*a* and 65*a* which have a large diameter and are arranged at the lower end portion thereof, and a small-diameter portion 65*b* arranged at the upper portion thereof. Then, a small-diameter portion between the above-explained pair of flanges 65*a* and 65*a* is mounted to the joint supporting hole 64, and the small-diameter portion 65*b* of the upper portion projects into an inside of the tank holder F. Then, a seal ring 66 is mounted on the lower portion of the small-diameter portion 65*b* of the ink joint 65. The lower surface of this seal ring 66 is supported by the flange 65*a* of the ink joint 65.

A stepped portion is formed at the upper end of the inside of the small-diameter portion 65*b* for the ink joint 65. A thin disk-shaped filter 67 having a filtering particle of 10 to 20 micrometers is positioned at this stepped portion. A porous body 68 is stored inside the small-diameter portion 65*b* in such a manner that this porous body 68 is in contact with a lower surface of the filter 67. Also, as shown in FIG. 23A, a joint sided communication tube 69 for communicating with an inside of the ink joint 65 and an outside thereof, is coupled to the ink joint 65 at the lower end thereof.

Next, a description will now be made of the ink-jet recording head "H" of the head cartridge K.

In FIGS. 23A and 24, the ink-jet recording head "H" has the head supporting portion 52 formed on the base plate member 51 of the head cartridge K. The side surface of the head supporting portion 52 at the Y1 side, namely the left side surface (i.e., right side surface in FIGS. 23A, upper surface in FIG. 24) is formed as the head supporting surface 52*a*. 4 positioning fixed projections (see FIG. 24) are formed on the head supporting plane 52*a* in an integral form.

A heat sink 70 made of aluminum is mounted on the head supporting plane 52*a*. This heat sink 70 has a heat sinking function (namely, function to absorb/radiate heat energy produced from a heater when ink is exhausted). On this heat sink 70, four positioning holes 70*a* are formed and are engaged with the above-described fixing projection 52*b*. After the fixing projection 52*b* is engaged with the positioning hole 70*a*, this fixing projection 52*b* is melted so as to fix the head sink 70.

In FIG. 24, head positioning planes 70*b* are provided at the front side and the rear side of the heat sink 70. This head positioning planes 70*b* are fabricated by left-side planes (side planes at Y1 side) of the positioning projections projected from the heat sink 70 at the front side and the rear side. This head positioning plane 70*b* is such a member for positioning the head cartridge "K" under such a condition that this positioning plane 70*b* abuts the above-explained positioning end 38*b* (see FIGS. 11 and 12). As shown in FIG. 12, the ink-jet recording head "H" is held at a position that when the head cartridge "K" is inserted into the read carriage "C", this ink-jet recording head is depressed leftwardly by the depression elastic portion 29*b*, and the head positioning plane 70*b* abuts the positioning edge 38*b* (see FIGS. 11 and 12) of the positioning plate 38.

In FIGS. 23A and 24, a printed circuit board 71 made of resin is adhered to a portion of the heat sink 70 except for the tip portion (namely, right end portion of FIG. 24 and lower end portion of FIG. 23A), whereas a head chip 74 (will be discussed more in detail, and see FIG. 23B) is adhered to this tip portion.

One end portion of the flexible cable 72 is connected to the upper end terminal portion of the printed circuit board 71 by way of a conductive adhesive agent. As indicated in FIG. 24, a connection terminal portion 72*a* is provided at other end portion of this flexible cable 72, and as represented in FIGS. 22A and 24, an intermediate portion of this flexible cable 72 has a bent shape at a right angle.

Also, as shown in FIG. 23A, this flexible cable 72 exceeds over the low-height partition wall portion 551 of the holder bottom portion 55, and a major portion thereof is stored into the flexible cable storing portion 54*a* formed at the inner surface of the holder right-side wall 54. Then, as indicated in FIGS. 21 and 22A, a portion of the flexible cable 72 stored into the flexible cable storing portion 54*a*, is stopped at a predetermined position by means of two cable stopping portions 54*b* (see FIGS. 22A and 22B) provided at the side edge portion of the flexible cable storing portion 54*a*.

The connection terminal part 72*a* of the flexible cable 72 passes through the cable through hole 571*a* of the terminal holding portion 571 (see FIGS. 19B) provided at the outer surface of the holder rear wall 57, and is exposed from the outer surface of the tank holder F (see FIG. 19A). As represented in FIGS. 19A, 21 and 22A, an elastic sheet (namely, elastic member) 73 and the connection terminal portion 72*a* are arranged in an overlapping state in the concave 571*b* of the terminal holding portion 571. In this elastic sheet 73, small hardened portions are formed at positions corresponding to a plurality of terminals provided at the connection terminal portion 72. Then, the elastic sheet 73 is so constructed that the elastic sheet other than the hardened portions can be elastically compressed along a direction perpendicular to this sheet plane. Then, the connection terminal portion 72 is held at a position where this terminal portion is projected outwardly from the elastic sheet 73. When an external depression force is applied to this sheet, the sheet is deformed inwardly. However, a plurality of terminals of the connection terminal portion 72 are held at a position where these terminals are projected outwardly by the hardened portions. Accordingly, a plurality of terminals of the connection terminal portion, 72*a* are continuously projected outwardly by the hardened portions, so that the electric contacts can be established between these connection terminals and each of these plural connection terminals 41*a* of the carriage-side connection terminal portion 41 positioned in front of the connection board B (see FIG. 16).

In FIGS. 23A and 24, a manifold 75 is adhered for covering the outer surface of the head chip 74 which is adhered to the tip portion of the heat sink 70.

In FIGS. 23A and 23B, the head chip 74 is constructed by thereon a common electrode (not shown), a plurality of separate electrodes (not shown in detail), a heater substrate 74*a* on which a plurality of heaters (heating resistors) for connecting these electrodes, and a channel substrate 74*b* fixed on this heater substrate by employing a resin adhesive agent.

A large number of ink exhausting paths 74*c* are manufactured by the heater substrate 74*a*, and channels (grooves) formed on the channel substrate 74*b* in accordance with a plurality of heaters of the heater substrate 74*a*. The large quantity of ink exhausting paths 74*c* are formed in such a manner that these paths are aligned along the vertical direction to this drawing plane of FIG. 23B.

In the channel substrate 74*b*, ink supply channels 74*d* connected to the respective ink exhausting paths 74*c* and extended in the vertical direction of the drawing planes in FIGS. 23A and 23B are fabricated. It should be understood that the structure of the above-described head chip 74 is not limited to the above- described structure, but may be made by employing various sorts of conventional structures.

In FIG. 23A, an ink storage chamber 75*a* is formed in the manifold 75. This ink storage chamber 75*a* is communicated with the ink supply channel 74*d* (see FIG. 23B). As shown in FIGS. 23A and 24, the ink storage chamber 75*a* of the manifold 75 is closed by a cover 76. A connection member 77 communicated with the ink storage chamber 75*a* is fixed to an inside of this cover 76. Also, a chip-side communication tube 78 for communicating the inside of this connection member with an external portion, is coupled to this connection member 77.

This chip-side communication tube 78 is connected to the joint-side communication tube 69 by a connection pipe 79.

Figure 26:
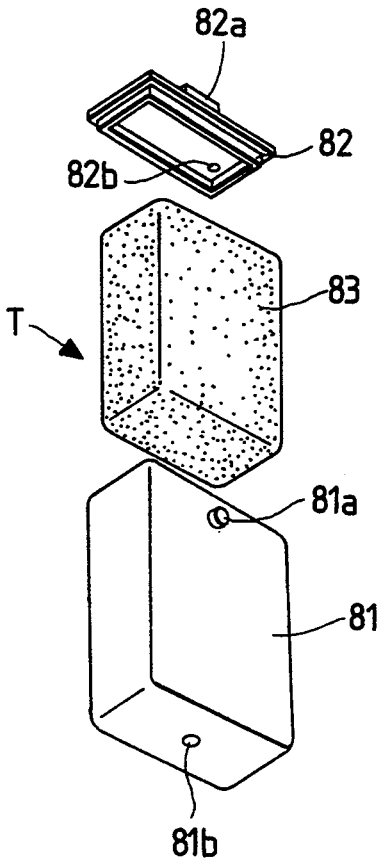
FIG. 26 is an exploded perspective view of the ink tank T.

In FIGS. 6, 7 and 17, the ink tank T shown together with the tank holder F are constructed of a tank case 81 for forming an ink storage space inside, a tank cover 82 for closing this ink storage space, and a porous ink holding body 83 stored in this ink storage space, as indicated in FIG. 26. A density of this ink holding body 83 is selected to be lower than that of the porous body 68 (see FIG. 23A) stored within the ink joint 65.

At the left side surface and the right side surface of the tank case 81 (namely, the side surfaces guided by the holder right-side wall 54 of the tank holder "F" and the holder left-side wall 62 thereof), there are provided semi-spherical projections 81*a* functioning as the positioning stopped members, respectively.

These projections 81*a* formed on the left and right side surfaces of the ink case 81 (namely, left/right side surfaces of ink tank T) are formed in such a way that these projections can be engaged with the circular stopping holes 54*d* (see FIG. 21) and 62*d* (see FIGS. 17 and 18) functioning as the stopping members, formed on the holder right-side wall 54 and the holder left-side wall 62 of the tank holder F.

A circular through hole 81*b* functioning as a joint connection member is formed in the bottom plane of the ink tank case 81 (bottom plane of ink tank T). This circular through hole 81*b* is formed in such a position that this through hole is fitted with the small diameter portion 65*b* (see FIG. 23A) the ink joint 65 projecting into an inside of the tank holder "F" when the ink tank T is inserted along the holder side walls 54, 62 of the tank holder F. Then, when the ink tank T is inserted into the tank holder F, the outer circumference portion of the through hole 81*b* formed in the bottom plane of the ink tank T is depressed against the seal ring 66 mounted on the ink joint 65. As a consequence, there is no ink leakage from the connection portion between the ink tank T and the tank holder F.

Under such a condition that the ink tank T is connected to the ink joint 65 of the tank holder F, the above-described ink holding member 83 is positioned in contact with the filter 67, and similarly this filter 67 is positioned in contact with the porous body 68.

The tank cover 82 for closing the ink storage space of the tank case 81, is fixed to the opening portion of the upper end portion of the tank case 81 by way of either an adhesive agent, or a heat melting method. On this tank cover 82, there is provided a handle 82*a* having a shape of a substantially flat plate, which is gripped by a finger of an operator when the ink tank T is pulled to be removed from the tank holder F.

Furthermore, as shown in FIGS. 7A and 26, an atmospheric communication hole 82*b* for communicating an inside of the ink tank T with an outside thereof is formed in the tank cover 82.

As described above, since the above-described handle 82*a* of the ink tank T and atmospheric through hole 82*b* are formed in the tank cover 82, the shape of the tank case 81 can be made simple.

Operation of First Ink-Jet Recording Apparatus

An operation of the ink-jet recording apparatus equipped with the above-described arrangement, according to the preferred embodiment of the present invention, will now be described.

In FIGS. 6 and 17, the porous ink holding body 83 (see FIG. 26) into which ink has soaked, is stored into the ink storing space of the ink tank T.

When this ink tank T is inserted toward the holder bottom plane of the tank holder F of the head cartridge K, the ink tank T is guided along the inside surfaces of the holder right-side wall 54 and the holder left-side wall 62. In this case, since the ink holding member 83 into which the ink has soaked is utilized, the ink can be hardly leaked from the circular through hole 81*b* formed in the bottom plane of the ink tank T as the joint connection member while the ink tank T is detached.

Then, one pair of semi-spherical projections (stopped member) 81*a* for the positioning purpose, which is formed on both side planes of the ink tank T, abut the upper end portions of the holder side walls 54 and 62 of the tank holder F. Since the holder side-wall portions at which one pair of semi-spherical projections (stopped members) 81*a* are abutted, correspond to a portion defined between the parallel slits 54*c* and 54*c* of the holder right-side wall 54, and also a portion defined between the slits 62*a* and 62*a* of the holder left-side wall 61, these semi- spherical projections has an elastic characteristic to be opened outwardly. As a consequence, the above-explained one pair of semi-spherical projections 81*a* abutting at the upper end portions of the holder side walls 54 and 62 of the tank holder F, are inserted into the holder bottom plane, while opening the holder side walls 54 and 62 along the horizontal direction.

Subsequently, when the ink tank T is further inserted toward the bottom plane of the tank holder F, the through hole 81*b* functioning as the joint connection member of the tank bottom plane is depressed against the ink joint 65 of the holder bottom plane. At this time, the small-diameter portion 65*b* of the upper portion of the ink joint 65 is fitted with the through hole (joint connection member) 81*b* of the tank bottom plane. Under this condition, since the outer peripheral portion of the through hole 81*c* of the bottom plane of the ink tank T is depressed against the seal ring (see FIG. 23A) mounted on the ink joint 65, no ink is leaking from the connection portion between the ink tank T and the tank holder F.

At the same time, the above-described one pair of semi-spherical projections (stopped member) 81*a* reach such a position where these projections 81*a* are engaged with the circular stopping hole (stopping member) 54*d* of the holder right-side wall 54 (refer to FIGS. 24, 21, 22A), as well as the circular stopping hole (stopping member) 62*b* of the holder left-side wall 62 (see FIGS. 24, 6, 17). Then, these one pair of projections 81*a* (see FIGS. 6 and 17) are stopped by the stopping holes 54*d* and 62*b*.

Under this condition, both of the bottom plane and the side planes of the ink tank T are correctly positioned to predetermined positions of the left side wall and the right side wall, and also the holder bottom wall F1 (see FIGS. 21 and 24) of the tank holder F.

As described above, under such a condition that the through hole 81*b* of the bottom plane of the ink tank T is connected to the small-diameter portion 65*b* of the ink joint 65, the ink holding member 83 is positioned in contact with the filter 67, and the filter 67 is positioned in contact with the porous member 68. Then, since the hole diameter of the ink holding member 83 is selected to be smaller than that of the porous member 68, and the thickness of the filter 67 arranged between them is thin, the ink held in the ink holding member 83 is flown from the ink tank T into the ink joint 65 due to the capillary phenomenon. As a result, the ink stored in the ink tank T can be consumed without any unused ink.

As apparent from FIGS. 23A and 24, the inner portion of the ink joint 65 is communicated with the inside of the ink storage chamber 75*a* within the manifold 75 closed by the joint side communication tube 69, connection pipe 79, chip-side communication tube 78, connection member 77 on the cover 76, and the cover 76, which are successively coupled to the lower end of the ink joint 65. Then, the ink storage chamber 75*a* within the manifold 75 is connected via the ink supply channel 74*d* of the head chip 74 to the ink exhausting paths 74*c*.

Accordingly, since the ink stored into the ink tank T is supplied to the ink exhausting paths 74*c* of the ink-jet recording head H under such a condition that the ink tank T is mounted on the tank holder F, a printing operation can be done by the ink exhausted from the tip portion (ink exhausting port) of the ink exhausting paths 74*c*.

In the head cartridge K which is constructed by the tank holder F and the ink-jet recording head H in an integral form, the terminal holding portion 571 (see FIG. 19B) of the rear side of the tank holder F is protected by the shutter S (see FIGS. 18, 20, 21). That is to say, normally, the shutter S is mounted at the terminal covering position (namely, refer to solid-line positions of FIGS. 18 and 21) for caving the connection terminal portion 72*a* of the flexible cable 72 held at the terminal holding portion 571 of the outer plane of the holder rear wall 57.

As a result, when the head cartridge K is handled during the mount of the ink tank T, there is no risk that the connection terminal portion 72*a* of the flexible cable 72 is touched by a finger of an operator.

Under condition that the ink tank K has been mounted on the tank holder K of the head cartridge K, the head cartridge K is inserted toward the holder bottom wall supporting plane 32 (see FIG. 9) of the carriage bottom plane of the head carriage C, the tank holder F is guided along one pair of adjoining side walls among the cartridge side walls 27, 29, 29, 29, 28 (see FIGS. 6 and 8).

In this case, the shutter "S" mounted at the terminal covering position (see solid-line positions of FIGS. 18 and 21) for covering the terminal holding portion 571 of the outer surface of the holder rear wall in the tank holder F, is engaged with the upper end of the carriage side wall 27, 28, or 29 of the head carriage C. Accordingly, when the head cartridge K is inserted toward the holder bottom wall supporting plane 32 (see FIG. 9) of the bottom plane of the head carriage C, the shutter S is moved from the terminal covering position (i.e., lower end position of FIGS. 18, 21), until the terminal releasing position (i.e., upper end position of FIGS. 18, 21, dash/dot line position) along the shutter guide groove 62*d*. That is, the shutter S which was positioned as indicated in FIG. 6, is automatically moved to the position indicated in FIG. 7A.

As a result, the connection terminal portion 72*a* of the flexible cable 72 which is normally covered by the shutter S, is automatically released when the head cartridge K is inserted into the head carriage C.

In this case, the guided projections 62*c* and 54*e* (see FIG. 19) provided at the left-side wall 62 and the right-side wall 54 of the tank holder F, are guided, while being engaged with the holder guide groove 27*a*, 28*a*, or 29*a* of the head carriage C.

Then, the holder bottom wall F1 (see FIGS. 21, 24) of the tank holder F reaches the holder bottom wall supporting plane 32 (see FIG. 9) of the carriage bottom. At this time, the ink-jet recording head "H" which is coupled to the outside of the bottom wall for the tank holder F in an integral form, passes through the head through hole 33 (see FIG. 9) of the carriage bottom plane and the head positioning hole 38*a* (see FIG. 11). Then, as apparent from FIGS. 10 and 12, the right-side plane of the head cartridge K is depressed by the depression elastic portion 28*b*, or 29*b* along the horizontal direction (Y1 direction), and the head positioning plane 70*b* is abutted at the positioning end portion 38*b* (see FIG. 11), so that the positioning operation can be achieved along the horizontal direction.

Under this condition, the "L"-shaped pawls 55*a* and 55*c* of the holder bottom wall (see FIGS. 21, 24) are stored into two sets of "L"-shaped pawl storage portions 34 (see FIG. 9) which are provided at the front and rear end portions of the holder bottom wall supporting plane 32.

When the depression member 37 is rotated in an anticlockwise direction in FIG. 6 under such a condition (condition that the holder bottom wall F1 shown in FIGS. 21 and 24 is supported by the carriage bottom plane), the tank holder F is depressed along a direction (i.e., backward direction, or X2-direction) intersecting the insertion direction (downward direction) of the tank holder F by way of the cam plane (depression surface) of the eccentric cam 37*b*. At this time, the tank holder F supported to the carriage bottom plane of the head carriage C, is moved backwardly. During this movement, since the guided projection 56*a* (see FIGS. 6 and 7) of the outer plane of the holder front wall 56 is engaged with the cam groove 37*c* (see FIGS. 6, 8, 9) formed at the cam plane of the depression member 37, this projection is guided by the cam groove 37*c*.

As the cam groove 37*c* is formed so as to guide the projection 56*a* along the left direction (Yl-direction, see FIG. 6) depressed by the depression member 37, the head cartridge K having the tank holder F and the ink jet recording head H is depressed along the left direction during the depression operation, so that the positioning operation along the horizontal direction ca be achieved (namely, the head positioning plane 70*b* is depressed by the positioning edge portion 38*b* shown in FIGS. 11 and 12, and thus, the positioning operation along the horizontal direction can be done).

As a consequence, the tank holder F is depressed to the left rear end position (predetermined position) within a range over which the tank holder can be moved on the head carriage C.

At this time, the connection terminal portion 72*a* of the flexible cable 72 is automatically connected with the carriage-side connection terminal portion 41 positioned in front of the connection board B (see FIG. 16).

As shown in FIG. 13, the above-described held portion (loosen preventing member) 35 of the head carriage C is held by the loosen preventing member 55*c* constructed of the "L"-shaped pawl 55*a* and the holding projection 55*b* of the holder bottom wall F1 (see FIGS. 21 and 22).

Such a condition that the held portion (loosen preventing member) 35 is held by this loosen preventing member 55*c*, namely such a condition that the loosen preventing member 55*c* is engaged with the loosen preventing member 35, corresponds to the holder mounting condition (the tank holder F is mounted to the head carriage C). Under this holder mounting condition, the movement of the tank holder F to the direction opposite to the above-described insertion direction, namely, the upward movement of the head cartridge K is prevented.

As described above, in case that only the ink tank T is replaced under such a condition that the upward movement of the head cartridge K is prevented, if the empty tank T is pulled along the direction (upward) opposite to the insertion direction (downward) to the tank holder F, the upward pulling force is also exerted to the head cartridge K formed with the tank holder F in an integral form, namely the force for removing the head cartridge K from the head carriage C is exerted. However, the tank holder F of the head cartridge K cannot be removed by the held portion (loosen preventing member) 35 of the head carriage C by the loosen preventing member 55*c*.

Consequently, when the handle 82*a* of the ink tank T is pulled up under the above-described holder mounting state, the through hole (joint connection member) 81*b* of the bottom plane of the ink tank T is removed from the small-diameter portion 65*b* of the upper portion of the ink joint 65, while maintaining that the head cartridge K is mounted on the head carriage C. Then, only the ink tank T is pulled up.

As previously explained, after the empty ink tank T has been removed, if a new tank T is inserted toward the holder bottom wall of the tank holder F, the through hole (joint connection member) 81*b* of this new ink tank T is connected to the small- diameter portion 65*b* of the upper portion of the ink joint 65.

To exchange the ink-jet recording head "H", the head cartridge "K" constructed of the ink-jet recording head "H", and the tank holder "F" formed with this ink-jet recording head "H" in an integral form, is replaced.

When the ink-jet recording head is replaced, namely, the head cartridge K is exchanged, if the depression member 37 is rotated along a clockwise direction in FIG. 6, the guided projection 56*a* of the head cartridge K is guided by the cam groove 37*c*, thereby being depressed to the right side (Y2 side) in FIG. 6, and also the backward depression force exerted to the head cartridge K is released.

Under this condition, if the head cartridge K is moved along the forward (X1) direction, the engagement made between the loosen preventing member 55*c* (see FIG. 13) of the outer face of the holder bottom wall for the tank holder F, and the held portion (loosen preventing member) 35 of the bottom plane of the head carriage C is released. Subsequently, the head cartridge K can be freely moved upwardly (i.e., the direction opposite to the insertion direction toward the head carriage C).

Accordingly, when the head cartridge K is pulled up along the upper direction (the direction opposite to the insertion direction of the head carriage C) under this condition, the head cartridge K can be readily removed from the head carriage C. In this case, when the ink tank T has been inserted into the tank holder F of the head cartridge K, and the ink still remains within this ink tank T, this old ink tank T with ink remained may be mounted to a tank holder F of a new cartridge K (namely, a new tank holder "F" coupled with a new ink-jet recording head "H" in an integral form).

Then, the head cartridge K on which the above-explained old ink tank T has been mounted is inserted toward the carriage bottom plane of the head carriage C, so that the new head cartridge K may be mounted on the head carriage C.

Structure of Second Ink-Jet Recording Apparatus

Figure 27:
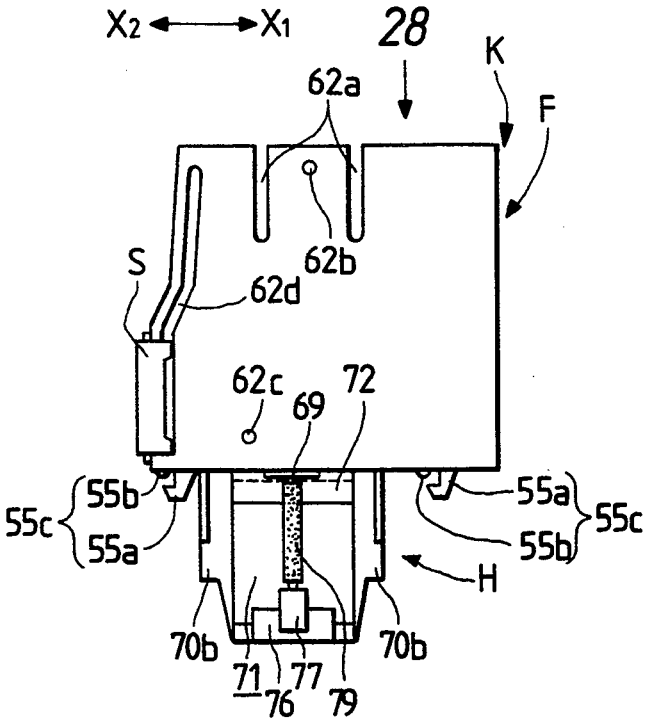
FIG. 27 is a left side view of a head cartridge K (a side view as viewed at a side of the arrow Y1) employed in an ink-jet recording apparatus U according to a preferred embodiment 2 of the present invention.

Referring now FIGS. 27 and 28, an ink-jet recording apparatus U according to a preferred embodiment 2 of the present invention will be explained. FIG. 27 is a view corresponding to FIG. 18 of the above-described preferred embodiment 1, and FIG. 28 is a view corresponding to FIG. 20 of the above-explained preferred embodiment 1 (i.e., a view as viewed from an arrow 28 of FIG. 27).

It should be noted that the same reference numerals of the preferred embodiment 1 will be employed as those for denoting the same constructive elements in the preferred embodiment 1, and detailed explanations thereof are omitted in this preferred embodiment 2.

Figure 28:
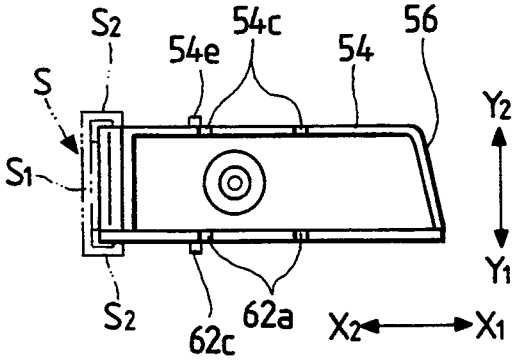
FIG. 28 is a top view (a view as viewed from the arrow 28 of FIG. 27) of the head cartridge K according to the preferred embodiment 2.

As shown in FIGS. 27 and 28, in the ink-jet recording apparatus U of this preferred embodiment 2, the holder front wall 56 of the tank holder F of the head cartridge K is inclined toward the forward direction (X1 direction, in accordance with the leftward direction (Y1 direction). Then, the guided projection 56*a* which was employed in the preferred embodiment 1, is omitted. Similar to the preferred embodiment 1, the cam groove 37*c* of the depression member 37 (not shown) is omitted from the head carriage C.

As to other points, the preferred embodiment 2 is constructed in a similar manner to that of the preferred embodiment 1.

In accordance with this preferred embodiment 2, when the depression member 37 is pivoted in the anti-clockwise direction similar to the preferred embodiment 1, since the holder front wall 56 abutting the cam plane of the depression member 37 is inclined to the forward direction in accordance with the leftward direction thereof, the tank holder F is depressed backwardly along the left direction. As a consequencer the tank holder F is depressed against the right-side rear position (preselected position) within a range over which the tank holder F can be moved on the head carriage C.

Arrangement of Third Ink-Jet Recording Apparatus

With reference to FIG. 29, an ink-jet recording apparatus U according to a preferred embodiment 3 of the present invention will now be described.

It should also be noted that the same reference numerals shown in the preferred embodiment 1 will be employed as those for denoting the same constructive elements of the preferred embodiment 3, and detailed descriptions thereof are omitted.

Although a structure of a shutter S employed in this ink-jet recording apparatus U according to the preferred embodiment 3 is different from that of the preferred embodiment 1, other points thereof are similarly constructed with respect to the preferred embodiment 1.

FIG. 29 is an explanatory diagram of a shutter S of the ink jet recording apparatus U according to a preferred embodiment 3 of the present invention; FIG. 29A is a perspective view thereof; FIG. 29A is a perspective view thereof; FIG. 29B is a bottom view thereof; FIG. 29C is a view a view from an arrow 29C of FIG. 29B; FIG. 29D is a sectional view, taken along a line 29D—29D of FIG. 29B;

In FIG. 29 the shutter S owns a covering plate S1 and one pair of leg plates S2 along the horizontal direction, which are provided at both sides of this covering plate S1, and hold the outer surfaces of the right-side wall 62 and the left-side wall 54 (see FIG. 6) of the tank holder F. Projections are formed on the inner surfaces of the leg plates S2 in order to held the holder side walls 62 and 54. Then, 2 projections are continuously formed on the leg portions S2 for holding the holder left-side wall 62. These two continuous projections are guided in engagement of the shutter guide groove (see FIG. 6).

Arrangement of Fourth Ink-Jet Recording Apparatus

Referring now to FIGS. 30 to 54, an ink-jet recording apparatus according to a preferred embodiment 4 of the present invention will be explained.

It should be understood that although the ink-jet recording apparatus U and the head carriage C according to this preferred embodiment 4 have different structures from those of the preferred embodiment 1, the same reference numerals of "U" and "C" will be employed for these ink-jet recording apparatus "U" and the head carriage C.

It should also be understood that in the following descriptions of the ink-jet recording apparatus according to the preferred embodiment 4 of the present invention, an expression "forward" or "front side" implies a direction X1 (see FIG. 30) of a front side of the ink-jet recording apparatus U, which is similar to the preferred embodiment 1. An expression "backward" or "back side" implies a direction X2 (see FIG. 30) of the rear side of the ink-jet recording apparatus U. Similarly, an expression "leftward" or "left side" implies a direction Y1 (see FIG. 32) of the front side thereof. Furthermore, an expression "rightward" or "right side" implies a direction Y2 (see FIG. 32) of a right side of the ink-jet recording apparatus U, as viewed from the front side.

Figure 30A:
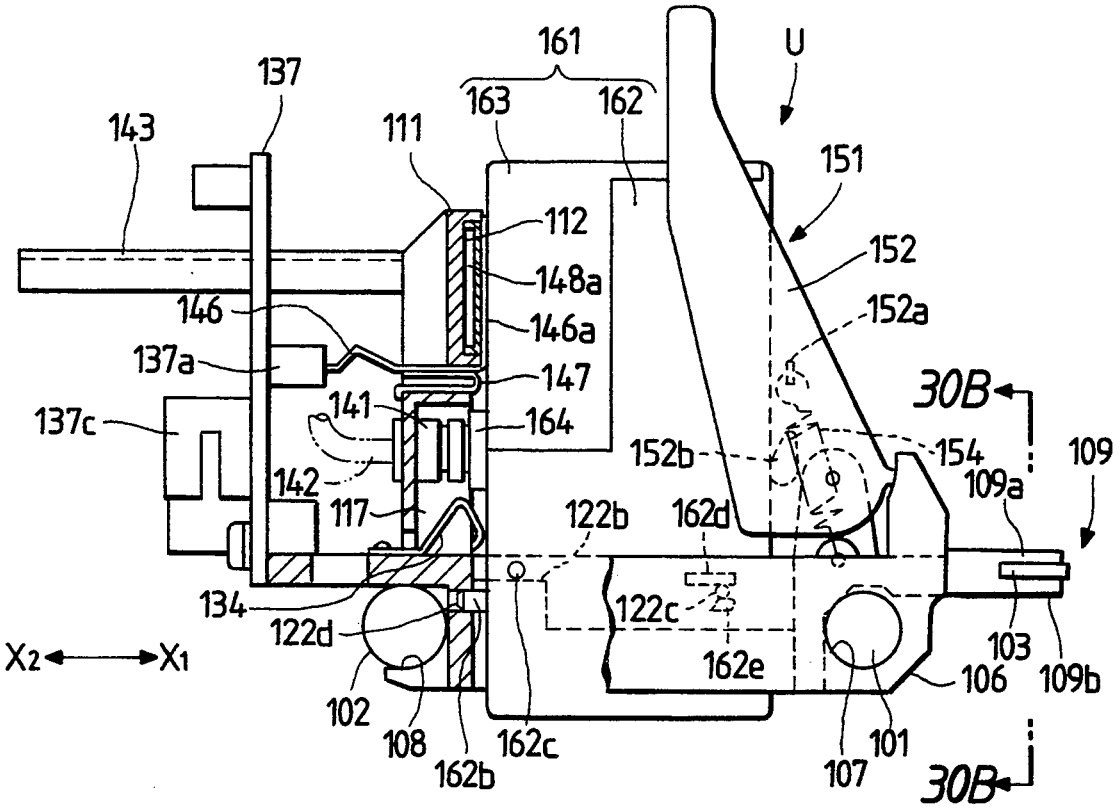
FIG. 30A is an explanatory diagram of a major portion of an ink-jet recording apparatus according to a preferred embodiment 4 of the present invention, the figure is a view for representing such a condition that a black color head cartridge K1 and a color head cartridge K2 (only cartridge K2 is not shown) are mounted on the head carriage C' reciprocated along the horizontal direction (i.e., a direction perpendicular to a paper surface, Y1-Y2 direction of FIG. 32) in a similar manner to that of the preferred embodiment 1.
Figure 30B:
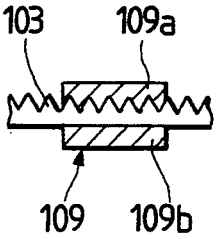
FIG. 30B is a sectional view, taken along a line 30B—30B in FIG. 30A.
Figure 31:
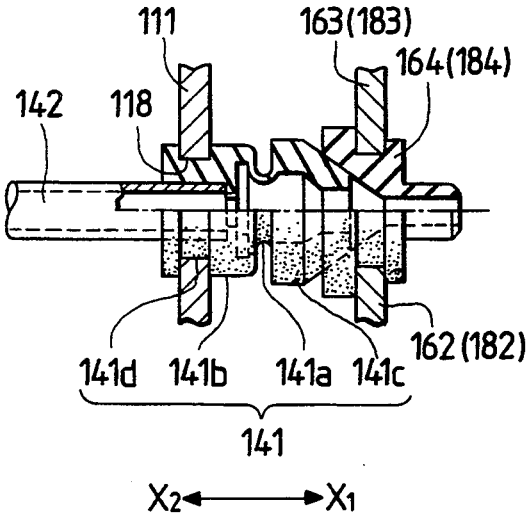
FIG. 31 is a detailed explanatory diagram of an ink supplying connection unit for the above-described head carriage C and the head cartridge K1 or K2 of the preferred embodiment 4.
Figure 32:
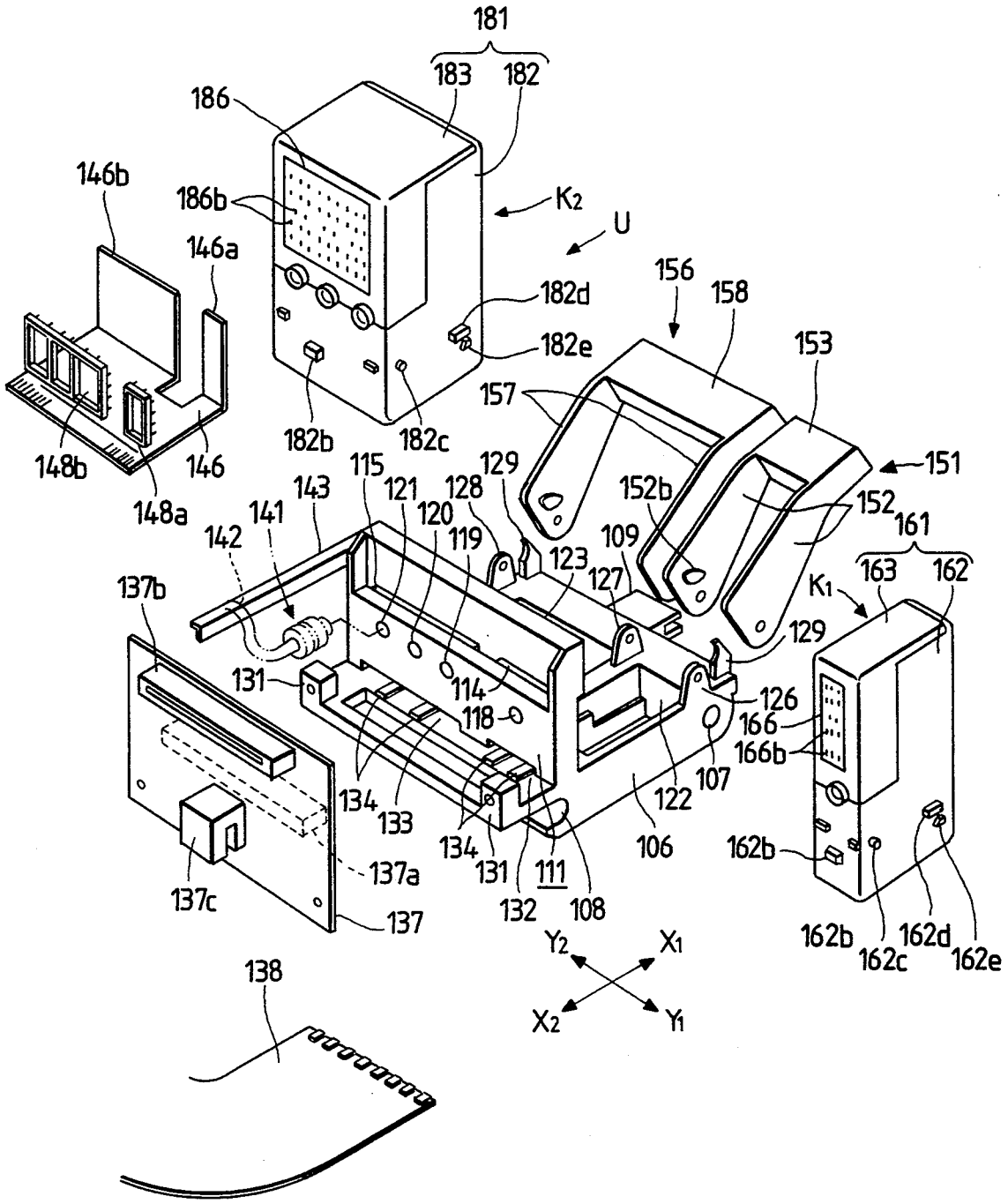
FIG. 32 is an exploded perspective view of the head carriage according to the preferred embodiment 4, and a view for showing the block color head cartridge K1 and the color head cartridge K2 mounted to the head carriage C.

FIG. 30 is an explanatory diagram of a major portion of an ink-jet recording apparatus according to a preferred embodiment 4 of the present invention. FIG. 30A is a view for representing such a condition that a black color head cartridge K1 and a color head cartridge K2 (only cartridge K2 is not shown) are mounted on the head carriage C reciprocated along the horizontal direction (i.e., a direction perpendicular to a paper surface, Y1-Y2 direction of FIG. 32) in a similar manner to that of the preferred embodiment, and FIG. 30B is a sectional view, taken along a line 30B—30B. FIG. 31 is a detail explanatory diagram of an ink supplying connection unit for the above-described head carriage C and the head cartridge K1 or K2 of the preferred embodiment 4. FIG. 32 is an exploded perspective view of the head carriage according to the preferred embodiment 4, and a view for showing the block color head cartridge K1 and the color head cartridge K2 mounted to the head carriage C.

FIGS. 33 to 36 are explanatory diagrams of a single body of the head cartridge C.

Figure 33:
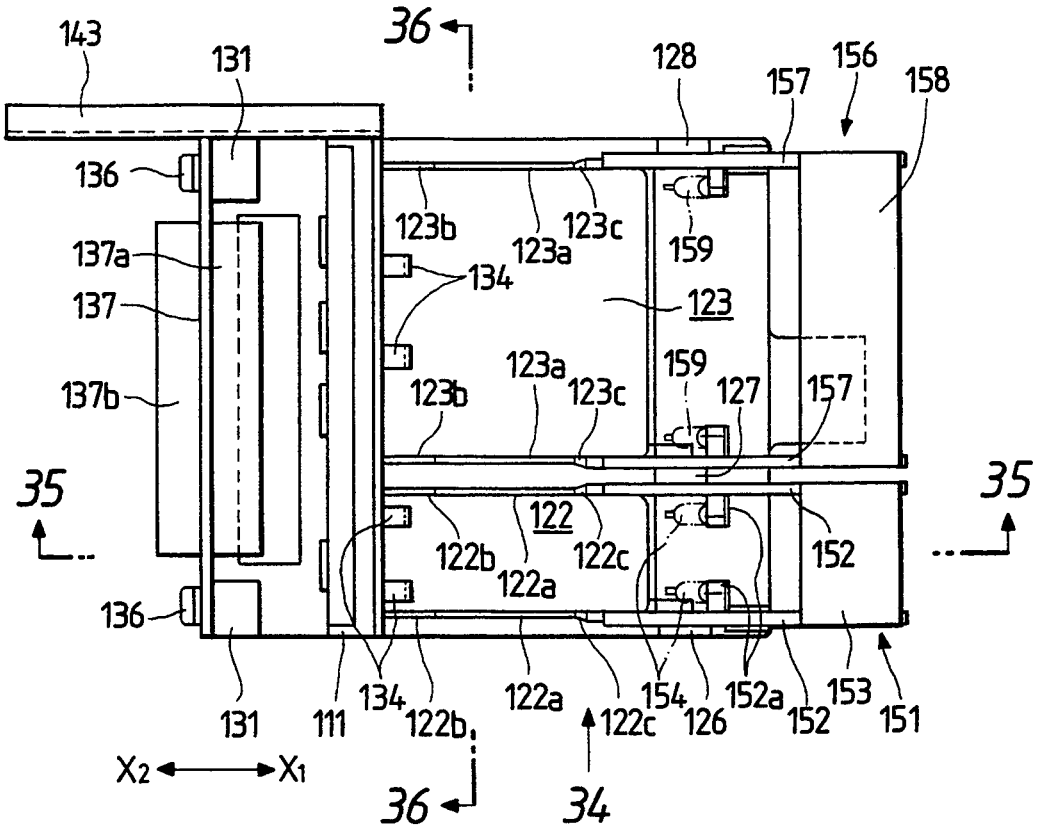
FIG. 33 is a plan view of a single body of the head carriage C.

FIG. 33 is a plane view of this single body of the head carriage C.

Figure 34:
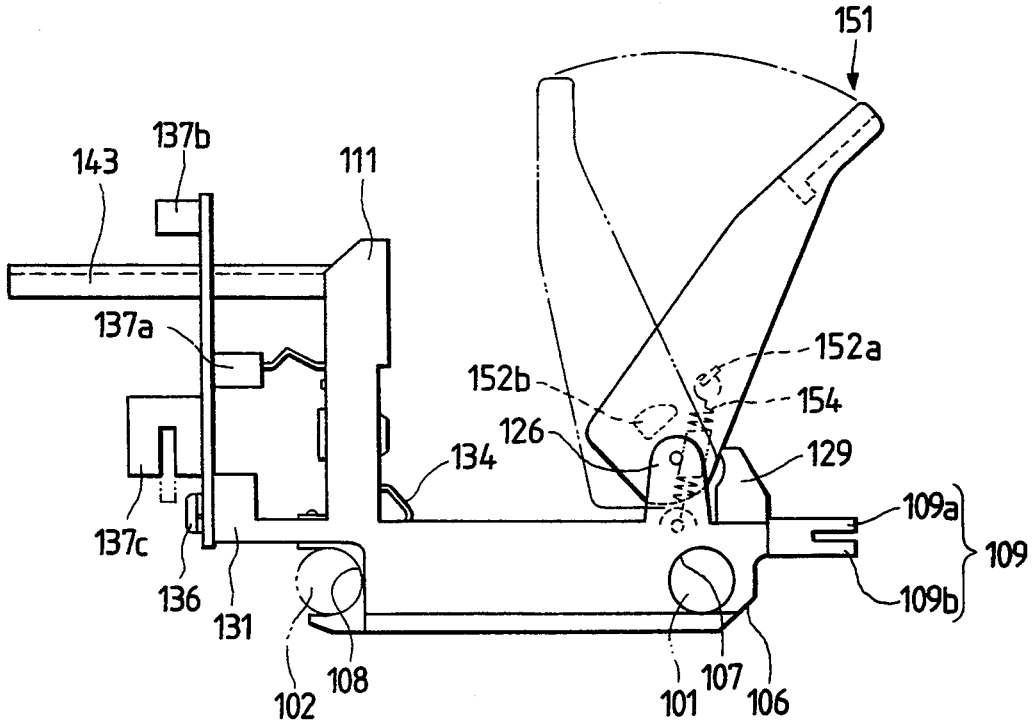
FIG. 34 is a view as viewed from an arrow 34 of FIG. 33.

FIG. 34 is a view as viewed from an arrow 34 of FIG. 33.

Figure 35:
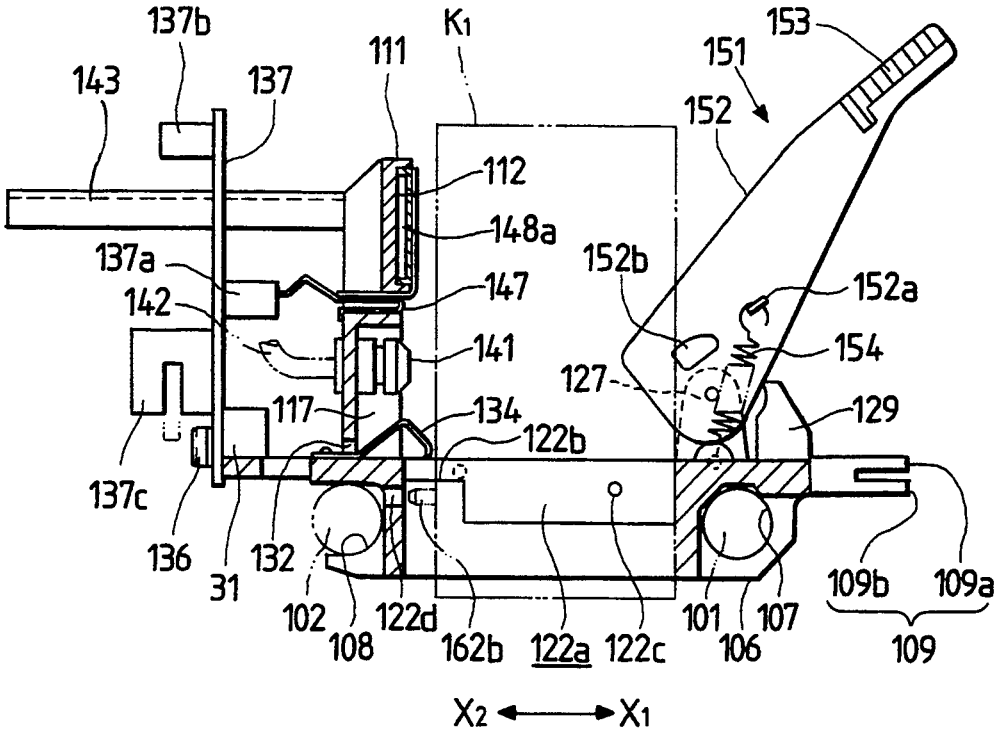
FIG. 35 is a sectional view of the head carriage C, taken along a line 36—36 of FIG. 36.
Figure 36:
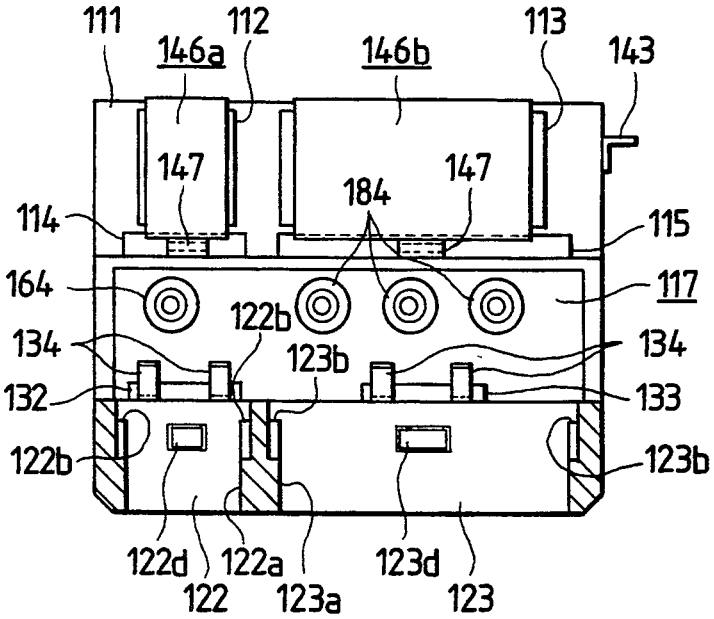

FIG. 35 is a sectional view of the head carriage C, taken along an arrow 35—35 of FIG. 33. FIG. 36 is a sectional view of the head carriage C, taken along a line 36—36 of FIG. 36.

In FIGS. 30A and 30B, the ink-jet recording apparatus U has a front side guide shaft 101 and a rear side guide shaft 102, which are separated from each other at an interval along the front and rear directions (namely, X1-X2 direction), and extended along the left and right direction (Y1-Y2 direction). The ink- jet recording apparatus U has an endless drive belt 103 for reciprocating the head carriage C along one pair of guide shafts 101 and 102. A convex and concave groove is formed in the outer side surface of this drive belt 103.

As represented in FIG. 32 to 36, the head carriage C has a carriage main body 106 having a substantially rectangular shape, as viewed in a plan view (see FIGS. 32 and 33). A guide shaft through hole 107 is formed in the front side lower portion (lower side of arrow Xl-side in FIG. 32) of this carriage main body 106, whereas a guide shaft engaging groove 108 is formed in the rear-side lower portion (lower portion of arrow X2-side in FIG. 32). Then, both of the guide shaft through hole 107 and the guide shaft engaging groove 108 are slidably fitted to the front-side guide shaft 101 and the rear-side guide shaft 102 shown in FIG. 30A.

As seen from FIGS. 30A, 30B and 30, there is provided a belt coupling member 109 at a central portion of the carriage main body 106 at the front edge side along the left/right (horizontal) direction. This belt coupling member 109 owns an upper side holding member 109*a* and a lower side holding member 109*b* for holding the drive belt 103 from the vertical direction. A concave/convex is formed in the lower surface of the upper side holding member 109*a*, which is engaged with the concave/convex of the outer side surface of the drive belt 103.

The coupling between the belt coupling member 109 and the drive belt 103 is performed by inserting the drive belt 103 into a space defined among the front side of the belt coupling member 109, the upper side holding member 109*a*, and the lower side holding member 109*b*, and by engaging the concave/convex of the drive belt 103 with the concave/convex formed in the lower surface of the upper side holding member 109*a*.

When the drive belt 103 is reciprocated by way of a drive motor (not shown) and a transmission mechanism under such a condition that the drive belt 103 is coupled with the belt coupling member 109, the head carriage C is reciprocated along one pair of guide shafts 101 and 102 in the left/right direction (Y1-Y2 direction).

Such a structure for reciprocating the head carriage along the guide shafts by the drive belt may be realized by way of the conventional technique.

In FIGS. 30A, 35, 26, a carriage rear wall 111 is formed on the rear upper surface of the carriage main body 106 in such a manner that this carriage rear wall is extended upwardly. In the carriage rear wall 111, a black-color flexible cable connection portion storage concave 112 is formed in the upper left-side portion thereof at the front surface (portion of Y1 side), and a color flexible cable storage concave 113 is formed in the right side portion (portion of Y2 side). Also in the carriage rear wall 111, a black-color flexible cable through hole 114 is fabricated in the lower side of the black-color flexible cable connection portion storage concave 112, whereas a color flexible cable through hole 115 is formed in the lower side of the color flexible cable storage concave portion 113. Furthermore, in the carriage rear wall 111, an ink supplying connection member storage concave 117 is formed in the front surface (surface at the X1 side) of the lower portion thereof.

In the ink supplying connection member storage concave 117, a black ink supplying connection member mounting hole 118 (see FIGS. 31 and 32) is formed at the lower position of the black-color flexible cable connection portion storage concave 112, and three color ink supplying connection member mounting holes 119, 120 and 121 (see FIG. 32) are formed at the lower position of the color flexible cable storage concave 113.

As shown in FIGS. 32 and 33, in the carriage main body 106, a black cartridge mounting hole 122 is formed at the left-side portion (portion of Y1-side) of the carriage rear wall 111 at the front side thereof, and a color cartridge mounting hole 123 is formed at the right-side portion (portion of Y2-side).

When the black-color head cartridge K1 is inserted into the black-color cartridge mounting hole 122, an insertion guide wall 122*a* for guiding this black-color head cartridge K1, is formed in the inner plane of this mounting hole 122. An insertion guide wall 123*a* is formed in the inner plane of the color cartridge mounting hole 123 when the color head cartridge K2 is inserted and guided by this insertion guide wall 123*a*.

In both of the left/right inside surfaces (namely, insertion guide wall 122*a*) of the black-color cartridge mounting hole 122, a cartridge supporting plane 122*b* (see FIGS. 30A, 33, 35 and 36) as the head supporting member mounting unit is provided at the rear-side portion thereof, and a cartridge supporting projection 122*c* (see FIGS. 30A, 33, 35) is formed at the front-side portion thereof. As apparent from FIG. 33, the widths of the left/right inside surfaces of the black-color cartridge mounting hole 122 are made narrower than that of the cartridge supporting projection 122*c*. This wider width portion of the right/left inside planes of this black-color cartridge mounting hole 122, is provided in order that a member projected sidewardly can be easily inserted into the black-color cartridge mounting hole 122 when the black- color head cartridge K1 is inserted therein, thereby performing the positioning operation of the black-color cartridge K1 along the left/right direction.

An unloosen preventing member stopping hole 122*d* (refer to FIG. 35 and 36) functioning as a loosen preventing member is provided at the rear surface of the black color cartridge mounting hole 122.

On the left/right inside surfaces (namely, insert guide wall 123*a* ) of the color cartridge mounting hole 123, there are provided a cartridge supporting plane 123*b* (see FIGS. 33, 36) and a cartridge supporting projection 123*c* (see FIG. 33). Also, an unloosen preventing member stopping hole 123*d* (see FIG. 36) as a loosen preventing member is formed at the rear surface of the color cartridge mounting hole 123.

Depression lever supporting members 126, 127 and 128 (see FIG. 33) are formed on the front upper surface of the carriage main body 106 in such a manner that these lever supporting members are projected upwardly. The depression lever supporting member 126 is arranged at a left end of the carriage main body 106, the depression lever supporting member 127 is positioned at a boundary portion between the black-color cartridge mounting hole 122 and the color cartridge mounting hole 123, and the depression lever supporting member 128.

Stoppers 129 are arranged on the front upper surface of the carriage main body 106, depending upon the above-described three depression lever supporting members 126, 127 and 128.

As shown in FIG. 32, the carriage main body 106 is extended from the carriage rear wall 111 backwardly, and one pair of board connection portions 131 and 131 are provided at the rear end thereof. One pair of board connection positions 131, 131 correspond to portions where a connection board is fixed by a screw.

As represented in FIGS. 32, 35, 36, leaf spring through holes 132, 133 are formed at the carriage rear wall 111 of the carriage main body 106.

The carriage main body 106 is constructed of the above-described elements indicated by reference numerals 107 to 131.

As indicated in FIGS. 32, 35 and 36, a leaf spring 134 passes through the leaf spring through holes 132, 133 of the carriage rear wall 111 of the carriage main body 106, and a rear end portion thereof is fixed to the carriage main body 106 by, for instance, a screw (see FIG. 35). Then, when the head cartridge K1, or K2 is inserted into the cartridge mounting hole 122, or 123, the front end portion of the leaf spring 134 is formed in such a way that the head cartridge is depressed forwardly.

In FIGS. 33, 34 and 35, a connection board 137 is fixed to the board connection portions 131, 131 of the carriage main body 106 by screws 136, 136. At a center portion of the front surface of the connection board 137 along the vertical direction, a front side connector 137*a* is provided which extends along the horizontal direction, whereas a rear side connector 137*b* is provided at the upper rear surface of the connection board 137, which extends along the horizontal direction. The front side connector 137*a* is a connector to which a flexible cable (will be discussed later) is connected, and the rear side connector 137*b* is a connector to which a cable 138 (see FIG. 32) is connected. The first-mentioned flexible cable is connected to the head cartridges K1 and K2, and the last-mentioned cable is connected to a main board (not shown).

A position detecting photosensor 137*c* is provided at the lower rear surface of the connection board 137. This photosensor 137*c* is constructed of a light emitting element and a light receiving element which are arranged with sandwiching a slit. When the head carriage C is moved to a predetermined position, this position is detected by a light shield plate upon which light is incident via the slit.

On the black-color ink supplying connection member mounting hole 118 (see FIG. 32) and the color ink supplying connection member mounting holes 119,120,121 formed in the ink supplying connection member storage concave 117 (see FIG. 30A) of the carriage rear wall 111, a cylindrical-shaped ink supplying joint connection member 141 (see FIGS. 30A, 31, 32) is mounted respectively. This joint connection member 141 is connected with a cap-shaped ink joint to realize a function to supply ink to the ink joint.

In FIG. 31, there is shown a joint connection member 141 mounted on the black-color ink supplying connection member mounting hole 118. A joint connection member has a similar structure to that of this joint connection member 141, which is mounted on the color ink supplying connection member mounting holes 119, 120 and 121.

In FIG. 31, the cylindrical ink supplying join connection member is constructed of an elastic member of a synthetic resin. An elastic characteristic applying portion 141*a* having a thin thickness is provided at an intermediate portion of this joint connection member along the forward/backward direction, by which displacement of the front side portion is possible. An elastic characteristic applying portion 141*a* having a thin thickness is provided at an intermediate portion of this joint connection member along the forward/backward direction, by which displacement of the front side portion is possible. An concave groove is formed around the outer peripheral surface of the elastic characteristic applying portion 141*a*, and a thickness of the side wall thereof is made thin. The ink supplying joint connection member 141 owns the elastic characteristic applying portion 141*a*, a fixing portion 141*b* at a rear side thereof, and the cartridge connection portion 141*c*. At the outside surface of the fixing portion 141*b*, a concave groove 141*d* fitted to the block-color ink supplying connection member mounting hole 118, is formed. Since the concave groove 141*d* is fitted into the black- color ink supplying connection member mounting hole 118, the joint connection member 141 is fixed to the carriage rear wall 111.

A shape of the front-end outer surface of the cartridge connection portion 141*c* of the joint connection member 141 is formed as a conical taper plane, which is automatically connected to the cap-shaped ink joint when this taper plane is depressed to the cap-shaped ink joint having the head cartridges K1 and K2 (will be discussed later more in detail).

Into an inner hole of the cylindrical joint connection member 141, one end portion of a flexible ink supply tube 142 is inserted from the rear end side of the fixing portion 141b. The other end portion of this ink supply tube 142 is connected to an ink tank (not shown) fixed to a proper position of the ink-jet recording apparatus U.

As represented in FIG. 32, a cable supporting lever 143 having an "L"-shaped sectional view is fixed on the upper right end portion of the carriage rear wall 111. This cable supporting lever 143 horizontally extends backwardly so as to support the cable 138 and the ink supply tube 142. That is, the cable supporting lever 143 owns such a function to support both of the cable 138 and the ink supply tube 142 when the head carriage C is driven along the left/right direction in order that these cable 138 and the ink supply tube 142 do not hang down (namely, a function to maintain both of the cable 138 and the ink supply tube 142 at a predetermined height at the right end position of the head carriage C).

As apparent from FIGS. 30A and 32, the rear end of the flexible cable 146 is connected to the front side connector 137a of the connection board 137. Also as obvious from FIG. 32, the front end portion of this flexible cable 146 is subdivided into a black-color connection terminal portion 146 and a color connection terminal portion 146b. These black-color connection terminal portion 146a and the color connection terminal portion 146b pass through the black color flexible cable through hole 114 and the color flexible cable through hole 115 of the carriage rear wall 111, and then stored into the black-color flexible cable connection portion storage concave 112 and the color flexible cable storage concave 113 (see FIG. 36).

An inverted C-shaped spring 147 (see FIGS. 30A and 36) for fixing the flexible cable 146 is inserted into the black-color flexible cable through hole 114 and the color flexible cable through hole 115.

In FIGS. 30A and 32, elastic sheets (namely, elastic members) 148a and 148b are arranged among the black-color connection terminal portion 146a, the color connection terminal portion 146b, and the carriage rear wall 111 in both of the black-color flexible cable connection portion storage concave 112 and the color flexible cable storage concave 113. In the elastic sheets 148a and 148b, small hardened projection portions (see FIG. 32) are formed, corresponding to a plurality of terminal positions which have been provided at the respective connection terminal portions 146a and 146b. Then, the elastic sheets 148a and 148b are constructed in such a manner that the entire elastic sheet portion can be elastically compressed along the vertical direction to the sheet plane.

The connection terminal portions 146a and 146b are held at outwardly projected positions by the elastic sheets 148a and 148b. When an external depression force is applied to these connection terminal portions 146a and 146b, these portions are deformed inwardly. A plurality of connection terminal portions 146a and 146b are maintained at the outwardly projected positions by these harden projection portions. As a consequence, a plurality of connection terminal portions 146a and 146b are continuously projected outwardly, so that good electric contacts can be maintained among the plural connection terminal portions 146a, 146b, and the plural cartridge-side connection terminal portions (will be discussed later) provided at the rear surfaces of the head cartridges K1 and K2.

The black-color cartridge depression lever (namely, depression member) 151 is rotatably supported by the above-explained depression lever supporting members 126, 127 (see FIG. 32). The black cartridge depression lever 151 has one pair of left/right arms 152, 152, whose lower end portions are rotatably supported by the depression lever supporting members 126, 127, and also an arm coupling member 153 for coupling the upper end portions of one pair of left/right arms with each other. There are provided a tension spring stopping portion 152a and a depression cam forming projection portion 152b at inner planes of one pair of arms 152.

The depression cam forming projection portion 152b has a cam plane for depressing the black-color cartridge K1 toward the rear side (X2-direction) when the black-color cartridge depression level 151 is pivoted in an counterclockwise direction under such a condition that the black-color head cartridge K1 is mounted into the black-color cartridge mounting hole 122.

As seen from FIGS. 33 and 35, a tension spring 154 is provided between the tension spring stopping portion 152a and the upper plane of the carriage main body 106. Under the condition shown in FIG. 35, a line of action with respect to the tension spring 154 (line for connecting an action point of the tension spring 154 with respect to the carriage main body 106 with an action point with regard to the arm 152), is present at a front side of a rotation center of the arm 152. Under such a condition, the tension spring 114 exerts a force to rotate the black-color cartridge depression lever 151 in a clockwise direction. Then, the black-color cartridge lever 151 is held at the cartridge release position abutting against the stopper 129 by means of the tension spring 154.

If the black-color cartridge depression lever 151 is pivoted along the counterclockwise direction and thereafter exceeds a dead point (namely, if the line of action for the tension spring 154 is moved from the front side of the rotation center of the arm 152 to the rear side), the tension spring 154 exerts such a force to rotate the black-color cartridge depression lower 151 along the counterclockwise direction. Under this condition, the black- color cartridge depression lever 151 is held at a cartridge depression position (will be discussed later) by the tension spring 154.

As apparent from FIG. 33, the color cartridge depression lever 156 is rotatably supported by the depression lever supporting members 127, 128. The color cartridge depression lever 156 has one pair of left/right arms 157, 157 whose lower end portions are rotatable supported by the depression lever supporting members 127,128, and further an arm coupling member 158 for coupling the upper end portions of one pair of left/right arms with each other. Then, this color cartridge depression lever 156 is constructed in a similar manner to that of the above-explained black-color cartridge depression lever 151, and a tension spring stopping portion and also a depression cam forming projection portion are formed on the inner planes of one pair of arms 157.

Then, a tension spring 159 is provided between the tension spring stopping portion of the arm 157 and the upper surface of the carriage main body 106. This tension spring 159 has a similar function to that of the tension spring 154.

The head carriage C is constructed of the elements indicated by reference numerals 106 to 159.

Structure of Black-Color Head Cartridge K1

Referring now to FIGS. 37 to 47, a description will be made of the above-explained black-color head cartridge K1.

Figure 37:
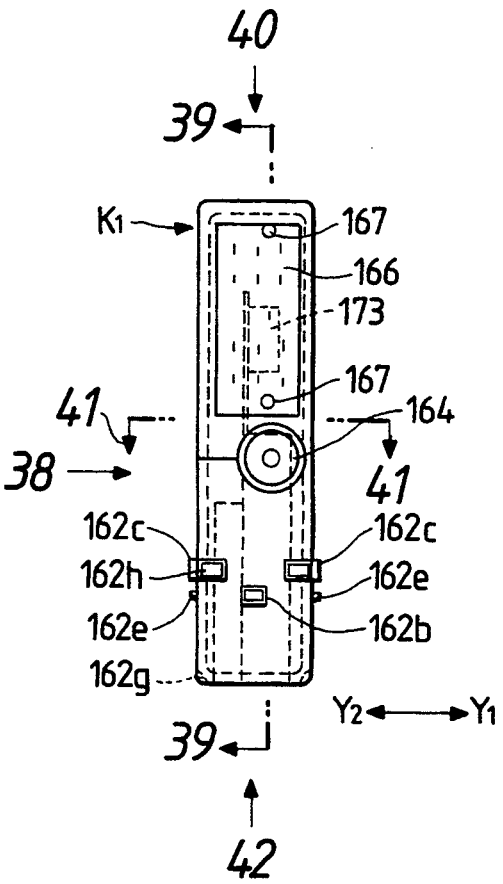
FIG. 37 is a rear view of the black color head cartridge used in the preferred embodiment 4.
Figure 38:
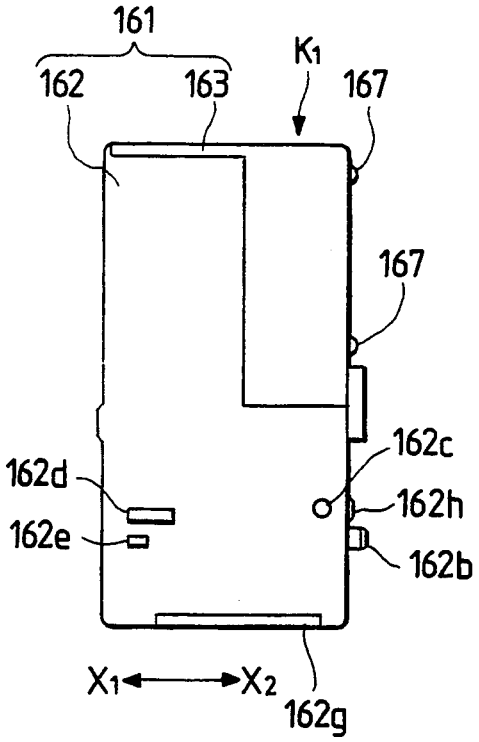
FIG. 38 is a right side view (a view, as viewed from an arrow 38 of FIG. 37) of the black color head cartridge K1 according to the preferred embodiment 4.
Figure 39:
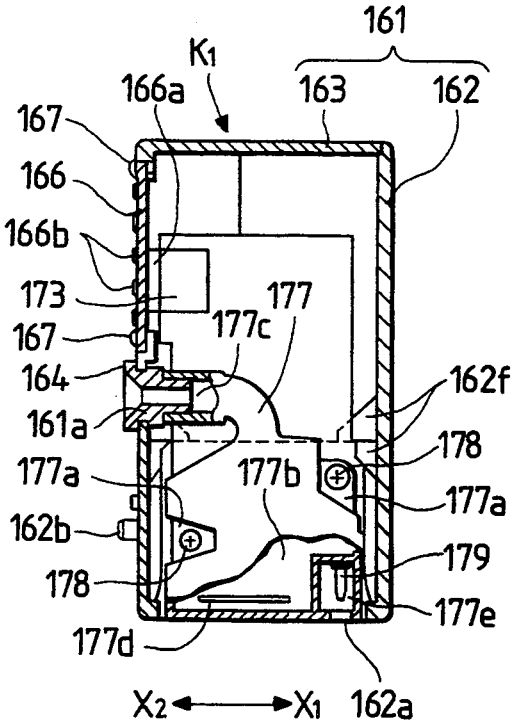
FIG. 39 is left-side sectional view (sectional view taken along line 39—39 of FIG. 37) of the black color head cartridge K1 according to the preferred embodiment 4.
Figure 40:
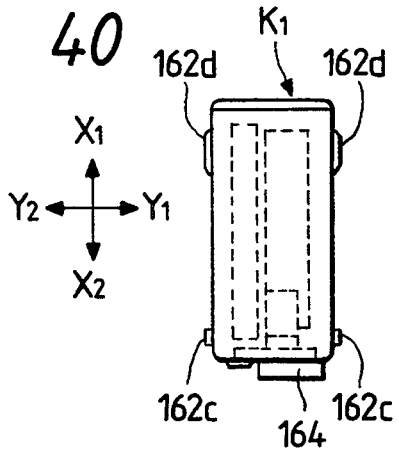
FIG. 40 is a top view of the black color head cartridge K1 according to the preferred embodiment 4, namely a view as viewed from an arrow 40 of FIG. 37.
Figure 41:
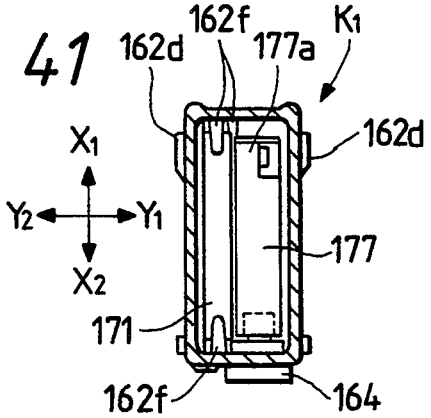
FIG. 41 is an upper sectional view of the black color head cartridge k1 according to the preferred embodiment 4, namely a sectional view of the black color head cartridge K1, taken along a line 41—41 of FIG. 37.
Figure 42:
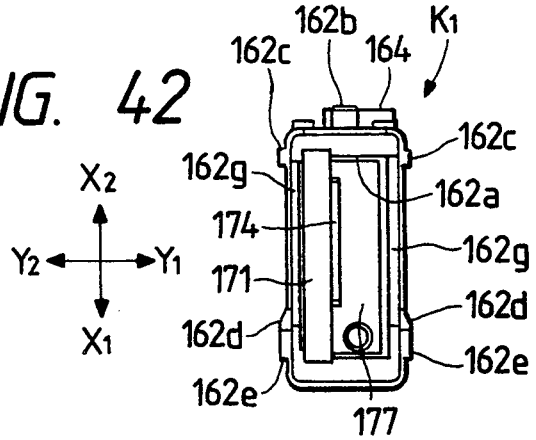
FIG. 42 is a bottom view of the black color head cartridge K1 according to the preferred embodiment 4, a view as shown from an arrow 42 of FIG. 37.
Figure 43:
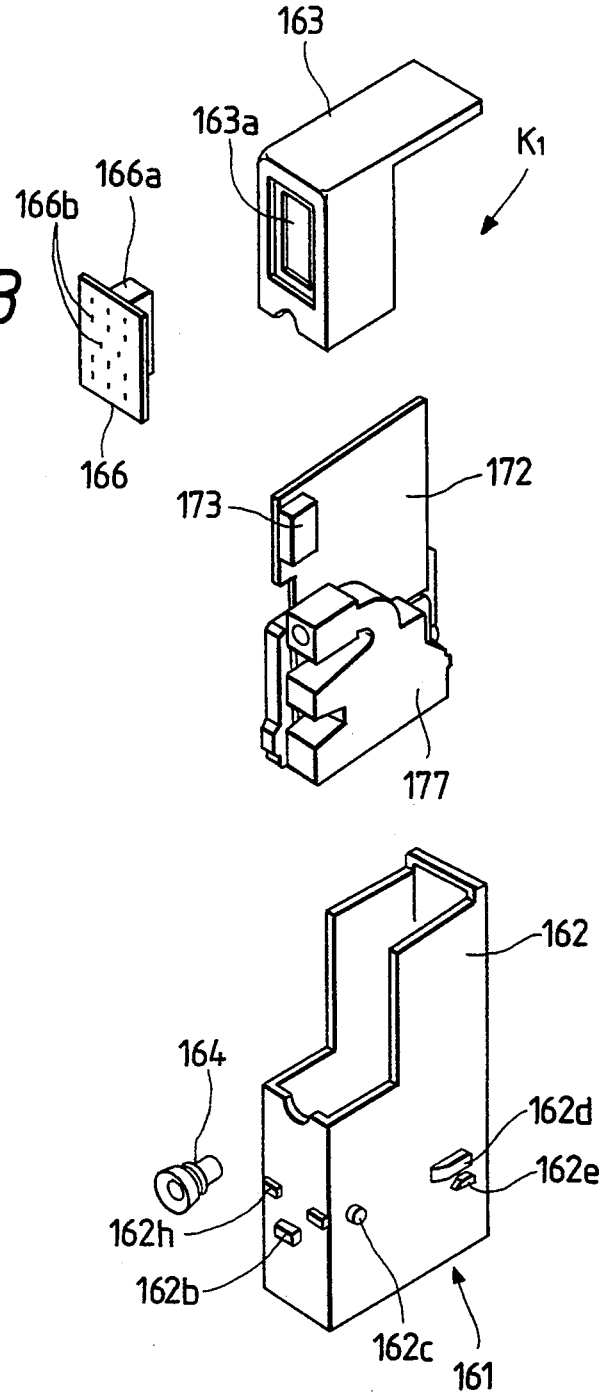
FIG. 43 is an exploded perspective view of the black color head cartridge k1 according to the preferred embodiment 4.
Figure 44:
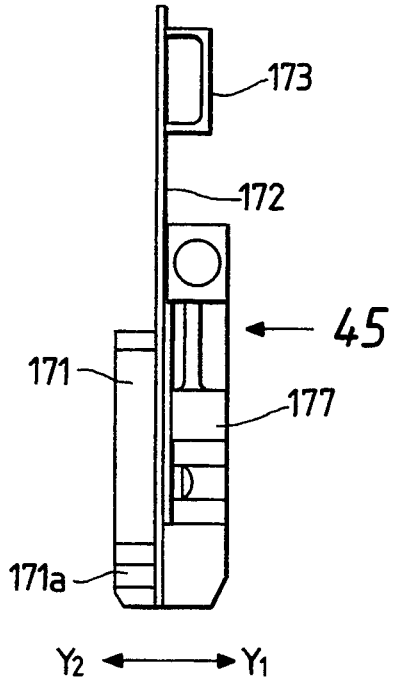
FIG. 44 is a rear view of a main body "H" of an ink-jet recording head stored into a case of the black color head cartridge K1 according to the preferred embodiment 4.
Figure 45:
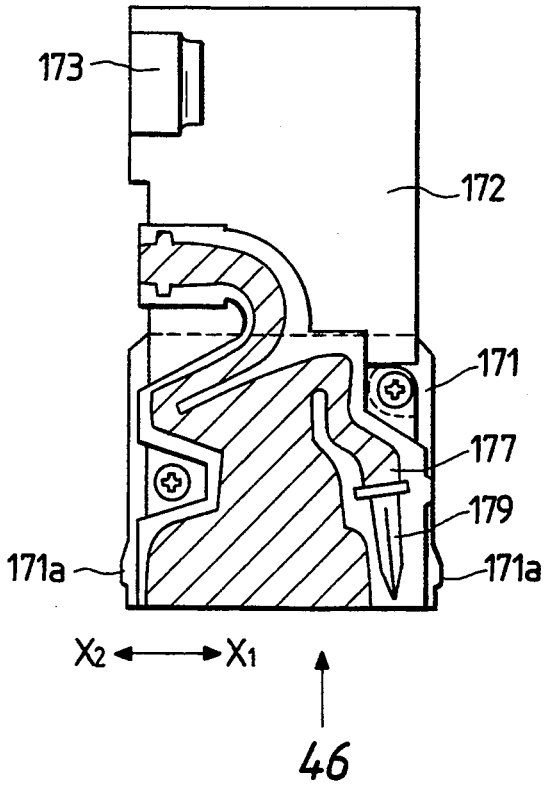
FIG. 45 is a left side view of the main body of the ink-jet recording head shown in FIG. 44, namely a view of the head main body as viewed from an arrow 45 of FIG. 44.
Figure 46:
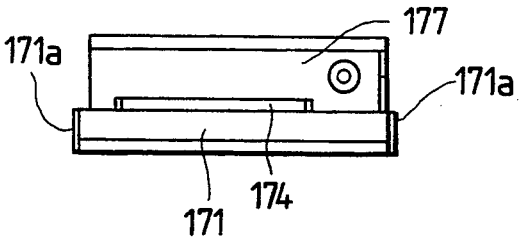
FIG. 46 is a bottom view of the main body of the ink-jet recording head shown in FIG. 44, namely a view of the head body as viewed from an arrow 46 of FIG. 45.

FIG. 37 is a rear view of the black color head cartridge. FIG. 38 is a right side view (a view, as viewed from an arrow 38 of FIG. 37) of the black color head cartridge K1. FIG. 39 is a left-side sectional view (sectional view taken along line 39—39 of FIG. 37) of the black color head cartridge K1. FIG. 40 is a top view of the black color head cartridge K1, namely a view as viewed from an arrow 40 of FIG. 37. FIG. 41 is an upper sectional view of the black color head cartridge K1, namely a sectional view of the black color head cartridge K1, taken along a line 41—41 of FIG. 37. FIG. 42 is a bottom view of the black color head cartridge K1, a view as shown from an arrow 42 of FIG. 37. FIG. 43 is an exploded perspective view of the black color head cartridge K1. FIG. 44 is a rear view of a main body "H" of an ink-jet recording head stored into a case of the black color head cartridge K1. FIG. 45 is a left side view of the main body of the ink-jet recording head shown in FIG. 44, namely a view of the head main body as viewed from an arrow 45 of FIG. 44. FIG. 46 is a bottom view of the main body of the ink-jet recording head shown in FIG. 44 (namely, a view of the head body as viewed from an arrow 46 of FIG. 45).

Figure 47A:
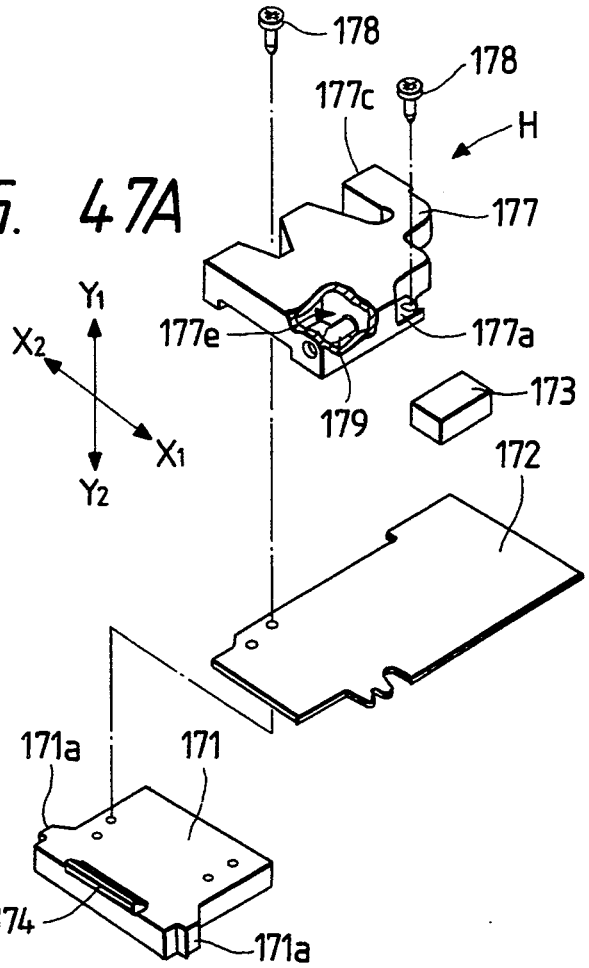
FIGS. 47A to 47D are detailed explanatory diagrams of the main body of the ink-jet recording head shown in FIG. 44.
Figure 47B:
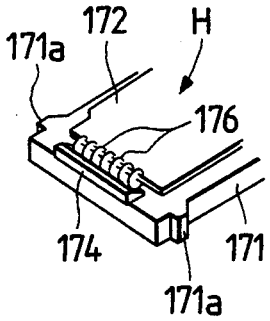

FIG. 47 is a detailed explanatory diagram of the main body of the ink-jet recording head shown in FIG. 44, FIG. 47A is an exploded perspective view of the main body "H" of the above-described ink-jet recording head, FIG. 47B is a detailed explanatory diagram of a major portion of the main body "H" of the ink-jet recording head.

As shown in FIG. 43, the black-color head cartridge K1 is equipped with a black-color cartridge case (namely, head supporting member) 16 for supporting the ink-jet recording head main body "H". This black-color cartridge case 161 is constructed of a black-color cartridge lower case 162 and a black-color cartridge upper case 163.

A head insertion hole 162*a* (refer to FIGS. 39, 42) used to insert the ink-jet recording head main body "H" (will be discussed later) is formed in the lower surface of the black-color cartridge lower case 162. An unloosen preventing projection (namely, unloosen preventing member) 162*b* is formed at the lower rear surface. This unloosen preventing projection 162*b* has such a shape to be fitted to the above-explained unloosen preventing member stopping hole 122*d* (see FIG. 30A) which is formed at the rear surface of the black-color cartridge mounting hole 122.

On the left/right side surfaces of the lower portion of the black-color cartridge lower case 162, supported projections 162*c* (see FIGS. 37, 38, 40, 43) are provided at the front portion. This unsupported projection 162*c* is such a member supported by the cartridge supporting plane 122*b* (see FIGS. 30A, 33, 35 and 36) formed on both side surfaces of the black-color cartridge mounting hole 122 (see FIG. 33).

Also, on both of the right/left side planes of the lower portion of the black-color cartridge lower case 162, a supported ridge 162*d* and a holding ridge 162*e* (see FIGS. 38 and 43) are provided at the rear portion. The supported ridge 162*d* is such a member supported by cartridge supporting projections 122*c* (see FIGS. 30A, 33, 35) which are formed on both of the left/right side surfaces of the black-color cartridge mounting hole 122.

An outer circumference of the supported ridge 162*d* is formed in order to perform the positioning operation along the left/right (horizontal) direction. In other words, when the black-color head cartridge K1 is mounted to the black-color cartridge mounting hole 122, the supported ridge 162*d* is inserted into the wide width portion of the black-color cartridge mounting hole 122 (see FIG. 33) at the left/right inside surfaces, the width of which is wider than that of the cartridge supporting projection 122*c*. Thereafter, when the black-color head cartridge k1 is depressed backwardly, the supported ridge 162*d* is moved to the narrow width portions of the left-right inner surfaces of the black-color cartridge mounting hole 122 (see FIG. 33). Thus, both of the right/left edge portions of the supported ridge, 62*d* are positioned along the left/right (horizontal) direction by the narrow width portion (i.e., rear side portion rather than the cartridge supporting projection 122*c*) of the insertion guide wall 122*a* (see FIG. 33).

The holding ridge 162*e* corresponds to a member for holding the cartridge supporting projection 122*c* between this holding ridge 162*e* and the above supported ridge 162*d*. Since this holding ridge 162*e* is stopped by the cartridge supporting ridge 122*c* (see FIG. 30A) when the black-color head cartridge K1 mounted on the head carriage C is depressed upwardly by the capping unit, or pulled up by a manual operation, this holding ridge has a function as the unloosen preventing member.

Inside the black-color cartridge lower case 162, there is provided a rib 162*f* (see FIG. 39 and 41) for fixing the ink-jet recording head main body "H" (will be explained later) to a predetermined position when this ink-jet recording from the head insertion hole 162*a*. Furthermore, a semi-circular notch portion (see FIG. 43) for mounting an ink connection cap is provided at the connection portion with the black-color cartridge upper case 163 on the rear surface of the black-color cartridge lower case 162.

An outer surface of the black-color cartridge lower case 162 has a taper form whose outer diameter is slightly reduced along the downward direction. As a result, when the black-color cartridge case 161 is mounted in the black color cartridge mounting hole 122, the taper-shaped outer surface of the black- color cartridge lower case 162 can be smoothly inserted along both of the left/right inner surface of the black-color cartridge mounting hole 122 (i.e., insertion guide wall 122*a*). The taper shape whose outer diameter is slightly reduced along the lower portion of the outer surface of the black-color cartridge lower case 162, is represented in FIG. 42 (drawing as viewed from the lower direction to the black-color cartridge case 161).

Also, a taper portion 162*g* having a sharp gradient is formed at the left/right lower end portions of the outer surfaces of the black-color cartridge lower case 162. This sharp-gradient taper portion 162*g* is provided in order to avoid such a risk that the cartridge supporting projection 122*c* (see FIGS. 33, 35) formed at the insertion guide wall 122*a* collides with the lower end plane of the black-color cartridge case 161 when the black-color cartridge case 161 is mounted to the black-color cartridge mounting hole 122.

Furthermore, two positioning projections (see FIGS. 37, 439 for positioning the black-color cartridge case 161 by abutting to the rear surface of the black-color cartridge mounting hole 12, are formed on the rear end surface of the black-color cartridge lower case 162.

The black-color cartridge upper case 163 adhered to the black-color cartridge lower case 162, has a semi-circular notch portion (see FIG. 43) at a connection portion between the black- color cartridge lower case 162 and itself. A single circular ink connection cap mounting hole 161*a* (see FIG. 39) is formed by this notch portion and the above-described semi-circular notch portion of the black-color cartridge lower case 162.

On the ink connection cap mounting hole 61*a*, a cap-shaped ink joint 164 (see FIGS. 31, 37, 39, 43) fabricated from rubber or a flexible synthetic resin is mounted. In the rear portion of this ink joint 164 (i.e., contact-side portion) with the cartridge connection portion 141*c* shown in FIG. 31 of the joint connection member 141, a taper-shaped inner hole is formed whose diameter becomes large along the backward direction (i.e., direction to contact-side end portion).

A board mounting port 163*a* (see FIG. 43) is formed on the rear surface of the black-color cartridge upper case 163. As shown as FIG. 39, a cartridge side board 166 is fixed to this board mounting port 163*a* by a screw 167. It should be noted that another proper fixing means such as a thermal melting method may be employed instead of the screw 167. A connector 166*a* (see FIG. 39) is mounted on the front surface (surface of X1 side) of the cartridge side board 166, and a connection terminal 166*b* (see FIGS. 32, 43) between the black color connection terminal portion 146*a* of the flexible cable 146 (see FIG. 32) and itself is formed on the rear surface (surface of arrow X2 side).

Ink-Jet Recording Head Main Body

A description will now be made of the ink-jet recording head main body "H" stored into the black-color cartridge case 161.

In FIGS. 47A and 47B, the ink-jet recording head main body "H" includes an aluminum heat sink 171 fixed inside the black-color cartridge case 161 (see FIG. 43). This heat sink 171 has a heat sink function. There are provided stopped projections 171*a* on both of the front/rear surfaces of the heat sink 171.

The stopped projection 171*a* has such a function that when the ink-jet recording head main body "H" is inserted from the head insertion hole 162*a* of the black-color cartridge case 161 (see FIGS. 39 and 43), these stopped projections 171*a* are engaged with the front edge and the rear edge of the head insertion hole 162*a* (see FIG. 39), which are formed at the lower surface of the black-color cartridge lower case 162 in order to prevent that the ink-jet recording head main body "H" is dropped out from the head insertion hole 162*a*. Also, the stopped projection 171*a* has a function to position the ink-jet recording head main body "H" within the black-color cartridge case 161 along the vertical direction.

As apparent from FIGS. 39 and 42, the lower end of the heat sink 171 is inserted into the head insertion hole 162*a* of the black-color cartridge case 161. Then, the positions of the lower end of the heat sink 171 along both of the front/back direction (X1-X2 direction), and the left/right direction (Y1-Y2 direction) are determined by the head insertion hole 162*a*.

In FIG. 47, a printed circuit board 172 made of a region is provided in contact with the left side surface of the heat sink 171 except for the tip portion thereof (lower left portion shown in FIG. 47A and lower end portions shown in FIG. 44 and 45), and the head chip is adhered to this chip portion.

As represented in FIG. 44 and 45, the printed circuit board 172 extends over the upper end of the heat sink 171, and a base side connector 173 is mounted on the upper end portion of this circuit board. The base side connector 173 is such a member for connecting therewith the connector 166*a* (see FIG. 39) mounted on the front plane (surface of X1-side) of the cartridge side board 166.

In FIGS. 44 to 47, the head chip 174 is attached to the tip portion (lower left portion of FIG. 47A, and lower end portion of FIGS. 44 and 45) of the heat sink 171. This head chip 174 is constructed in a similar to that of the head chip 74 of the preferred embodiment 1 shown in FIG. 23B. This head chip 174 owns constructive elements (not shown) similar to the heater board 74*a*, channel board 74*b*, ink exhausting path 74*c* and ink-supplying channel 74*d*.

The head chip 174 and the printed circuit board 172 are mutually connected via a plurality of connection terminals thereof by a large number of bonding wires 176.

As apparent from FIG. 47A, 42 and 39, a manifold 177 for covering the head chip 174, bonding wires 176, and printed circuit board 172 is arranged on the left side surface of the heat sink 171. As shown in FIG. 39, this manifold 177 has two fixing flanges 177*a* and an ink storage space 177*b*. An ink flow inlet 177*c* is formed at the upper end portion of the ink storage space 177*b*, whereas an ink flow outlet 177*d* and an ink suction member mounting portion 177*e*.

As apparent from FIG. 47A, the heat sink 171, the printed circuit board 172, and the manifold 177 are successively jointed and coupled with each other by two screws 178 (see FIGS. 47A and 39) passing through two fixing flanges 177*a*. As apparent from FIG. 39, the front end portion of the ink joint 164 (see FIGS. 37, 39, 43) is inserted into the ink flow inlet 177*c*. The ink flowing from the ink flow inlet 177*c* into the ink storage space 177*b*, is supplied from the ink flow outlet 177*a* into the head chip 174. A check valve 179 (see FIGS. 47A and 39) is mounted on the ink suction member mounting portion 177*e*.

Figure 47C:
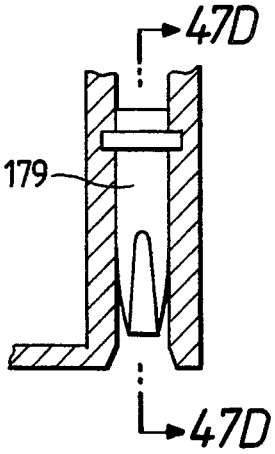
Figure 47D:
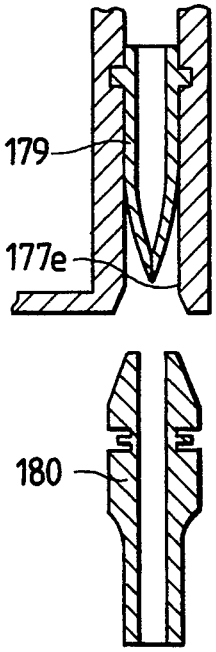

As indicated in FIGS. 47C and 47D, this check valve 179 is constituted by an elastic member in an integral form. A tip portion of the check valve 179 is subdivided into two portions. As a consequence, when a suction nozzle 180 shown in FIG. 47D is depressed against an opening of an ink suction part mounting portion 177*e* near the tip of the check valve 179 to suck air, two divided portions of the tip portion of this check valve 179 is opened, so that air filled in the manifold 177 is sucked and ink can be filled within this manifold 177.

Color Head Cartridge

Referring now to FIGS. 48 to 54, the color head cartridge K2 shown in FIG. 32 will be explained.

Figure 48:
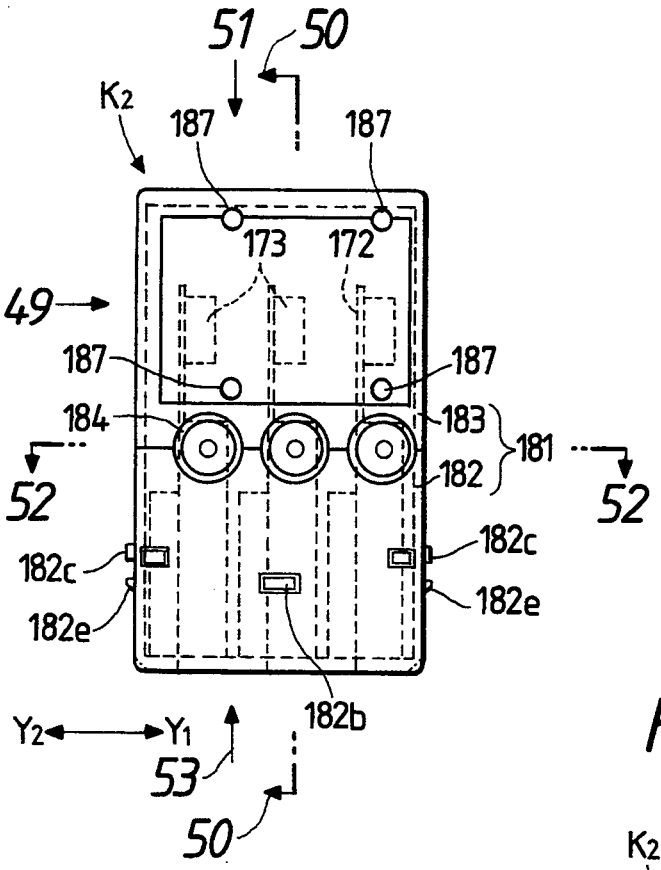
FIG. 48 is a rear view of a color head cartridge K2 used in the preferred embodiment 4.
Figure 49:
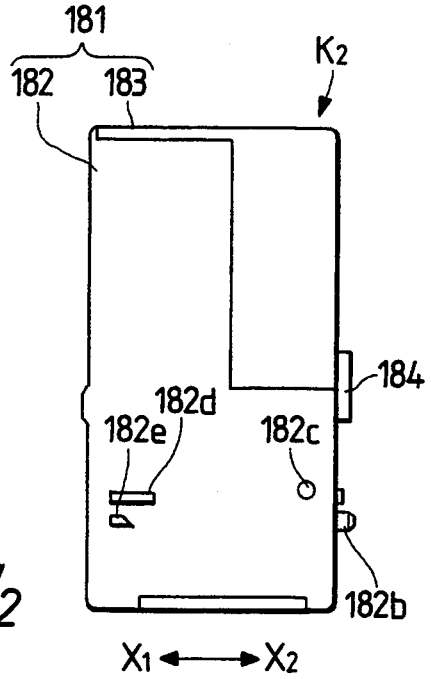
FIG. 49 is a right side view of the color head cartridge K2 according to the preferred embodiment 4, namely a view of the cartridge K2 as viewed from an arrow 49 of FIG. 48.
Figure 50:
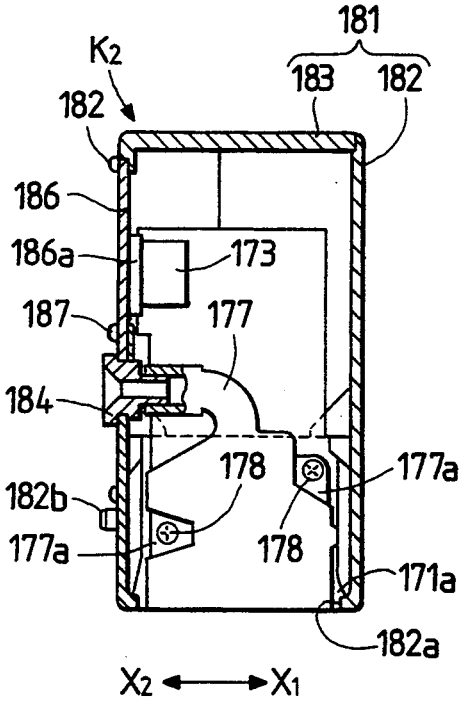
FIG. 50 is a left side view of the color head cartridge K2 according to the preferred embodiment 4, namely a sectional view of the head cartridge K2, taken along a line 50—50 of FIG. 48.
Figure 51:
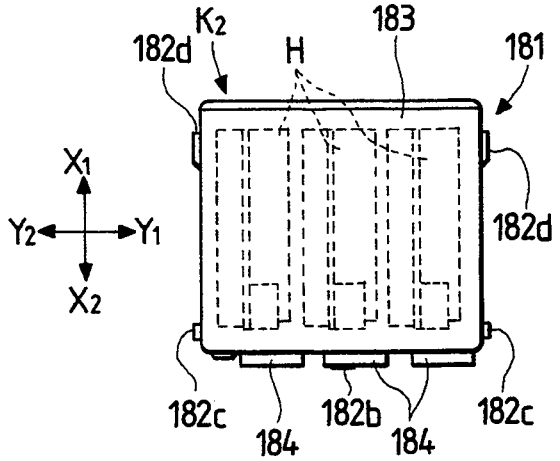
FIG. 51 is an upper view of the color head cartridge K2 according to the preferred embodiment 4, namely a view of the head cartridge as viewed from an arrow 51 of FIG. 48.
Figure 52:
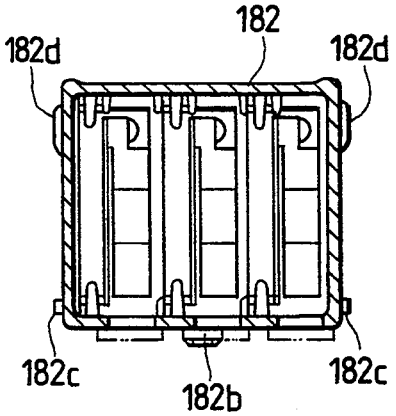
FIG. 52 is an upper sectional view of the color head cartridge K2 according to the preferred embodiment 4, namely a sectional view of the head cartridge, taken along a line 52—52 of FIG. 48.
Figure 53:
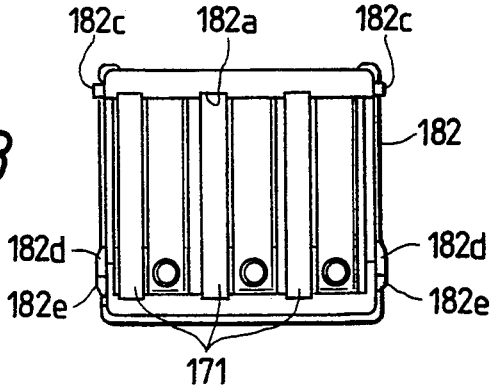
FIG. 53 is a bottom view of the color head cartridge K2 according to the preferred embodiment 4, namely a view of the head cartridge as viewed from an arrow 53 of FIG. 48.
Figure 54:
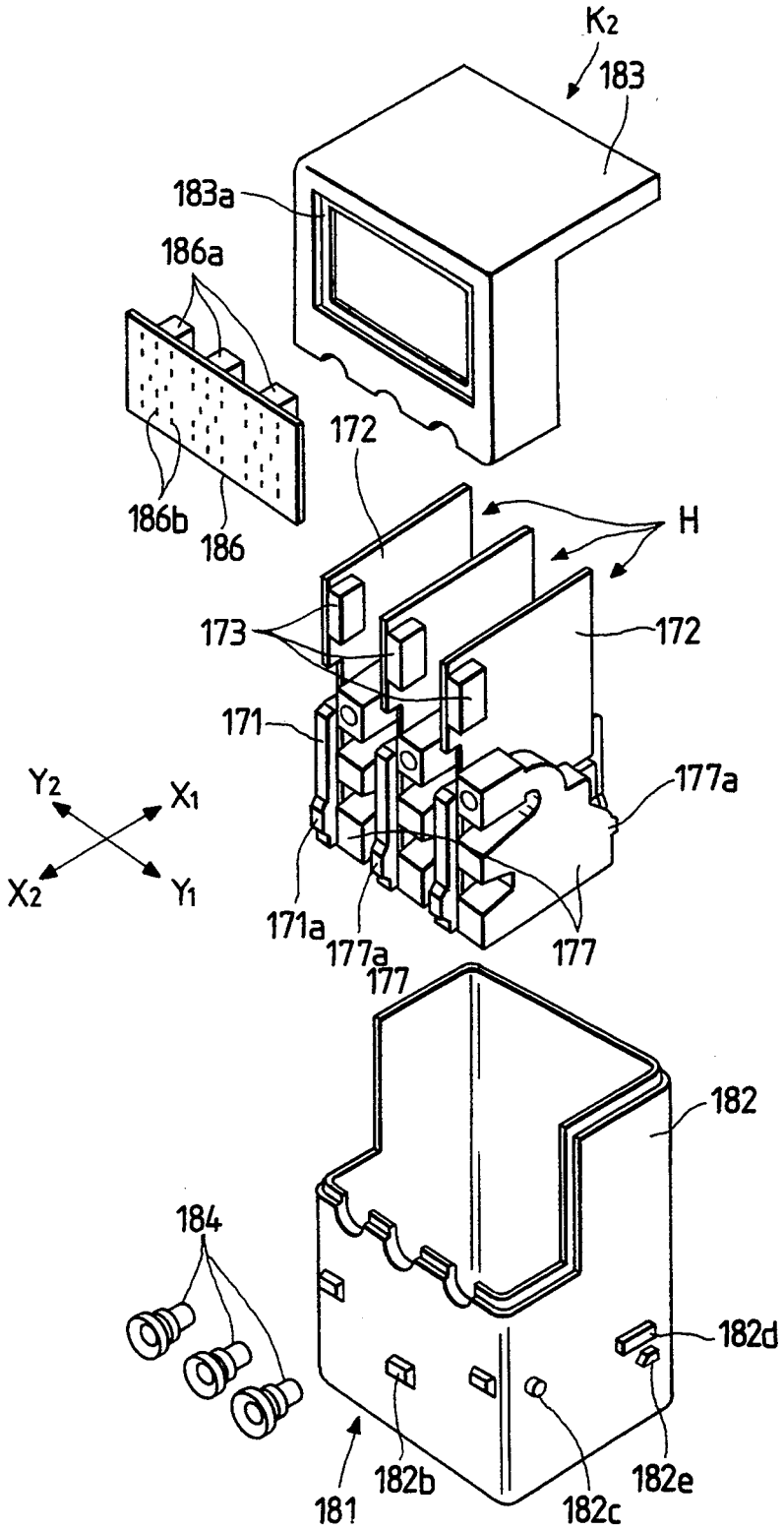
FIG. 54 is an exploded perspective view of the color head cartridge K2 according to the preferred embodiment 4.

FIG. 48 is a rear view of the color head cartridge K2. FIG. 49 is a right side view of the color head cartridge K2 (namely a view of the cartridge K2 as viewed from an arrow 49 of FIG. 48). FIG. 50 is a left side view of the color head cartridge K2 (namely a sectional view of the head cartridge K2, taken along a line 50—50 of FIG. 48). FIG. 51 is an upper view of the color head cartridge K2 (namely a view of the head cartridge as viewed from an arrow 51 of FIG. 48). FIG. 52 is an upper sectional view of the color head cartridge K2 (namely a sectional view of the head cartridge, taken along a line 52—52 of FIG. 48). FIG. 53 is a bottom view of the color head cartridge K2 (namely a view of the head cartridge as viewed from an arrow 53 of FIG. 48). FIG. 54 is an exploded perspective view of the color head cartridge K2.

As apparent from FIG. 54, this color head cartridge K2 is equipped with 3 ink-jet recording head main bodies "H" used for separately exhausting or jetting 3 different color ink such as yellow, magenta and cyan. These three ink-jet recording head main bodies "H" are stored into a single color cartridge case (namely, head supporting member) 181, which is different from such a black-color head cartridge K1 into which a single jet recording head main body "H" shown in FIG. 43 is stored into the black-color cartridge case 161. Then, there is only difference in the colors of the supplied ink to the color head cartridge, but the structures of the three ink-jet recording head main bodies "H" of the color head cartridge K2 are the completely same as that of the black-color head cartridge K1.

As a consequence, each of these three ink jet recording head main bodies "H" for the color head cartridge K2 is constructed of the elements indicated by reference numerals 171 to 179 in FIGS. 44 to 47. It should be noted that colors of the ink supplied to the respective 3 ink-jet recording head main bodies "H" of the color head cartridge K2, are not black, but yellow, magenta and cyan.

Also, as seen from FIG. 54, a color cartridge case 181 of this color head cartridge K2 is constructed of a color cartridge lower case 182 and a color cartridge upper case 183.

At the lower surface of the color cartridge lower case 182, a head insertion hole **182*a* (see FIGS. 53 and 50) is fabricated. As understood from FIGS. 50, 53 the above-described 3 ink-jet recording head main bodies "H" are inserted into the head insertion hole 182*a*, and the lower end portion of the respective heat sinks 171 for the 3 ink-jet recording head main bodies "H" is held at the lower end position of the head insertion hole 182*a***.

There is a difference in such a construction that this lower case 182 of the color cartridge can receive these 3 ink-jet recording head main bodies "H", as compared with such a construction that one ink-jet recording head main body "H" can be inserted into the lower case 162 of the black-color cartridge. However, the remaining structures of the color cartridge lower case 182 are substantially same as those of the black-color cartridge lower case 162.

When the ink-jet recording head main body "H" is inserted from the head insertion hole **182*a* of the color cartridge case 181 (see FIGS. 50, 54), the stopped projection 171*a* (see FIGS. 47 and 50) of the heat sink 171 is engaged with both of the front edge and the rear edge of the head insertion hole 182*a* (see FIG. 50) formed at the lower surface of the color cartridge lower case 182, thereby preventing that the ink-jet recording head main body "H" is dropped out from the head insertion hole 182*a*. The stopped projection 171*a* has a function to position the ink-jet recording head main body "H" within the color cartridge case 181** along the vertical direction.

Then, the head insertion hole **182*a* has such a form capable of positioning the lower ends of the above-described 3 heat sinks 171** along the front/rear direction (X1-X2 direction) and the left/right direction (Y1-Y2 direction).

An unloosen preventing projection (namely, unloosen preventing member) **182*b* (see FIGS. 54, 52, 48) is formed at the lower rear plane of the color cartridge lower case 182. This unloosen preventing projection 182*b* has such a shape capable of being fitted into the unloosen preventing member stopping hole 123*d* (see FIG. 36) which is formed at the rear surface of the color cartridge mounting hole 123 (see FIGS. 36, 33**).

There are provided supported projections **182*c* (see FIGS. 54, 53, 49) on both of lower left/right surfaces of the color cartridge lower case 182. This supported projection 182*c* corresponds to a member supported by a cartridge supporting plane 123*b* (see FIGS. 33, 36) formed on both of left/right surfaces of the color cartridge mounting hole 123** at the front surface thereof.

Also, there are provided a supported ridge **182*d* and a holding ridge 182*e* on the lower left/right side planes of the color cartridge lower case 182 at the rear portion thereof. The supported ridge 182*d* is such a member supported by cartridge supporting projections 123*c* (see FIG. 33) which are formed on both of the left/right side surfaces of the color cartridge mounting hole 123. The holding ridge 182*e* corresponds to a member for holding the cartridge supporting projection 123*c* between this holding ridge 182*e* and the above supported ridge 182*d*. Since this holding ridge 182*e* is stopped by the cartridge supporting projection 123*c* when the color head cartridge K2 mounted on the head carriage C is depressed upwardly by the capping unit, or pulled up by a manual operation, this holding ridge 123*c*** has a function as the unloosen preventing member.

Inside the black-color cartridge lower case 162, there is provided a rib **162*f* (see FIGS. 39 and 41) for fixing the ink-jet recording head main body "H" (will be explained later) to a predetermined position. Furthermore, 3 semi-circular notch portions (see FIG. 54) for mounting an ink connection cap are provided at the connection portion with the color cartridge upper case 183 on the rear surface of the color cartridge lower case 182**.

The color cartridge upper case 183 adhered to the color cartridge lower case 182, has 3 semi-circular notch portions at a connection portion between the color cartridge lower case 182 an itself. Three circular ink connection cap mounting hole **181*a* (see FIG. 50) are formed by these notch portions and the above- described 3 semi-circular notch portions of the color cartridge lower case 182**.

On the three ink connection cap mounting holes **181*a*, a cap-shaped ink joint 184 (see FIGS. 48, 49, 50, 54) fabricated from rubber or a flexible synthetic resin is mounted. This ink joint 184 has the completely same structure as the ink joint 164 shown in FIGS. 37, 39 and 43**.

A board mounting port **183*a* is formed on the rear surface of the color cartridge upper case 183. A cartridge side board 186 is fixed to this board mounting port 183*a* by a screw 187. Three connector 186*a* are mounted on the front surface (surface of X1 side) of the cartridge side board 186. These three connectors 186*a* are connected to the respective base side connectors 173 (see FIGS. 50, 54, 48) of the 3 ink-jet recording head main body "H" stored in the color cartridge case 181**.

A connection terminal **186*b* (see FIGS. 32, 54) between the color connection terminal portion 146*b* of the flexible cable 146 (see FIG. 32) and itself is formed on the rear surface (surface of arrow X2 side) of the cartridge side board 186**.

Operation of Fourth Ink-Jet Recording Apparatus

A description of an operation of the ink-jet recording apparatus equipped with the above-described structure, according to the preferred embodiment 4, will now be made.

In FIGS. 30, 31, 32, the connection board 137, the cylindrical ink-supplying joint connection member 141, the flexible cable 146, the elastic sheets 148*a*, 148*b*, black-color cartridge depression lever 151, and also the color cartridge depression lever 156 are mounted on the carriage main body 106 to assemble the head carriage C. This head carriage C is supported by one pair of guide shafts 101 and 102 along the front/backward direction. Then, the drive belt 103 is coupled to the belt coupling member 109 of the head carriage C. Also, the tip portion of the cable 138 connected to a main board (not shown), is connected to the rear side connector 137*b* of the head cartridge C. Furthermore, an ink supply tube 142 connected to an ink tank (not shown) is connected to the joint connection member 141 of the head carriage C.

In this case, the intermediate portions of the above-mentioned cable 138 and ink supply tube 142 are supported by the upper end of the cable supporting lever 143. Under this condition, the head carriage C can be reciprocated along the guide shafts 101 and 102 by the drive belt 103.

Subsequently, under such a condition that the black-color cartridge depression lever 151 is held at the release position (solid-line position of FIG. 34) (this state is kept by the tension spring 154 for the line of operation in front of the dead point), the black-color head cartridge K1 is inserted into the black-color cartridge mounting hole 122 of the head cartridge C. Thus, since the black-color head cartridge K1 is depressed frontwardly by the leaf spring 134 (see FIG. 35), this cartridge is inserted into a front-deviated preselected position. At this time, the supported projections 162*c* provided at the lower rear portions of the right/left side surfaces of the black-color head cartridge K1, are supported by the cartridge supporting plane 122*b* (see FIGS. 30A, 33, 35 and 36) of the black-color cartridge mounting hole 122. At the same time, the lower surface of the holding ridge 162*d* provided at the lower front portion of the left/right side surfaces of the black-color head cartridge K1 is supported by the cartridge supporting projection 122*c* (see FIGS. 30A, 33, 359 of the black-color cartridge mounting hole 122.

The position of the black-color head cartridge K1 on the head carriage C, at this time, is indicated by a two-dot/dash line of FIG. 35.

Under the condition of FIG. 35, when the black-color cartridge depression lever 151 is pivoted in the counterclockwise direction, the black-color head cartridge K1 inserted into the black-color cartridge mounting hole 122 is depressed toward the rear side (X2-direction) by means of the cam plane of the depression cam forming projection portion 152*b* formed on the inner side surfaces of one pair of arms 152. At this time, the black-color head cartridge K1 is moved backwardly. Then, as shown in FIG. 30A, the unloosen preventing projection 162*b* of the lower rear surface of the black-color head cartridge K1 is fitted to the unloosen preventing member stopping hole 122*d* formed on the rear surface of the black-color cartridge mounting hole 122. At this time, both of the supported ridge 162*d* and the holding ridge 162*e* provided on the lower front portion of the left/-right side surfaces of the black-color head cartridge K1 are simultaneously moved backwardly, so that the cartridge supporting projection 122*c* of the black-color cartridge mounting hole 122 is sandwiched between them.

Then, when the black-color head cartridge K1 is moved backwardly, the supported ridge 162*d* is moved to the left/right inside surface portions of the black-color cartridge mounting hole 122 (see FIG. 33), whose width becomes narrow, and thus, both of the left/right edges of the supported ridge 162*d* are positioned with respect to the horizontal direction by the portion of the insertion guide wall 122*a* (see FIG. 33), whose width is narrow.

At this time, the present position of the black-color head cartridge K1 on the head carriage C is indicated by a solid line of FIG. 30A.

The condition indicated by the solid line of FIG. 30A corresponds to the condition under which the black-color head cartridge K1 is mounted on the head carriage C. Under such a mounting state, the line of operation for the tension spring 54 is moved to the rear side of the dead point. As a consequence, this mounting state is held by the tension spring 154 exerted to the black-color cartridge depression lever 151.

Under such a condition that this black-color head cartridge K1 is mounted to the head carriage C, when the head carriage C is moved to a home position, an ink-stop preventing cap is depressed against the ink exhausting hole formed at the lower surface of the ink-jet recording head main body "H" for the black-color head cartridge K1. In this case, the black-color head cartridge K1 is depressed upwardly. This depression force is such a force for moving upwardly the black-color head cartridge K1 from the head carriage C.

When such a force is effected by which the black-color head cartridge K1 is moved upwardly from the head carriage C, the upward movements of the supported projection 162*c* and the holding ridge 162*e* of the black-color head cartridge K1 are prevented by the unloosen preventing member stopping hole 122*d* and the cartridge supporting projection 122*c* of the head carriage C.

As seen from FIGS. 30A and 31, under such a condition that the black head cartridge K is mounted on the head carriage C, the ink joint 164 of the black-color head cartridge K1 is depressed to the joint connection member 141 of the head carriage C, thereby maintain the mutual connection condition.

That is, when the ink joint 164 and the joint connection member 141 are mutually depressed, the taper-shaped inner hole expanding backwardly to the ink joint 164, and a taper-shaped outer diameter reducing forwardly to the joint connection member 141 are mutually depressed, so that the ink joint 164 is connected to the joint connection member 141.

On the other hand, an elastic characteristic applying portion 141*a* having a thin thickness is formed at an intermediate position of the joint connection member 141 along the forward/backward direction (namely, a position between a portion supported by the carriage rear wall 111 and a portion connected to the ink joint 164). As a result, even if the position of the black-color ink supply connection member mounting hole 118 (see FIG. 31) of the carriage rear wall 111 for supporting the joint connection member 141, and also the position of the ink joint 164 are slightly shifted, the above-described elastic characteristic applying portion 141*a*.

In other words, when the taper-shaped inner hole expanding backwardly to the ink joint 164 and the taper-shaped outer diameter reducing forwardly to the joint connection member 141 are mutually depressed, such a force is exerted by which the center lines of the connection portions are coincident with each other due to the shapes of the connection portions of these members 164 and 141. At this time, even if the positions of both of the connection portions are shifted, since the elastic characteristic applying portion 141*a* having a thin thickness is deformed and then the cartridge connection portion 141C is deformed, the center lines of both of these connection portions are automatically coincident with each other.

As a consequence, the joint connection member 141 is coupled to the cap-shaped ink joint 164 under watertight state.

Also, even when a vibration is produced in either the head carriage C, or the black-color head cartridge K1 and therefore a relative movement is produced between them, such a relative movement can be absorbed by the elastic characteristic applying portion 141*a* having a thin thickness. As a consequence, even when the joint connection member 141 supported to the head carriage C is relatively moved with respect to the ink joint 164 supported to the black-color head cartridge K1, such a watertight condition can be maintained without any damage.

As easily seen from FIGS. 30A and 30, under such a condition that the black-color head cartridge K1 is mounted to the head carriage C, the connection terminal 166*b* (see FIGS. 32, 43) formed on the rear surface of the cartridge side board 166 for the black-color head cartridge K1, and also the black-color connection terminal portion 146*a* of the flexible cable 146 of the head carriage C are depressed.

On the other hand, there is provided the above-explained elastic sheet 148*a* which can be elastically and entirely compressed along a direction perpendicular to the sheet surface, between the rear surface of the black-color connection terminal portion 146*a* and the carriage rear wall 111. A plurality of small hardening projection portions are formed on the elastic sheet 148*a*at positions corresponding to a plurality of terminals formed on the black-color connection terminal portion 146*a*. Then, the black-color connection terminal portion 146*a* is held at the position outwardly projecting from the elastic sheet 148*a*. If an external depression force is applied to the elastic sheet 148*a*, this sheet is deformed inwardly. However, a plurality of terminals for the black-color connection terminal portions 146 are maintained at the positions projecting outwardly by the hardening projection portions. As a result, the plural terminals of the black-color connection terminal portions 146*a* are continuously projected outwardly by way of the hardening projection portions of the elastic sheet 148*a*, so that a better electric contact can be maintained between the connection terminal 166*b* (see FIGS. 32, 43) formed at the rear surface of the black-color head cartridge K1 and these plural terminals of the black-color connection terminal portions 146*a*.

Since an operation when the color head cartridge K2 is mounted to the head cartridge C is substantially similar to that when the black-color head cartridge K1 is mounted to the head cartridge C, no explanation thereof is made.

Arrangement of Fifth Ink-Jet Recording Apparatus

Figure 55:
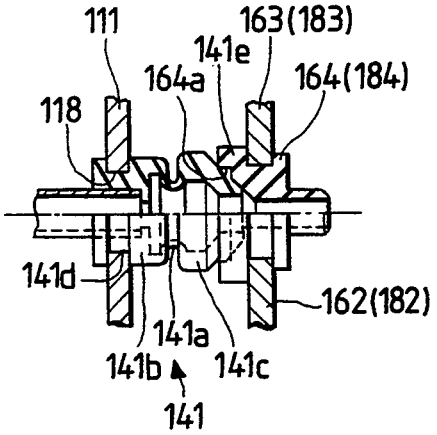
FIG. 55 is an explanatory diagram of a major portion of an ink-jet recording apparatus according to a preferred embodiment 5 of the present invention.

Referring now to FIG. 55, an arrangement of an ink-jet recording apparatus U according to a preferred embodiment to a preferred embodiment 5 will be described.

A view of FIG. 55 corresponds to the view of FIG. 31 according to the preferred embodiment 4. It should be noted that the same reference numerals are applied to constructive elements corresponding to those of the preferred embodiment 4, and a detailed explanation thereof is omitted. In this preferred embodiment 5, although a structures of a joint connection member 141 mounted to the rear wall 111 of the head carriage C, and ink joints 164,184 of the head cartridges K1, K2 are different from the structures, shown in FIG. 31, of the preferred embodiment 4, the remaining structures thereof are similar to those of the preferred embodiment 4.

Structures of the respective ink joints 164 and 184 of the black-color, or color head cartridge K1 or K2 according to this preferred embodiment 5 are the same with each other, and also structures of the black-color, or color ink supplying joint connection member 141 at the head carriage C side to be connected to the above-described ink joints are the same. Accordingly, as shown in FIG. 55, a description will now be made of the cap-shaped ink joint 164 for the black-color head cartridge K1, and also the ink supplying cylindrical joint connection member 141 to be connected thereto.

In FIG. 55, the ink supplying cylindrical joint connection member 141 is mounted on the black-color ink supplying connection member mounting hole 118 of the carriage rear wall 111. A ring- shaped ridge 141*e* is provided on the front outer side surface having a taper-shaped outer diameter reducing forwardly to the joint connection member 141. A ring-shaped groove 164*a* fitted with the above ridge 141*e* is provided in a taper-shaped inner hole expanding backwardly to the rear end portion of the ink joint 164.

Consequently, when the ink joint 164 and the joint connection member 141 are mutually depressed, the taper-shaped inner hole expanding backwardly to the ink joint 164, and a taper-shaped outer diameter reducing forwardly to the joint connection member 141 are mutually depressed, so that the ink joint 164 is connected to the joint connection member 141. In this case, the ridge 141*e* of the joint connection member 141 is fitted with the groove 164*a* of the ink joint 164. As a consequence, the watertight condition established when the joint connection member 141 is connected with the ink joint 164 can be furthermore improved.

Arrangement of Sixth Ink-Jet Recording Apparatus

An ink-jet recording apparatus according to a preferred embodiment 6 of the present invention will now be explained with reference to FIG. 56.

Figure 56A:
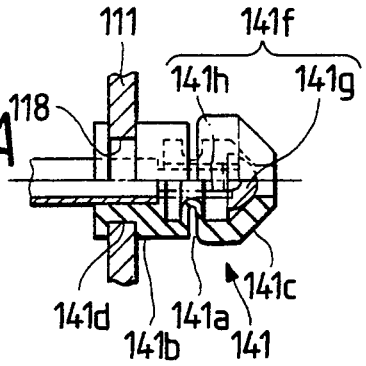
FIGS. 56A to 56C are explanatory diagrams of a major portion of an ink-jet recording apparatus according to the present invention.
Figure 56B:
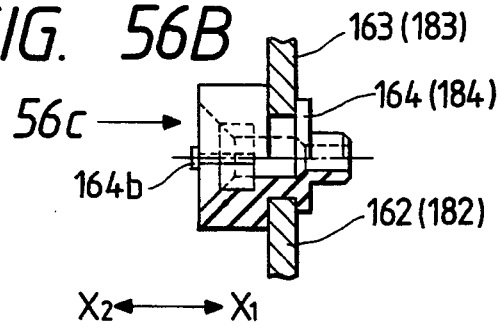
Figure 56C:
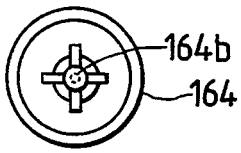

A drawing shown in FIG. 56 corresponds to the drawing of the preferred embodiment 4 shown in FIG. 31. The same reference numerals shown in the preferred embodiment 4 will be employed as those for denoting the same constructive elements in the preferred embodiment 6, and detailed explanations thereof are omitted. In accordance with this preferred embodiment 6, the structures of the ink supplying cylindrical joint connection member 141 mounted on the rear wall 111 of the head carriage C, and of the ink joints 164, 184 of the head cartridges k1 and K2 are different from those of the preferred embodiment 4 shown in FIG. 31. However, the remaining structures of this preferred embodiment 6 are similar to those of the preferred embodiment 4.

Structures of the respective ink joints 164 and 184 of the black-color, or color head cartridge K1 or K2 according to this preferred embodiment 6 are the same with each other, and also structures of the black-color, or color ink supplying joint connection member 141 at the head carriage C side to be connected to the above-described ink joints are the same. Accordingly, as shown in FIG. 56, a description will now be made of the cap- shaped ink joint 164 for the black-color head cartridge K1 according to the preferred embodiment 6, and also the ink supplying cylindrical joint connection member 141 to be connected thereto.

In FIG. 56, the ink supplying cylindrical joint connection member 141 is mounted on the black-color ink supplying connection member mounting hole 118 of the carriage rear wall 111. A front outer side surface of the joint connection member 141, which has a taper-shaped outer diameter reducing forwardly, is fitted to a taper-shaped inner hole of the rear portion of the ink joint 164 expanding backwardly. These constructions are similar to those of the preferred embodiment 4 shown in FIG. 31 and of the preferred embodiment 5 shown in FIG. 55.

Inside the inner hole of the joint connection member 141, automatic opening/closing valve **141*f* is stored which is automatically opened when being connected with the ink joint 164, and is automatically closed when being released from the ink joint 164. This automatic opening/closing valve 141*f* is arranged by a valve body 141*g* and a compression spring 141*h* for continuously depressing this valve body 141*g*** against the closing position.

Also, inside the taper-shaped inner hole of the ink joint 164, a valve operation member **164*b* is stored which depresses the valve body 141*g* to the opening position when being connected to the joint connection member 141. This valve operation member 164*b* is supported into the taper-shaped inner hole of the ink joint 164** by 4 supporting plates extending in a radial direction.

Under such a condition that the ink joint 164 is mutually depressed by the joint connection member 141, thereby being connected with each other, inner portions thereof are communicated to each other, whereas when the ink joint 164 is separated from the joint connection member 141, the inner hole of the joint connection member 141 is closed by the valve body **141*g*. As a result, when the head cartridge K1 is detached with regard to the head carriage C, it can be prevented that air is entered into the joint connection member 141**.

Arrangement of Seventh Ink-Jet Recording Apparatus

Figure 57:
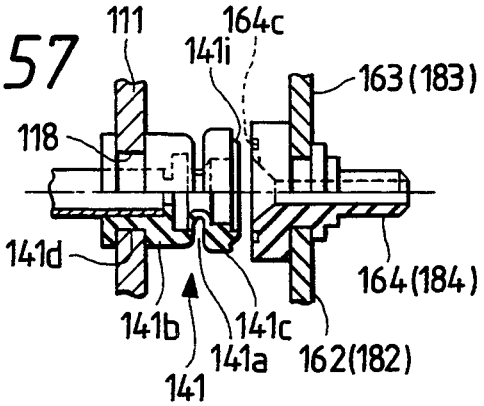
FIG. 57 is an explanatory diagram of a major portion of an ink-jet recording apparatus according to a preferred embodiment 7 of the present invention.

Referring now to FIG. 57, an arrangement of an ink-jet recording apparatus U according to a preferred embodiment 7 will be described. A view of FIG. 57 corresponds to the view of FIG. 31 according to the preferred embodiment 4.

It should be noted in this preferred embodiment 7 that the same reference numerals are applied to constructive elements corresponding to those of the preferred embodiment 4, and a detailed explanation thereof is omitted.

In this preferred embodiment 7, although structures of a cylindrical ink-supplying joint connection member 141 of the head carriage C, and ink joints 164,184 of the head cartridges K1, K2 are different from the structures, shown in FIG. 31, of the preferred embodiment 7, the remaining structures thereof are similar to those of the preferred embodiment 4.

Structures of the respective ink joints 164 and 184 of the black-color, or color head cartridge K1 or K2 according to this preferred embodiment 7 are the same with each other, and also structures of the black-color, or color ink supplying joint connection member 141 at the head carriage C side to be connected to the above-described ink joints are the same. Accordingly, as shown in FIG. 57, a description will now be made of the cap- shaped ink joint 164 for the black-color head cartridge K1, and also the ink supplying cylindrical joint connection member 141 to be connected thereto.

In FIG. 57, the cylindrical ink-supplying joint connection member 141 is mounted on the black-color ink supplying connection member mounting hole 118 of the carriage rear wall 111. A front edge surface of the joint connection member 141 is made flat, on which a ring-shaped ridge **141*i* is provided. Also, a rear edge surface of the ink joint 164 is made flat, on which a ring-shaped groove 164*c* is formed. This ring-shaped groove 164*c* is fitted to the above-described ridge 141*i***.

As a consequence, when the ink joint 164 is mutually depressed against the joint connection member 141, the ring-shaped ridge **141*i* formed on the front edge surface of the joint connection member 141 is mutually depressed against the ring-shaped groove 164*c* formed on the rear edge surface of the ink joint 164, thereby being mutually fitted. Then, the ink joint 164 is connected with the joint connection member 141. In this case, a section shape of the ridge 141*i* of the joint connection member 141 is made tapered arc, so that this tapered arc ridge 141*i* can be readily fitted with the groove 164*c***.

MODIFICATIONS

While the various preferred embodiments of the present invention have been described in detailed, the present invention is not limited to the above-described preferred embodiments, but may be modified, changed or substituted without departing from the appended claims.

For instance, in the preferred embodiment 1, it is possible to provide such a closing member for closing the through hole **81*b* in the ink tank T. When this closing member is depressed to the ink joint 65, this closing member may be easily destroyed, but until such a destroy happens to occur, the through hole 81*b*** may be closed by this closing member. An ink leakage from the ink tank T can be prevented by employing such a closing member.

Also, the above-described unloosen preventing member **55*c* has been made of the "L"-shaped pawl 55*a* and the holding projection 55*b* of the holder bottom wall F1. Alternatively, this holding projection 55*b* is omitted from the constructive elements, and then the unloosen preventing member 55*c* may be arranged by the "L"-shaped pawl 55*a*** and the outer side surface of the holder bottom wall.

Furthermore, the shutter guide **62*d*** formed on the side surface of the tank holder F has been formed as the guide groove, but also may be formed by 2 or 1 groove.

Also, in the preferred embodiment 1, the filter 67 may be omitted, and both of the filter 67 and the porous body 68 may be omitted. If only the filter 67 is omitted, the ink holding body 83 is positioned in contact with the porous body 68, that the ink held in the ink holding body 83 may be flown from the ink tank T into the ink joint 65 by way of the capillary phenomenon, and therefore the ink stored in the ink tank T may be completely consumed without any loss.

Then, in the preferred embodiment 4, instead that the elastic characteristic applying portion 141*a* is formed on the joint connection member 141, the elastic characteristic applying portion may be formed on the ink joint 164. Also, elastic characteristic applying portions may be formed on both of the joint connection member 141 and the ink joint 164.

In accordance with the ink-jet recording apparatus according to the present invention, since the head cartridge can be readily detached with the head carriage, the replacement of the head carriage may be easily performed by a simple operation. Moreover, the head cartridge can be firmly fixed to the head carriage under the cartridge mounting condition.

Also, in accordance with the ink-jet recording apparatus of the present invention, when the head supporting member of the head cartridge is constructed by the tank holder from which the ink tank can be freely detached, the replacement of the ink tank, or ink-jet recording head may be easily carried out by a simple operation. Then, the replacement of only the ink tank may be readily performed without separating the ink-jet recording head from the head carriage.

In the ink-jet recording apparatus according to the present invention, when the joint connection member is mounted on the head carriage, which is connected via a flexible ink-supplying tube to the ink tank fixedly positioned at a proper position, if the head cartridge is mounted on the head carriage, the ink joint of the head cartridge may be easily coupled to the joint connection portion without any ink leakage. Also, even if there is a positional shift between the ink joint and the joint connection portion, and/or there is a relative movement between them due to vibrations, a proper positional relationship between the ink joint and the joint connection portion can be maintained under watertight condition during the mutual connection thereof.

What is claimed is:

1. An ink-jet recording apparatus comprising:

an ink joint;

a head chip in which a plurality of ink exhausting outlets are formed;

an ink-jet recording head having a transfer fluid chamber for communicating an inside of the ink joint with said plurality of ink exhausting outlets;

a head carriage on which said ink-jet recording head is mounted; and a capping unit having a capping member which is abutted to a tip portion of said ink-jet recording head mounted on said head carriage during a non-printing operation so as to seal said ink exhausting ports, thereby avoiding dries of ink, and for abutting and separating said capping member with respect to said ink-jet recording head; wherein a bubble ventilation port is provided on said ink-jet recording head, said bubble ventilation port being communicated with an upper portion of said opened along the same direction of said ink exhausting outlets;

an opening/closing valve changing between a closing state and an opening state is provided between said transfer fluid chamber and said bubble ventilation port; and a suction nozzle is arranged in such a manner that said suction nozzle is abutted to, and is operated from said bubble ventilation port.

2. An ink-jet recording apparatus as claimed in claim 1, wherein said bubble ventilation port has a taper-shaped inner diameter expanding toward a tip portion thereof, and said suction nozzle has a taper-shaped narrowing outer side surface to be fitted to said inner diameter of the bubble ventilation port.

3. An ink-jet recording apparatus as claimed in claim 2, wherein said suction nozzle has a deformable elastic-characteristic applying portion having a thin thickness, and a tip side portion of said elastic-characteristic applying portion is so arranged as to be displaceable.

4. An ink-jet recording apparatus as claimed in claim 1, wherein said suction nozzle is provided on said capping unit.

5. An ink-jet recording apparatus comprising:

an ink joint;

a head chip having a plurality of ink exhausting outlets;

a transfer fluid chamber for communicating an inside of the ink joint with said plurality of ink exhausting outlets;

a bubble ventilation port for communicating with an upper portion of said transfer fluid chamber, and for being opened along the said direction of said ink exhausting outlets; and an opening/closing valve changing between a closing state and an opening state, provided between said transfer fluid chamber and said bubble ventilation port.

6. An ink-jet recording apparatus as claimed in claim 5, wherein said opening/closing valve is formed by an elastic material with a notch at a tip portion thereof, and is constructed in such a manner that said opening/closing valve is normally maintained under such a closing state that said notch is jointed with each other due to elasticity thereof, and said opening/closing valve is changed into such an opening state that said notch is separated from each other when pressure at an upper stream side is higher than pressure at a down stream side.

7. An ink-jet recording apparatus comprising:

a head cartridge including a head supporting member in which an ink tank and an ink joint communicatable with said ink tank are provided, a head chip having a plurality of ink exhausting outlets, and ink-jet recording head arranged by an ink supply path for communicating said plurality of ink exhausting outlets with an inside of said ink joint; and a head carriage reciprocated along a main scanning direction and to which said head cartridge is detachably mounted;

wherein a joint connection member for connecting with the ink joint of the head cartridge under such a condition that said head cartridge is mounted, is provided on said head carriage;

said joint connecting member is connected via a flexible ink supplying tube to the ink tank;

at least one of junction portions of said ink joint and said joint connecting member is displaceable; and a junction portion between a deformable elastic characteristic applying portion with a thin thickness and a tip portion thereof is integrally formed.

8. An ink-jet recording apparatus as claimed in claim 7, wherein one junction portion of said ink joint and said joint connecting member has a narrow taper-shaped outer side surface, and the other junction portion has a taper-shaped inner hole capable of being fitted with said taper-shaped outer side surface, and expanding toward a tip portion thereof.

9. An ink-jet recording apparatus as claimed in claim 7, wherein a positioning projection for defining a mutual joint position is formed on said one junction portion between said ink joint and said joint connecting member, and a positioning concave fitted with said positioning projection is formed on the other junction portion.

10. An ink-jet recording apparatus as claimed in claim 7, wherein an ink leakage preventing valve opened during a junction operation and closed during a separating operation is provided inside said ink joint or said joint connecting member.

11. An ink-jet recording apparatus comprising:

a head cartridge including a head supporting member in which there is provided an ink joint connected when being depressed to a joint connection member communicated with an ink tank and disconnected when being separated from the joint connection member, a head chip having a plurality of ink exhausting outlets, and ink-jet recording head arranged by an ink supply path for communicating said plurality of ink exhausting outlets with an inside of said ink joint; and a head carriage reciprocated along a main scanning direction and to which said head cartridge is detachably 5 mounted;

wherein said head supporting member is constructed of a case having a lower portion, the shape of which is substantially rectangular, as viewed in a sectional view and also said ink- jet, recording head is fixed to an inside of said head supporting member;

said ink exhausting outlets are provided on either a lower end surface, or a rear end surface of said head cartridge;

a supported projecting member is provided on a side surface of said head cartridge;

a cartridge mounting hole whose sectional view is rectangular and into which a lower portion of said head cartridge is inserted from an upper portion, is formed on the head carriage, and a cartridge mounting portion for supporting said supported projecting member along a forward/backward direction under movable state is formed on a side surface of said cartridge mounting hole;

a depression member for depressing backwardly said head cartridge supported by said supported projecting member is provided on said cartridge mounting portion;

a means for blocking an upward movement of said head cartridge from said cartridge mounting hole when the head cartridge for supporting said supported projecting member is depressed to be moved backwardly by said depression member and the cartridge mounting condition is established, is formed on said cartridge mounting portion;

a mounting-condition holding means for holding a position of said depression member under said cartridge mounting condition is provided;

a cartridge front/rear-direction positioning means for positioning said head cartridge along the front/rear direction under such a cartridge mounting condition that said unloosen preventing member is engaged with a loosen preventing member, is provided between a rear surface of said cartridge mounting hole and a rear surface of said head cartridge; and a cartridge left/right-direction positioning means for positioning said head cartridge along a left/right direction under such a cartridge mounting condition that said unloosen preventing member is engaged with said loosen preventing member, is provided between each of left/right side surfaces of said cartridge mounting hole and each of left/right side surfaces of said head cartridge.

12. An ink-jet recording apparatus as claimed in claim 11, wherein said means for blocking the upward movement of said head cartridge from said cartridge mounting hole includes;

a loosen preventing member formed at a rear portion of said cartridge mounting hole, and an unloosen preventing member stopped to said loosen preventing member and formed on a rear portion of said head supporting member;

said means for blocking the upward movement of said head cartridge from said cartridge mounting hole includes:

a loosen preventing member formed at a front portion of left/right side walls of said cartridge mounting hole; and an unloosen preventing member stopped to said loosen preventing member and formed on a front portion of left/right side walls of said head supporting member; and said cartridge rear-portion stopping means is constructed of a loosen preventing member formed on a rear plane of said cartridge mounting hole and an unloosen preventing member stopped to said loosen preventing member and formed at a rear surface of said head supporting member.

13. An ink-jet recording apparatus as claimed in claim 12, wherein said loosen preventing member of the cartridge rear portion stopping means is arranged by a loosen preventing hole formed at a rear surface of said cartridge mounting hole, and said unloosen preventing member is arranged by an unloosen preventing projection fitted to said loosen preventing hole.

14. An ink-jet recording apparatus as claimed in claim 11, wherein said depression member is arranged by a pivot lever pivotably journaled to the head carriage, and a cam member pivoted with said pivot lever in an integral form, and having a depression cam plane abutting to a front surface of said head cartridge.

15. An ink-jet recording apparatus as claimed in claim 14, wherein said mounting condition holding means is provided between said pivot lever and a member for pivotably supporting said pivot lever, and has a tension spring for pivoting said pivot lever along the depression direction when said pivot lever is pivoted from a predetermined pivot position to a depression side.

16. An ink-jet recording apparatus as claimed in claim 11, wherein said cartridge front/back direction positioning means is separately formed along the left/right direction on both of the flat rear surface of said cartridge mounting hole and the rear surface of said head cartridge, and is constructed by one pair of positioning projections abutting at the rear surface of said cartridge mounting hole.

17. An ink-jet recording apparatus as claimed in claim 11, wherein said cartridge left/right direction positioning means is provided on the left/right side wall portions of said cartridge mounting hole, the width of which is made narrow, and on the left/right side surfaces of the head cartridge, and is constructed of a supported projecting member, the outer circumference of which is in contact with said side wall portion having a narrow width.

18. An ink-jet recording apparatus as claimed in claim 11, wherein said joint connecting member is provided in the head carriage at a position opposite to the ink joint of said head cartridge mounted on said cartridge mounting portion, and at a position connected to the ink joint of the cartridge held under said cartridge mounting state, and said joint connecting member is connected via a flexible ink supplying tube to the ink tank fixed to a proper position.

19. An ink-jet recording apparatus as claimed in claim 11, wherein a tank mounting member for detachably mounting said ink tank, and having a joint connecting member connectable to said ink joint, is provided on said head cartridge.

20. An ink-jet recording apparatus as claimed in claim 11, wherein said head cartridge includes one head supporting member and three ink-jet recording heads for jetting 3 different color ink of yellow, magenta and cyan which is fixed to an inside of said ink-jet recording heads, and three ink joints for communicating with an internal portion of the head chip of said three ink-jet recording heads are provided at said head cartridge.

21. An ink-jet recording apparatus comprising:

a head cartridge including a head supporting member in which there is provided an ink joint connected when being depressed to a joint connection member communicated with an ink tank and disconnected when being separated from the joint connection member, a head chip having a plurality of ink exhausting outlets, and ink-jet recording head arranged by an ink supply path for communicating said plurality of ink exhausting outlets with an inside of said ink joint; and a head carriage reciprocated along a main scanning direction and to which said head cartridge is detachably mounted;

wherein a head supporting member of said head cartridge is arranged by:

head insertion holes into which a yellow ink-jet recording head, a magenta ink-jet recording head, and a cyan ink-jet recording head are inserted, respectively, from which 3 different color ink of yellow, magenta, and cyan is jetted; and head positioning members for positioning said ink-jet recording heads to be fixed into said head insertion holes;

said head cartridge has ink joints communicated with insides of the head chips for said three ink-jet recording heads;

a lower portion of said head cartridge is made of a rectangular shape as viewed in a sectional direction, and supported projecting members are provided on the respective right/left side surface of said head cartridge;

a cartridge mounting hole whose sectional view is rectangular and into which a lower portion of said head cartridge is inserted from an upper portion, is formed on the head carriage, and a cartridge mounting portion for supporting said supported projecting member along a forward/backward direction under movable state is formed on a side surface of said cartridge mounting hole;

a depression member for depressing backwardly said head cartridge supported by said supported projecting member is provided on said cartridge mounting portion; and a means for blocking an upward movement of said head cartridge from said cartridge mounting hole when the head cartridge for supporting said supported projecting member is depressed to be moved backwardly by said depression member, and the cartridge mounting condition is established, is formed on said cartridge mounting portion.

22. An ink-jet recording apparatus comprising:

a head cartridge including a head supporting member in which there is provided an ink joint connected when being depressed to a joint connection member communicated with an ink tank and disconnected when being separated from the joint connection member, a head chip having a plurality of ink exhausting outlets, and ink-jet recording head arranged by an ink supply path for communicating said plurality of ink exhausting outlets with an inside of said ink joint;

wherein a head supporting member of said head cartridge is arranged by:

head insertion holes into which a yellow ink-jet recording head, a magenta ink-jet recording head, and a cyan ink-jet recording head are inserted, respectively, from which 3 different color ink of yellow, magenta, and cyan is jetted; and head positioning members for positioning said ink-jet recording heads to be fixed into said head insertion holes;

said head cartridge has ink joints communicated with inside of the head chips for said three ink-jet recording heads; and a lower portion of said head cartridge is made of a rectangular shape as viewed in a sectional direction; and supported projecting members are provided on the respective right/left side surfaces of said head cartridge.

23. An ink-jet recording apparatus as claimed in claim 22, further comprising:

a heat sink fixed on said head supporting member and for mounting said head chip;

wherein a stopped projection is formed on said heat sink, which passes through said head insertion holes while elastically deforming said head insertion holes when said ink-jet recording head is inserted into said head insertion holes of said head supporting member;

under such a condition that said stopped projection has passed through said head insertion holes, said stopped o projection is stopped by the peripheral portion of said head insertion holes at the inner surface of said head supporting member, and an inner peripheral edge of said head insertion hole is engaged with an outer peripheral portion of the tip portion of said head sink; and a head positioning member for positioning said ink-jet recording heads inserted into said head insertion hole is provided at an inner portion of said head supporting member.

24. An ink-jet recording apparatus as claimed in claim 23, wherein a tank mounting member for detachably mounting said ink tank having said joint connecting member is provided at said head supporting member.

25. An ink-jet recording apparatus as claimed in claim 22, further comprising:

a printed circuit board fixed to said heat sink, wherein a head side connector is provided on said printed circuit board, and a cartridge side board having a connector connected to said head side connector and a connection terminal abutting at the connection terminal portion supported by said head carriage, is mounted on said head supporting member.

26. An ink-jet recording apparatus comprising:

a head cartridge including a head supporting member in which an ink tank and an ink joint communicatable with said ink tank are provided, a head chip having a plurality of ink exhausting outlets, and ink-jet recording head arranged by an ink supply path for communicating said plurality of ink exhausting outlets with an inside of said ink joint; and a head carriage reciprocated along a main scanning direction and to which said head cartridge is detachably mounted;

wherein a head supporting member of said head cartridge is detachably arranged with said ink tank;

both of a stopped member and a joint connection member are provided at said ink tank;

said ink joint of said head supporting member is so constructed that when said ink tank is depressed to said ink joint, said ink joint is connected to said joint connection member, and when said ink tank is removed from said head supporting member, said ink joint is separated from said joint connection member;

said head supporting member has a stopping member engageable with said stopped member of the ink tank under such a condition that said ink tank is mounted, and said stopping member can be readily engaged with and also separated from said stopped member.

27. An ink-jet recording apparatus as claimed in claim 26, wherein said head supporting member is constructed of a holder bottom wall movably supported on said head carriage and equipped with an ink joint, a holder side wall for guiding the ink tank inserted into said holder bottom wall, along the holder bottom wall, and a tank holder having an unloosen preventing member; and said head carriage includes;

a head supporting member mounting portion on which said head supporting member can be slidably mounted;

an insertion guide wall for guiding said head supporting member to be inserted into said head supporting member mounting portion;

a head passing through hole through which said tip portion of said ink-jet recording head under such a condition that said head supporting member is mounted on said head supporting member mounting portion;

a depression member for depressing said head supporting member along a direction intersecting with said insertion direction to be moved on said head supporting member mounting portion under such a condition that said head supporting member is mounted on said head supporting member mounting portion;

a loosen preventing member engaged with said unloosen preventing member of said head supporting member depressed by said depression member in order to block a movement of said head supporting member along a direction opposite to said insertion direction; and a mounting state holding means for holding a position of said depression member under such a cartridge mounting condition that said unloosen preventing member is engaged with said loosen preventing member.

28. An ink-jet recording apparatus as claimed in claim 26, wherein both of said insertion direction of the head supporting member to said head carriage, and said insertion direction to said head supporting member mounted on said head carriage are set to a bottom direction.

29. An ink-jet recording apparatus as claimed in claim 26, wherein said ink-tank positioning stopped member stops said stopped member formed on said tank side surface;

said ink-tank positioning stopping member is provided on the holder side wall of said head supporting member;

said stopped member is a semi-spherical projection, said stopping member is a stopping hole formed on said holder side wall, and said holder side wall portion on which said stopping hole is made, has an elastic characteristic capable of deforming toward an outside;

two parallel slits are formed from the side planes of said holder side wall in order to give an elastic deformation of said holder side wall portion on which said stopping hole is formed, and said stopping hole is arranged between said two parallel slits.

30. An ink-jet recording apparatus as claimed in claim 26, wherein an atmospheric communication hole for communicating an ink storage space with the external atmosphere is provided within said ink tank, and a porous ink holding body is stored into the ink storage space inside the ink tank; and said joint connecting member of the ink tank is arranged by a circular through hole formed on a tank bottom surface, said ink joint has a cylindrical portion passing through said through hole, and a seal ring is mounted on an outer peripheral portion of said cylinder portion, which abuts on the outer side surface of the ink tank around said through hole.

31. An ink-jet recording apparatus as claimed in claim 30, wherein a porous body is stored into an inside of said cylindrical portion of said ink joint;

said porous body has a density lower than that of the ink holding body stored inside said ink tank; and in the ink joint, a filter is provided at a boundary portion between a cylindrical inside of the ink joint and the ink storage space of the ink tank.

32. An ink-jet recording apparatus as claimed in claim 27, wherein said unloosen preventing member is arranged by one pair of "L" shaped pawl having a projection portion projecting from said holder bottom wall outer side surface outwardly, and a loosen preventing portion formed at a tip portion of said projection portion and extends in parallel with said holder bottom wall outer side surface; and said unloosen preventing member is constructed of a held portion held by the holder bottom wall and said "L"-shaped pawl loosen preventing portion when said head supporting member is depressed by said depressing member under such a condition that said holder bottom wall of the head supporting member is supported to said head supporting member mounting portion.

33. An ink-jet recording apparatus as claimed in claim 27, wherein said holder side surface of the head supporting member is formed by 4 side surfaces which constitute a pyramid having a rectangular shape as viewed in a sectional direction, and one side surface among them is fabricated as a depressed surface depressed by said depression member;

said depression member is constructed by a pivot lever pivotably provided on the head cartridge, and a cam member pivotable with said pivot lever in an integral form, and having a depression cam plane abutting at the outer side surface of said head supporting member; and said mounting condition holding means has a mounting condition holding surface which is formed locally lower than the abutting plane of said depression cam plane abutting on the outer side view of said head supporting member when said abutting portion of said depression cam plane abutting at said outer side plane of said head supporting member is abutted to said abutting portion of the depression cam plane and said pivot lever of said depression member is rotated from the cartridge mounting state to the depressed side.

34. An ink-jet recording apparatus as claimed in claim 33, wherein a connection terminal portion of a flexible cable connected to a circuit portion of said ink-jet recording head is held at a side opposite to the depressed surface of said head supporting member; and a carriage side connection terminal portion is formed in said head carriage at a position connectable with said connection terminal portion when said head supporting member is depressed by said depression member along a direction intersecting with said insertion direction under such a condition that said holder bottom wall is supported by the head supporting member mounting portion.

35. An ink-jet recording apparatus as claimed in claim 34, wherein a board insertion groove is formed on said head carriage, and said carriage side connection terminal portion is formed on a connection board detachably mounted on said board insertion groove.

36. An ink-jet recording apparatus as claimed in claim 34, wherein a shutter guide is formed on a side surface of said supporting member, and a shutter is mounted on said shutter guide, which is movable between a terminal covering position for covering said connection terminal portion of said flexible cable and a terminal releasing position for releasing the connection terminal portion along said shutter guide; and a heat sink fixed on said head supporting member and mounting said head chip is further provided, both of said heat sink and said shutter are constructed by a conductive material, and said heat sink is connected to said shutter by a conductive ground line.

37. An ink-jet recording apparatus as claimed in claim 36, wherein a shutter engaging portion for sliding said shutter to a release position with being engaged with said shutter is provided on said head carriage, when the head supporting member at said terminal covering position is inserted toward the head supporting member mounting portion along said side wall of the head carriage; and said shutter engaging portion is formed by the end surface of the side wall of said head carriage.

38. An ink-jet recording apparatus as claimed in claim 27, wherein a plurality of head supporting member mounting portions, head through holes insertion guide walls, depression members, and loosen preventing members are provided within said head carriage in order to support a plurality of head supporting members which store inside different color ink for performing a color printing operation;

said head supporting member mounting portions, head insertion holes, insertion guide walls, depression members, and loosen preventing members, which support the head supporting members on which a plurality of ink tanks for storing therein said different color ink have been mounted, are arranged along the scanning direction of said head carriage;

the tip portions of said ink-jet recording heads for said plurality of head cartridges pass through the lower surface of said head carriage; a heat sink fixed to said head supporting member and mounting said head chip is provided; a head positioning plate is mounted in which a plurality of head positioning holes are formed and have positioning edges which are abutted to a surface of said heat sink so as to position said ink-jet recording head along the main scanning direction; and a means for causing the surface of said heat sink to be abutted against said positioning edge while depressing said head cartridge inserted into said head carriage along the scanning direction of said head carriage, is provided between said head carriage and said head carriage.

39. An ink-jet recording apparatus as claimed in claim 38, wherein said means for causing the surface of said heat sink to be abutted against said positioning edge has a depression elastic portion formed at a lower end portion of said head carriage.

40. An ink-jet recording apparatus as claimed in claim 38, wherein said means for causing the surface of the heat sink to be abutted against said positioning edge includes;

a guided projection formed on the depressed surface of the holder side surface of said head supporting member; and a cam groove formed at the cam plane of the cam member of the depression member abutting against said depressed surface, and also for guiding said guided projection along the scanning direction of the head carriage when said cam member is rotated.

41. An ink-jet recording apparatus as claimed in claim 38, wherein said means for causing the surface of the heat sink to be abutted against said positioning edge, is formed in such a rectangular sectional view and fabricated by four holder side surfaces of said head supporting member is a pyramid having a trapezoid, said depressed surface is formed by a side surface for constituting one oblique edge of said trapezoid, and when being depressed by the depression member, a depressed force along the scanning direction of the head carriage is produced.

42. A head cartridge comprising:

a head supporting member having a holder bottom wall slidably supported by a head supporting member mounting portion of a head carriage of an ink-jet recording apparatus and on which an ink joint is formed, a holder side wall for guiding an ink tank inserted toward said holder bottom wall to said bottom wall, and an unloosen preventing member detachably engaged with a loosen preventing member for the head carriage when said holder bottom wall is slid on the head supporting member mounting portion, and arranged by a tank holder detachably holding the ink tank; and an ink-jet recording head arranged by a head chip with a plurality of ink exhausting outlets and an ink supplying path for communicating said plurality of ink exhausting outlets with an inside of said ink joint;

wherein a stopping member for stopping a stopped member of the ink tank when the ink tank is mounted is provided on said head supporting member; and said ink joint formed on said holder bottom wall is so constructed that when said ink tank is mounted on said supporting member, said ink joint is communicatable with the inside of said ink tank.

43. An ink tank detachably connected to a head supporting member of a head cartridge mounted on a head carriage of an ink-jet recording apparatus, comprising:

a tank case for storing therein a porous ink holding body for absorbing ink and having side wall guided along a holder side wall of said head supporting member;

a stopped member provided at a side surface of said tank case, and stopped by a stopping member of said holder side wall when the ink tank is mounted on said head supporting member; and a joint connection member connected with the ink joint when being depressed against the ink joint formed on said holder bottom wall, whereby an inside of the ink tank is communicated with an inside of the ink joint, and separated from the ink joint when a tension force along a separation direction from the ink joint is exerted, wherein said stopped member of the side wall of said tank case is a projection stopped to a stopping hole formed on said holder side wall as a stopping member.

* * * * *